US011262107B2

(12) United States Patent
Yoshioka et al.

(10) Patent No.: US 11,262,107 B2
(45) Date of Patent: Mar. 1, 2022

(54) HEAT EXCHANGER HAVING FIRST AND SECOND HEAT EXCHANGE UNITS WITH DIFFERENT REFRIGERANT FLOW RESISTANCES AND REFRIGERATION APPARATUS

(71) Applicant: DAIKIN INDUSTRIES, LTD., Osaka (JP)

(72) Inventors: Shun Yoshioka, Osaka (JP); Yoshiyuki Matsumoto, Osaka (JP); Shouta Agou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 225 days.

(21) Appl. No.: 16/497,737

(22) PCT Filed: Mar. 5, 2018

(86) PCT No.: PCT/JP2018/008286
§ 371 (c)(1),
(2) Date: Sep. 25, 2019

(87) PCT Pub. No.: WO2018/180240
PCT Pub. Date: Oct. 4, 2018

(65) Prior Publication Data

US 2021/0123638 A1 Apr. 29, 2021

(30) Foreign Application Priority Data

Mar. 27, 2017 (JP) ..... JP2017-061203
Mar. 27, 2017 (JP) ..... JP2017-061232
Mar. 27, 2017 (JP) ..... JP2017-061235

(51) Int. Cl.
*F25B 39/00* (2006.01)
*F25B 13/00* (2006.01)
(Continued)

(52) U.S. Cl.
CPC ..... *F25B 13/00* (2013.01); *F24F 11/84* (2018.01); *F25B 39/00* (2013.01); *F25B 41/39* (2021.01);
(Continued)

(58) Field of Classification Search
CPC ..... F24F 11/84; F25B 5/02; F25B 6/02; F25B 2600/2513
See application file for complete search history.

(56) References Cited

U.S. PATENT DOCUMENTS 5,529,116 A * 6/1996 Sasaki ..... F28D 1/0417 123/41.51
7,757,753 B2 7/2010 Yanik et al.
(Continued)

FOREIGN PATENT DOCUMENTS

CN 103256757 A 8/2013
EP 1 975 525 A1 10/2008
(Continued)

OTHER PUBLICATIONS

International Search Report for PCT/JP2018/008286 dated May 15, 2018.

*Primary Examiner* — Jonathan Bradford
(74) *Attorney, Agent, or Firm* — Birch, Stewart, Kolasch & Birch, LLP

(57) ABSTRACT

To improve the heat exchange efficiency of a heat exchanger that includes an upstream heat exchange unit and a downstream heat exchange unit. When the heat exchanger functions as an evaporator, a gas outlet pipe is an upstream refrigerant outlet that is located adjacent to the other end of upstream flat pipes of the upstream heat exchange unit, and a gas outlet pipe is a downstream refrigerant outlet that is located adjacent to the other end of downstream flat pipes of the downstream heat exchange unit. First resistance to refrigerant flow in the upstream heat exchange unit and
(Continued)

second resistance to refrigerant flow in the downstream heat exchange unit are adjusted in order that the degree of superheating of refrigerant at the downstream refrigerant outlet is smaller than the degree of superheating of refrigerant at the upstream refrigerant outlet.

17 Claims, 27 Drawing Sheets

(51) Int. Cl.

| | |
|---|---|
| ***F24F 11/84*** | (2018.01) |
| ***F25B 41/39*** | (2021.01) |
| ***F28D 1/02*** | (2006.01) |
| ***F28D 1/04*** | (2006.01) |
| ***F28F 1/32*** | (2006.01) |
| ***F25B 49/02*** | (2006.01) |
| *F28D 21/00* | (2006.01) |

(52) U.S. Cl.
CPC ..... *F25B 49/02* (2013.01); *F28D 1/024* (2013.01); *F28D 1/0426* (2013.01); *F28F 1/325* (2013.01); *F25B 2313/0233* (2013.01); *F25B 2600/2513* (2013.01); *F25B 2700/21162* (2013.01); *F25B 2700/21163* (2013.01); *F25B 2700/21174* (2013.01); *F25B 2700/21175* (2013.01); *F28D 2021/0061* (2013.01)

(56) References Cited

U.S. PATENT DOCUMENTS

| | | | | |
|---|---|---|---|---|
| 2012/0073786 | A1* | 3/2012 | Sakashita ..... | F24F 1/0007 165/104.14 |
| 2012/0234931 | A1* | 9/2012 | Hirota ..... | F25B 41/31 236/92 B |
| 2016/0327343 | A1 | 11/2016 | Hwang et al. | |
| 2017/0336145 | A1 | 11/2017 | Nakamura et al. | |
| 2018/0135900 | A1 | 5/2018 | Jindou et al. | |

FOREIGN PATENT DOCUMENTS

| | | | |
|---|---|---|---|
| EP | 3 015 808 | A1 | 5/2016 |
| JP | 8-244446 | A | 9/1996 |
| JP | H11-141968 | A | 5/1999 |
| JP | 2000-329486 | A | 11/2000 |
| JP | 2001-336896 | A | 12/2001 |
| JP | 2006-284134 | A | 10/2006 |
| JP | 2006-329511 | A | 12/2006 |
| JP | 2008-196811 | A | 8/2008 |
| JP | 2016-38192 | A | 3/2016 |
| WO | WO 2016-121125 | A1 | 8/2016 |
| WO | WO 2016/174830 | A1 | 11/2016 |

* cited by examiner

HEAT EXCHANGER HAVING FIRST AND SECOND HEAT EXCHANGE UNITS WITH DIFFERENT REFRIGERANT FLOW RESISTANCES AND REFRIGERATION APPARATUS

TECHNICAL FIELD

The present disclosure relates to a heat exchanger and a refrigeration apparatus, and, in particular, to a heat exchanger that is incorporated in a refrigerant circuit that performs a vapor compression refrigeration cycle and a refrigeration apparatus that performs a vapor compression refrigeration cycle.

BACKGROUND ART

Conventionally, a heat exchanger that is used in an air conditioner that conditions air by performing heat exchange using a vapor compression refrigeration cycle and that includes a flat pipe having a plurality of refrigerant channels is known. PTL 1 (Japanese Laid-open Patent Publication No. 2016-38192) describes a parallel-flow heat exchanger that is an example of such a heat exchanger. The parallel-flow heat exchanger includes an upstream heat exchanger, which is disposed upstream of the airflow and in which a plurality of flat pipes are disposed between two headers, and a downstream heat exchanger, which is disposed downstream of the airflow and in which a plurality of flat pipes are disposed between other two headers. When a heat exchanger includes such an upstream heat exchanger and such a downstream heat exchanger, air whose heat is to be exchanged exchanges heat twice while the air passes through the two heat exchangers.

SUMMARY OF THE INVENTION

Technical Problem

When the upstream heat exchanger and the downstream heat exchanger described in PTL 1 are used as evaporators, in order to facilitate control of the degree of superheating as a whole, it is general to adjust the degree of superheating of refrigerant at an outlet of the upstream heat exchanger and the degree of superheating of refrigerant at an outlet of the downstream heat exchanger to be approximately the same. However, if the degree of superheating of refrigerant at the outlet of the upstream heat exchanger and the degree of superheating of refrigerant at the outlet of the downstream heat exchanger are adjusted to be approximately the same, because air that has exchanged heat in the upstream heat exchanger is supplied to the downstream heat exchanger, it is difficult to reliably maintain a sufficient temperature difference between the temperature of refrigerant that flows in the downstream heat exchanger and the temperature of air that is supplied to the downstream heat exchanger. Moreover, the heat exchange efficiency decreases, because the flow rate area of superheated refrigerant in the downstream heat exchanger increases and the surface temperature of the heat exchanger increases.

When the upstream heat exchanger and the downstream heat exchanger described in PTL 1 are used as condensers, if the degree of subcooling of refrigerant at the outlet of the upstream heat exchanger and the degree of subcooling of refrigerant at the outlet of the downstream heat exchanger are to be adjusted to be approximately the same, because air that has exchanged heat in the upstream heat exchanger is supplied to the downstream heat exchanger, it is difficult to reliably maintain a sufficient temperature difference between the temperature of refrigerant that flows in the downstream heat exchanger and the temperature of air that is supplied to the downstream heat exchanger. Moreover, the heat exchange efficiency decreases, because the flow rate area of subcooled refrigerant in the downstream heat exchanger increases and the surface temperature of the heat exchanger decreases.

An object of the present disclosure is to improve the heat exchange efficiency of a heat exchanger that includes an upstream heat exchange unit and a downstream heat exchange unit.

Solution to Problem

A heat exchanger according to a first aspect is a heat exchanger that is incorporated in a refrigerant circuit in which a vapor compression refrigeration cycle is performed and that functions as an evaporator and/or a condenser. The heat exchanger includes an upstream heat exchange unit and a downstream heat exchange unit. The upstream heat exchange unit is disposed upstream of an airflow direction and includes a plurality of upstream flat pipes and an upstream refrigerant outlet. The plurality of upstream flat pipes are arranged in a direction that crosses the airflow direction and have one end and the other end. The upstream refrigerant outlet is located adjacent to the other end of the plurality of upstream flat pipes. The downstream heat exchange unit is disposed downstream of the upstream heat exchange unit and includes a plurality of downstream flat pipes and a downstream refrigerant outlet. The plurality of downstream flat pipes are arranged in a direction that crosses the airflow direction and have one end and the other end. The downstream refrigerant outlet is located adjacent to the other end of the plurality of downstream flat pipes. First resistance to refrigerant flow in the upstream heat exchange unit and second resistance to refrigerant flow in the downstream heat exchange unit are adjusted, so that a degree of superheating of refrigerant at the downstream refrigerant outlet is smaller than a degree of superheating of refrigerant at the upstream refrigerant outlet when the heat exchanger functions as an evaporator or so that a degree of subcooling of refrigerant at the downstream refrigerant outlet is smaller than a degree of subcooling of refrigerant at the upstream refrigerant outlet when the heat exchanger functions as a condenser.

In the heat exchanger according to the first aspect, the difference between the first resistance and the second resistance are adjusted, so that the degree of superheating of refrigerant at the downstream refrigerant outlet is smaller than the degree of superheating of refrigerant at the upstream refrigerant outlet or so that the degree of subcooling of refrigerant at the downstream refrigerant outlet is smaller than the degree of subcooling of refrigerant at the upstream refrigerant outlet. Therefore, it is possible to make a superheated region in which superheated refrigerant flows or a subcooled region in which subcooled refrigerant flows in the downstream heat exchange unit sufficiently small.

A heat exchanger according to a second aspect is the heat exchanger according to the first aspect, in which the upstream heat exchange unit and the downstream heat exchange unit are configured in order that: refrigerants flow in the upstream flat pipes and the downstream flat pipes in directions opposite to each other; air that has passed through a vicinity of the one end of the upstream flat pipes passes through a vicinity of the other end of the downstream flat pipes; and air that has passed through a vicinity of the other end of the upstream flat pipes passes through a vicinity of the one end of the downstream flat pipes.

In the heat exchanger according to the second aspect, air that has passed through the vicinity of the one end of the upstream flat pipes, that is, an inflow region of the upstream heat exchange unit passes through the vicinity of the other end of the downstream flat pipes, that is, an outflow region of the downstream heat exchange unit; and air that has passed through the vicinity of the other end of the upstream flat pipes, that is, an outflow region of the upstream heat exchange unit passes through the vicinity of the one end of the downstream flat pipes, that is, an inflow region of the downstream heat exchange unit.

A heat exchanger according to a third aspect is the heat exchanger according to the first aspect or the second aspect, further including: a temperature difference detector that is configured to detect a difference between a degree of superheating of refrigerant at a refrigerant outlet of the upstream heat exchange unit and a degree of superheating of refrigerant at a refrigerant outlet of the downstream heat exchange unit when the heat exchanger functions as an evaporator or that is configured to detect a difference between a degree of subcooling of refrigerant at the refrigerant outlet of the upstream heat exchange unit and a degree of subcooling of refrigerant at the refrigerant outlet of the downstream heat exchange unit when the heat exchanger functions as a condenser; and a first flow-rate adjusting valve that is configured to adjust a difference between the first resistance and the second resistance in order that a temperature difference detected by the temperature difference detector is a first threshold or larger in degree of superheating or a second threshold or larger in degree of subcooling.

In the heat exchanger according to the third aspect, the first flow-rate adjusting valve adjusts the difference between the first resistance and the second resistance in order that the temperature difference detected by the temperature difference detector is the first threshold or larger in degree of superheating and is the second threshold or larger in degree of subcooling. Therefore, it is possible to reliably maintain the first threshold in degree of superheating or the second threshold in degree of subcooling by changing the flow-rate adjusting valve, even when the state of refrigerant and/or air that flows in the heat exchanger changes.

A heat exchanger according to a fourth aspect is the heat exchanger according to the first aspect or the second aspect, in which, in the upstream heat exchange unit and the downstream heat exchange unit, a difference between the first resistance and the second resistance is adjusted beforehand so as to generate a difference in degree of superheating that is a first threshold or larger when the heat exchanger functions as an evaporator or so as to generate a difference in degree of subcooling that is a second threshold or larger when the heat exchanger functions as a condenser.

In the heat exchanger according to the fourth aspect, in the upstream heat exchange unit and the downstream heat exchange unit, the difference between the first resistance and the second resistance is adjusted beforehand so as to be the first threshold or larger in degree of superheating or the second threshold or larger in degree of subcooling. Therefore, it is possible to easily and reliably maintain the first threshold in degree of superheating or the second threshold in degree of subcooling in the use ranges of the upstream heat exchange unit and the downstream heat exchange unit.

A heat exchanger according to a fifth aspect is the heat exchanger according to the third aspect or the fourth aspect, in which the first threshold or the second threshold has a value of 3° C. or larger.

In the heat exchanger according to the fifth aspect, the difference in degree of superheating or degree of subcooling between refrigerant at the downstream refrigerant outlet and refrigerant at the upstream refrigerant outlet is 3° C. or larger. Therefore, it is possible to reliably maintain the degree of superheating or the degree of subcooling by using the upstream heat exchange unit whose heat exchange efficiency is higher than that of the downstream heat exchange unit.

A heat exchanger according to a sixth aspect is the heat exchanger according to any one of the first aspect to the fifth aspect, in which, in the downstream heat exchange unit, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller.

In the heat exchanger according to the sixth aspect, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller. Therefore, it is possible to sufficiently enlarge the superheated region or the subcooled region of the downstream heat exchange unit.

A heat exchanger according to a seventh aspect is the heat exchanger according to any one of the first aspect to the sixth aspect, in which the first resistance and the second resistance are set in order that the degree of superheating of refrigerant at the downstream refrigerant outlet is constantly smaller than the degree of superheating of refrigerant at the upstream refrigerant outlet when the heat exchanger functions as an evaporator or in order that the degree of subcooling of refrigerant at the downstream refrigerant outlet is constantly smaller than the degree of subcooling of refrigerant at the upstream refrigerant outlet when the heat exchanger functions as a condenser, in a state in which the refrigerant circuit is stably operating.

In the heat exchanger according to the seventh aspect, the first resistance and the second resistance are set in order that the degree of superheating of refrigerant at the downstream refrigerant outlet is constantly smaller than the degree of superheating of refrigerant at the upstream refrigerant outlet or in order that the degree of subcooling of refrigerant at the downstream refrigerant outlet is constantly smaller than the degree of subcooling of refrigerant at the upstream refrigerant outlet, in a state in which the refrigerant circuit is stably operating. Therefore, it is possible to make the superheated region in which superheated refrigerant flows or the subcooled region in which subcooled refrigerant flows sufficiently small in the entirety of the stable operating range of the refrigerant circuit. The phrase "a state in which the refrigerant circuit is stably operating" refers to a state that is not a transient state such as during startup of the refrigerant circuit and in which constituent devices of the refrigerant circuit are operated while keeping constant conditions.

A heat exchanger according to an eighth aspect is the heat exchanger according to any one of the first aspect to the seventh aspect, in which the upstream heat exchange unit further includes a first upstream refrigerant outlet through which refrigerant that flows in from an upstream refrigerant inlet that is located adjacent to the one end of the plurality of upstream flat pipes flows out when the heat exchanger functions as a condenser, and a second upstream refrigerant outlet through which refrigerant that flows in from a downstream refrigerant inlet that is located adjacent to the one end of the plurality of upstream flat pipes flows out when the heat exchanger functions as a condenser.

In the heat exchanger according to the eighth aspect, the upstream heat exchange unit includes the second upstream refrigerant outlet, which is located adjacent to the one end of the plurality of upstream flat pipes and through which refrigerant flows out when the heat exchanger functions as a condenser. Therefore, refrigerant that flows in the downstream heat exchange unit can be subcooled by using the upstream heat exchange unit.

A heat exchanger according to a ninth aspect is the heat exchanger according to any one of the first aspect to the eighth aspect, further including a first connection pipe in which refrigerant that flows out from the upstream heat exchange unit and refrigerant that flows out from the downstream heat exchange unit join and flow together when the heat exchanger functions as an evaporator.

In the heat exchanger according to the ninth aspect, because the heat exchanger includes the first connection pipe, the relationship between the first resistance and the second resistance when the heat exchanger functions as an evaporator does not easily change when, for example, the heat exchanger is transported.

A heat exchanger according to a tenth aspect is the heat exchanger according to any one of the first aspect to the ninth aspect, further including a second connection pipe in which refrigerant that flows out from the upstream heat exchange unit and refrigerant that flows out from the downstream heat exchange unit join and flow together when the heat exchanger functions as a condenser.

In the heat exchanger according to the tenth aspect, because the heat exchanger includes the second connection pipe, the relationship between the first resistance and the second resistance when the heat exchanger functions as a condenser does not easily change when, for example, the heat exchanger is transported.

A heat exchanger according to an eleventh aspect is the heat exchanger according to any one of the first aspect to the tenth aspect, further including a second flow-rate adjusting valve that adjusts a flow rate of refrigerant that flows into the upstream heat exchange unit and the downstream heat exchange unit before a flow of the refrigerant is split when the heat exchanger functions as an evaporator; and/or a third flow-rate adjusting valve that adjusts a flow rate of refrigerant that flows out from the upstream heat exchange unit and the downstream heat exchange unit after flows of the refrigerant have joined when the heat exchanger functions as a condenser.

In the heat exchanger according to the eleventh aspect, compared with a case where the second flow-rate adjusting valve and/or the third flow-rate adjusting valve are/is retrofitted, it is easy to perform adjustment related to the second flow-rate adjusting valve and/or the third flow-rate adjusting valve when incorporating the heat exchanger in the refrigerant circuit.

A refrigeration apparatus according to a twelfth aspect includes: a compressor that is incorporated in a refrigerant circuit in which a vapor compression refrigeration cycle is performed; and a heat exchanger that is disposed on a suction side or a discharge side of the compressor and that performs heat exchange that evaporates refrigerant sucked into the compressor or heat exchange that condenses refrigerant discharged from the compressor. The heat exchanger includes: an upstream heat exchange unit that is disposed upstream of an airflow direction and that includes a plurality of upstream flat pipes that are arranged in a direction that crosses the airflow direction, an upstream refrigerant inlet that is located adjacent to one end of the plurality of upstream flat pipes, and an upstream refrigerant outlet that is located adjacent to the other end of the plurality of upstream flat pipes; and a downstream heat exchange unit that is disposed downstream of the upstream heat exchange unit and that includes a plurality of downstream flat pipes that are arranged in a direction that crosses the airflow direction, a downstream refrigerant inlet that is located adjacent to the one end of the plurality of downstream flat pipes, and a downstream refrigerant outlet that is located adjacent to the other end of the plurality of upstream flat pipes. First resistance to refrigerant that flows in the upstream heat exchange unit and second resistance to refrigerant that flows in the downstream heat exchange unit are adjusted, so that a degree of superheating of refrigerant at the downstream refrigerant outlet is smaller than a degree of superheating of refrigerant at the upstream refrigerant outlet when the heat exchanger functions as an evaporator or so that a degree of subcooling of refrigerant at the downstream refrigerant outlet is smaller than a degree of subcooling of refrigerant at the upstream refrigerant outlet when the heat exchanger functions as a condenser.

In the refrigeration apparatus according to the twelfth aspect, the difference between the first resistance of the upstream heat exchange unit and the second resistance of the downstream heat exchange unit are adjusted, so that the degree of superheating of refrigerant at the downstream refrigerant outlet is smaller than the degree of superheating of refrigerant at the upstream refrigerant outlet or so that the degree of subcooling of refrigerant at the downstream refrigerant outlet is smaller than the degree of subcooling of refrigerant at the upstream refrigerant outlet. Therefore, it is possible to make a superheated region in which superheated refrigerant flows or a subcooled region in which subcooled refrigerant flows in the downstream heat exchange unit sufficiently small.

A refrigeration apparatus according to a thirteenth aspect is the refrigeration apparatus according to the twelfth aspect, in which the first resistance and the second resistance are set in order that the degree of superheating of refrigerant at the downstream refrigerant outlet is constantly smaller than the degree of superheating of refrigerant at the upstream refrigerant outlet when the heat exchanger functions as an evaporator or in order that the degree of subcooling of refrigerant at the downstream refrigerant outlet is constantly smaller than the degree of subcooling of refrigerant at the upstream refrigerant outlet when the heat exchanger functions as a condenser, in a state in which the compressor is stably operated at a constant operation frequency.

In the refrigeration apparatus according to the thirteenth aspect, it is possible to make the superheated region in which superheated refrigerant flows or the subcooled region in which subcooled refrigerant flows sufficiently small in a state in which the compressor is stably operated at a constant operation frequency.

Advantageous Effects of Invention

The heat exchanger according to the first aspect can improve the heat exchange efficiency.

The heat exchanger according to the second aspect reduces variation in temperature of conditioned air that passes through the upstream heat exchange unit and the downstream heat exchange unit. Although the heat exchange efficiency tends to decrease when refrigerants flow in the upstream heat exchange unit and the downstream heat exchange unit in opposite directions, decrease of the heat exchange efficiency is considerably reduced by making the superheated region or the subcooled region small.

The heat exchanger according to the third aspect can improve the heat exchange efficiency even when the state of refrigerant and/or air changes in the upstream heat exchange unit and the downstream heat exchange unit.

The heat exchanger according to the fourth aspect can improve the heat exchange efficiency at low cost.

The heat exchanger according to the fifth aspect can perform stable heat exchange and sufficiently improve the heat exchange efficiency.

The heat exchanger according to the sixth aspect can sufficiently improve the heat exchange efficiency.

The heat exchanger according to the seventh aspect can improve the heat exchange efficiency in the entirety of the stable operation range of the refrigerant circuit.

The heat exchanger according to the eighth aspect can improve the performance of the heat exchanger by adequately and reliably maintaining subcooled refrigerant.

The heat exchanger according to the ninth aspect or the tenth aspect facilitates handling of an indoor heat exchanger.

The heat exchanger according to the eleventh aspect facilitates incorporation of the heat exchanger in the refrigerant circuit.

The refrigeration apparatus according to the twelfth aspect can improve the heat exchange efficiency.

The refrigeration apparatus according to the thirteenth aspect can improve the heat exchange efficiency in a state in which the compressor is stably operated at a constant operation frequency.

DESCRIPTION OF EMBODIMENTS

First Embodiment

Hereinafter, a heat exchanger and a refrigeration apparatus according to a first embodiment will be described with reference to the drawings. In the following embodiment, a refrigeration apparatus including a ceiling-mounted air conditioner is described as an example. A heat exchanger disposed in the ceiling-mounted air conditioner is described as an example of a heat exchanger according to the first embodiment.

(1) Overall Structure

Figure 1:
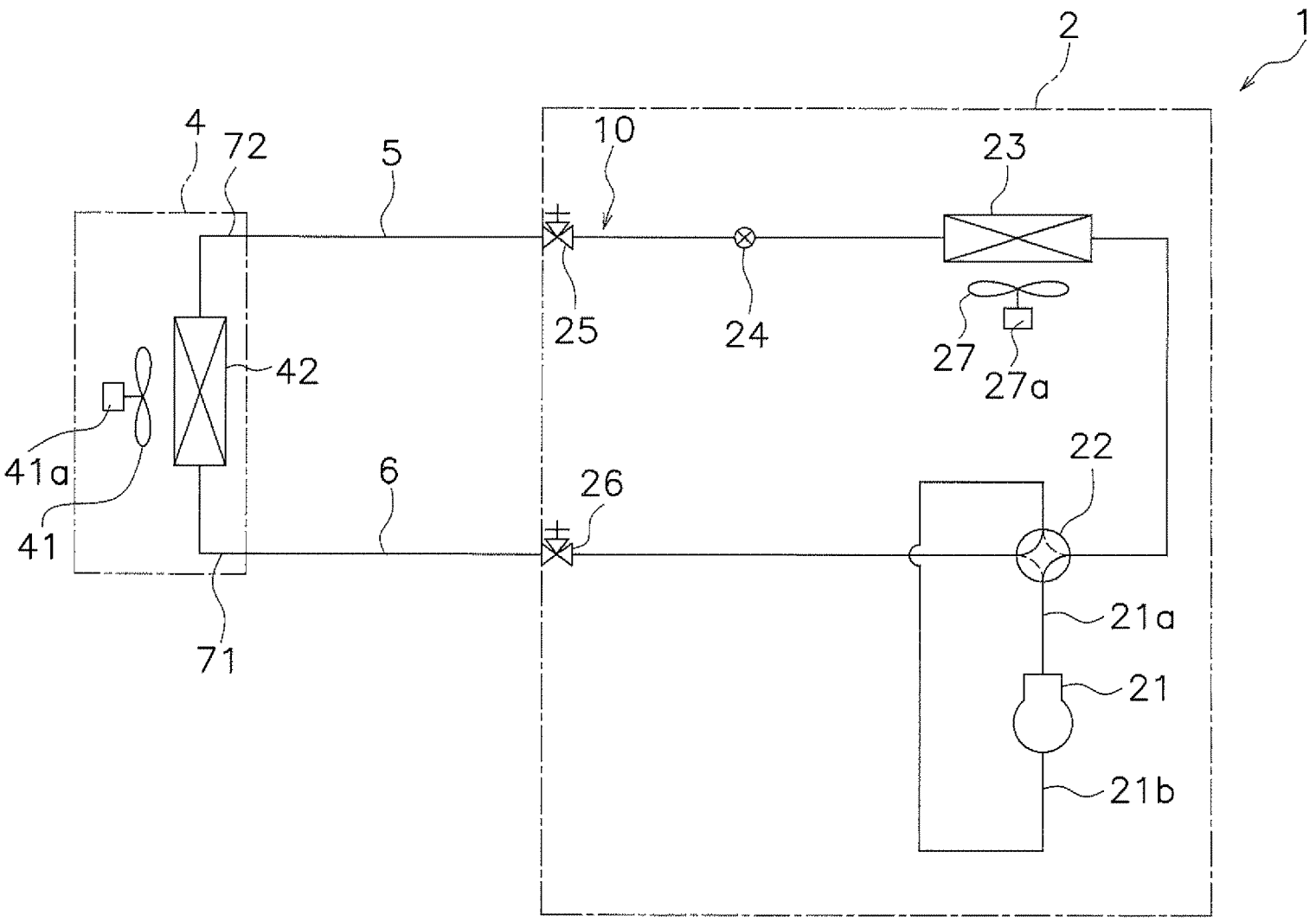
FIG. 1 is a circuit diagram of a refrigeration apparatus according to a first embodiment.

FIG. 1 illustrates the overall structure of a refrigeration apparatus according to the first embodiment. A refrigeration apparatus 1 illustrated in FIG. 1 includes an outdoor unit 2, an indoor unit 4, a liquid-refrigerant connection pipe 5, and a gas-refrigerant connection pipe 6. In this way, in the refrigeration apparatus 1, the outdoor unit 2 is set outdoors, the indoor unit 4 is installed indoors, and the outdoor unit 2 and the indoor unit 4 are connected to each other via the liquid-refrigerant connection pipe 5, the gas-refrigerant connection pipe 6, and the like. The outdoor unit 2 includes a compressor 21, a four-way switching valve 22, an outdoor heat exchanger 23, an expansion valve 24, a liquid-side shutoff valve 25, a gas-side shutoff valve 26, and an outdoor fan 27. The indoor unit 4, which is a ceiling-mounted air conditioner of a ceiling embedded type, includes an indoor heat exchanger 42 and an indoor fan 41.

A refrigerant circuit 10, which performs a vapor compression refrigeration cycle, is formed in the refrigeration apparatus 1, as the outdoor unit 2 and the indoor unit 4 are connected to each other via the liquid-refrigerant connection pipe 5 and the gas-refrigerant connection pipe 6. The compressor 21 is incorporated in the refrigerant circuit 10. The compressor 21 sucks low-pressure gas refrigerant, compresses and converts the low-pressure gas refrigerant into high-temperature high-pressure gas refrigerant, and then discharges the high-temperature high-pressure gas refrigerant. For example, the compressor 21 is a positive displacement inverter compressor whose rotation speed is controlled by an inverter. As the operation frequency of the compressor 21 increases, the amount of refrigerant that circulates in the refrigerant circuit 10 increases. As the operation frequency of the compressor 21 decreases, the amount of refrigerant that circulates in the refrigerant circuit 10 decreases. In the present embodiment, the phrase "a state in which the refrigerant circuit 10 is stably operating" refers to a state that is not a transitory state such as during startup of the refrigerant circuit 10 and in which constituent devices of the refrigerant circuit 10 are operated while keeping constant conditions. An example of such a state is a state in which, within an operating range of the refrigerant circuit 10, the operation frequency of the compressor 21 is constant, the rotation speeds of the outdoor fan 27 and the indoor fan 41 are constant, and the expansion-valve opening degree of the expansion valve 24 is constant.

The four-way switching valve 22 is a valve for switching the direction of flow of refrigerant when switching between cooling and heating. The four-way switching valve 22 can switch between a state shown by a solid line, in which refrigerant flows between a first port and a second port and refrigerant flows also between a third port and a fourth port; and a state shown by a broken line, in which refrigerant flows between the first port and the fourth port and refrigerant flows also between the second port and the third port. These ports of the four-way switching valve 22 are connected as follows: the discharge side (a discharge pipe 21*a*) of the compressor 21 is connected to the first port, the outdoor heat exchanger 23 is connected to the second port, the suction side (a suction pipe 21*b*) of the compressor 21 is connected to the third port, and the indoor heat exchanger 42 is connected to the fourth port via the gas-side shutoff valve 26 and the gas-refrigerant connection pipe 6.

The outdoor heat exchanger 23 exchanges heat between refrigerant that flows in heat transfer tubes (not shown) and outdoor air. The outdoor heat exchanger 23 functions as a condenser that releases heat from refrigerant during a cooling operation, and functions as an evaporator that provides heat to refrigerant during a heating operation.

The expansion valve 24 is disposed between the outdoor heat exchanger 23 and the indoor heat exchanger 42. The expansion valve 24 has a function of expanding and decompressing refrigerant that flows between the outdoor heat exchanger 23 and the indoor heat exchanger 42. The expansion valve 24 is structured so that the expansion-valve opening degree can be changed. When the expansion-valve opening degree is reduced, channel resistance to refrigerant that passes through the expansion valve 24 increases. When the expansion-valve opening degree is increased, channel resistance to refrigerant that passes through the expansion valve 24 decreases. In a heating operation, the expansion valve 24 expands and decompresses refrigerant that flows from the indoor heat exchanger 42 toward the outdoor heat exchanger 23. In a cooling operation, the expansion valve 24 expands and decompresses refrigerant that flows from the outdoor heat exchanger 23 toward the indoor heat exchanger 42.

The outdoor unit 2 includes the outdoor fan 27 for sucking outdoor air into the outdoor unit 2, supplying the outdoor air to the outdoor heat exchanger 23, and then discharging the air that has exchanged heat to the outside of the outdoor unit 2. The outdoor fan 27 promotes the function of the outdoor heat exchanger 23 in cooling and/or evaporating refrigerant by using outdoor air as a cooling source or a heating source. The outdoor fan 27 is driven by an outdoor fan motor 27*a* whose rotation speed can be changed.

Figure 4:
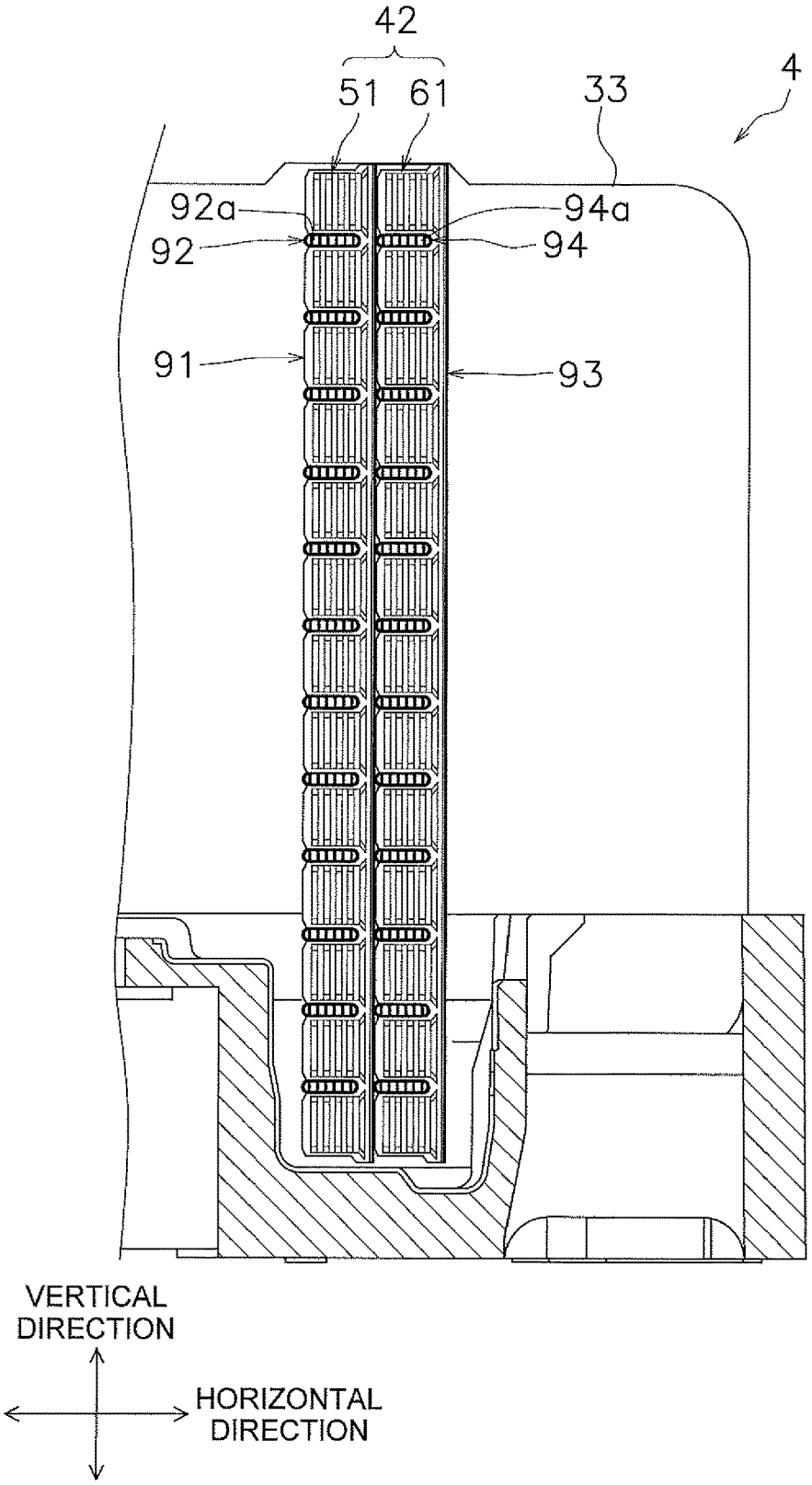
FIG. 4 is a partial enlarged sectional view of an indoor heat exchanger of the indoor unit of FIG. 3.

As illustrate in FIG. 4, the indoor heat exchanger 42 includes, for example, a plurality of upstream fins 91, a plurality of upstream flat pipes 92 that cross the plurality of upstream fins 91, a plurality of downstream fins 93, and a plurality of downstream flat pipes 94 that cross the plurality of downstream fins 93. The indoor heat exchanger 42 performs heat exchange between indoor air and refrigerant that flows in the upstream flat pipes 92 and the downstream flat pipes 94. Each of the upstream flat pipes 92 has a plurality of refrigerant channels 92*a*, and each of the downstream flat pipes 94 has a plurality of refrigerant channels 94*a*. The structure of the indoor heat exchanger 42 will be described below in detail.

The indoor unit 4 includes the indoor fan 41 for sucking indoor air into the indoor unit 4, supplying the indoor air to the indoor heat exchanger 42, and then discharging the air that has exchanged heat to the outside of the indoor unit 4. The indoor fan 41 promotes the function of the indoor heat exchanger 42 in cooling and/or evaporating refrigerant by using indoor air as a cooling source or a heating source. The indoor fan 41 is driven by an indoor fan motor 41*a* whose rotation speed can be changed.

(2) Basic Operations (2-1) Cooling Operation

During a cooling operation, the four-way switching valve 22 of the refrigerant circuit 10 is in a state shown by a solid line in FIG. 1. The liquid-side shutoff valve 25 and the gas-side shutoff valve 26 are open, and the opening degree of the expansion valve 24 is adjusted so as to decompress refrigerant.

When the compressor 21 is driven in the refrigerant circuit 10 during a cooling operation, low-pressure gas refrigerant is sucked into the compressor 21 through the suction pipe 21*b*, compressed by the compressor 21, and discharged from the discharge side (the discharge pipe 21*a*) of the compressor 21. High-temperature high-pressure gas refrigerant discharged from the compressor 21 passes through the first port and the second port of the four-way switching valve 22, and enters the outdoor heat exchanger 23. The high-temperature high-pressure gas refrigerant condenses by exchanging heat with outdoor air in the outdoor heat exchanger 23 and becomes high-pressure liquid refrigerant. The high-pressure liquid refrigerant is supplied to the expansion valve 24, is decompressed by the expansion valve 24, and becomes low-pressure gas-liquid two-phase refrigerant. The low-pressure gas-liquid two-phase refrigerant is supplied to the indoor heat exchanger 42 through the liquid-side shutoff valve 25, the liquid-refrigerant connection pipe 5, and a liquid-side connection pipe 72. In the indoor heat exchanger 42, the low-pressure gas-liquid two-phase refrigerant evaporates by exchanging heat with air that is blown out from the indoor fan 41, and becomes low-pressure gas refrigerant. The low-pressure gas refrigerant that has flowed out from the indoor heat exchanger 42 passes through a gas-side connection pipe 71, the gas-refrigerant connection pipe 6, the gas-side shutoff valve 26, the fourth port of the four-way switching valve 22, and the third port of the four-way switching valve 22; and is supplied again to the suction side (the suction pipe 21*b*) of the compressor 21.

(2-2) Heating Operation

Next, during a heating operation, the four-way switching valve 22 of the refrigerant circuit 10 is in a state shown by a broken line in FIG. 1. The liquid-side shutoff valve 25 and the gas-side shutoff valve 26 are open, and the opening degree of the expansion valve 24 is adjusted so as to decompress refrigerant.

When the compressor 21 is driven in the refrigerant circuit 10 during the heating operation, low-pressure gas refrigerant is sucked into the compressor 21 through the suction pipe 21*b*, compressed by the compressor 21, and discharged from the discharge side (the discharge pipe 21*a*) of the compressor 21. High-temperature high-pressure gas refrigerant discharged from the compressor 21 passes through the first port and the fourth port of the four-way switching valve 22, the gas-side shutoff valve 26, the gas-refrigerant connection pipe 6, and the gas-side connection pipe 71; and enters the indoor heat exchanger 42. The high-temperature high-pressure gas refrigerant condenses by exchanging heat with indoor air that is blown out from the indoor fan 41 in the indoor heat exchanger 42. The high-pressure liquid refrigerant is supplied to the expansion valve 24 through the liquid-side connection pipe 72, the liquid-refrigerant connection pipe 5, and the liquid-side shutoff valve 25; is decompressed by the expansion valve 24; and becomes low-pressure gas-liquid two-phase refrigerant. The low-pressure gas-liquid two-phase refrigerant discharged from the expansion valve 24 enters the outdoor heat exchanger 23. In the outdoor heat exchanger 23, the low-pressure gas-liquid two-phase refrigerant evaporates by exchanging heat with outdoor air. The low-pressure gas refrigerant flowed out from the outdoor heat exchanger 23 passes through the second port and the third port of the four-way switching valve 22, and is supplied again to the suction side (the suction pipe 21*b*) of the compressor 21.

(3) Detailed Structure (3-1) Indoor Unit 4

Figure 2:
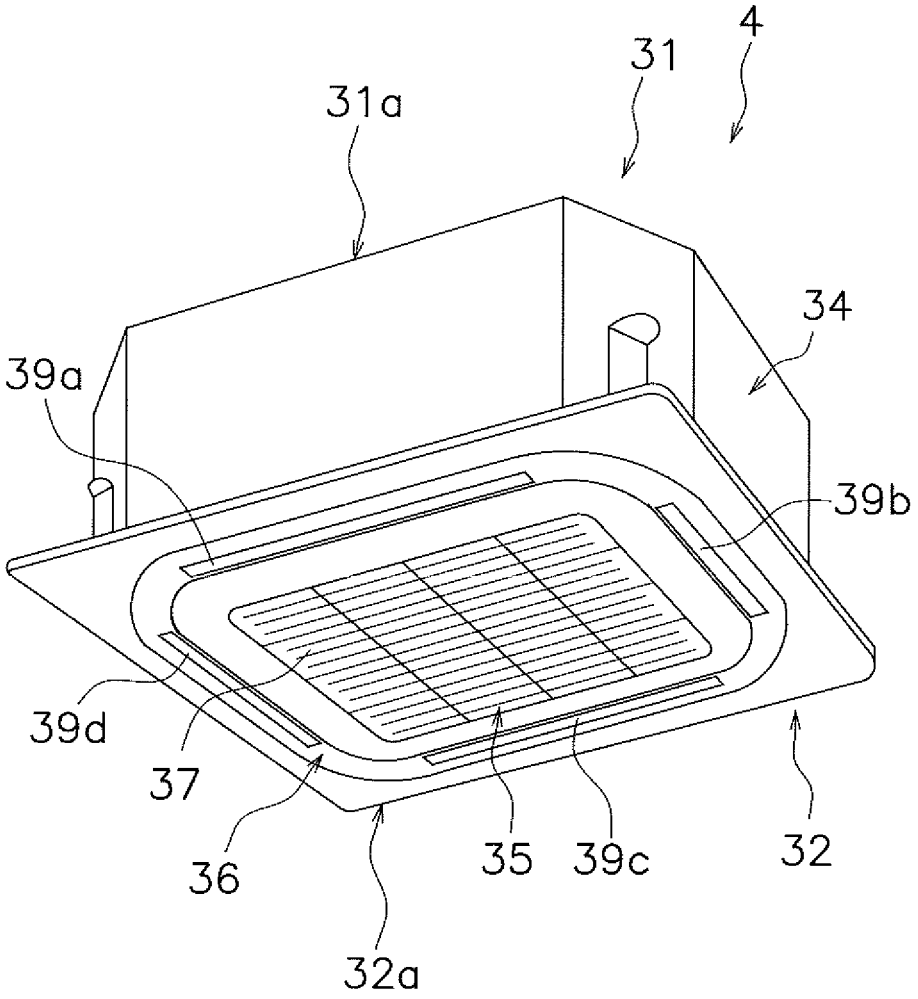
FIG. 2 is an external perspective view of an indoor unit according to the first embodiment.
Figure 3:
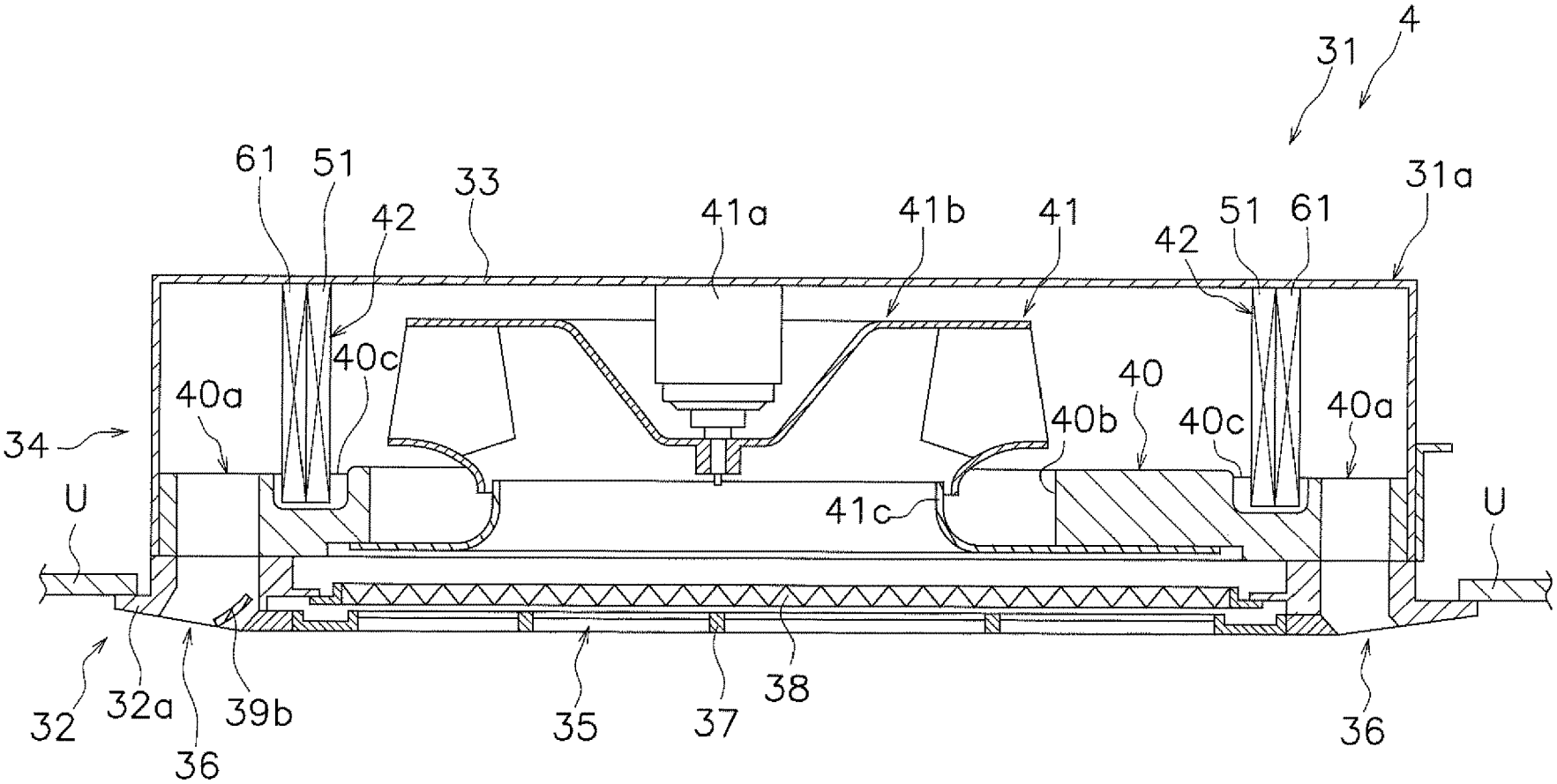
FIG. 3 is a sectional view illustrating the inside of the indoor unit of FIG. 2.

FIG. 2 is an external view of the indoor unit 4, and FIG. 3 is a sectional view of the indoor unit 4. The indoor unit 4 has a casing 31 that contains various constituent devices. The casing 31 includes a casing body 31*a* and a decorative panel 32 disposed on the lower side of the casing body 31*a*. As illustrated in FIG. 3, for example, the casing body 31*a* is inserted into an opening in a ceiling U of a room to be air-conditioned. The decorative panel 32 is disposed so as to be fitted into the opening of the ceiling U. The casing body 31*a* includes a top plate 33 that has a substantially octagonal shape in which long sides and short sides are formed continuously and alternately in plan view, and a side plate 34 that extends downward from the peripheral edge portion of the top plate 33.

The decorative panel 32 is a plate-shaped member that has a substantially quadrangular shape in plan view, and includes a panel body 32*a* that is fixed to a lower end portion of the casing body 31*a*. The panel body 32*a* has a suction opening 35, for sucking air in a room to be air-conditioned, at substantially the center thereof; and a blow-out opening 36, which surrounds the suction opening 35 in plan view and which blows out air to the room to be air-conditioned. The suction opening 35 is a substantially quadrangular opening. In the suction opening 35, a suction grille 37 and a filter 38, for removing dust in air that is sucked from the suction opening 35, are disposed. The blow-out opening 36 is a substantially quadrangular-ring-shaped opening. In the blow-out opening 36, horizontal flaps 39*a*, 39*b*, 39*c*, and 39*d* for adjusting the airflow direction of air that is blown into the room to be air-conditioned are disposed so as to correspond to the four sides of the quadrangular shape of the panel body 32*a*.

In the casing body 31*a*, mainly, the indoor fan 41 and the indoor heat exchanger 42 are disposed. The indoor fan 41 sucks air in the room to be air-conditioned into the casing body 31*a* through the suction opening 35 of the decorative panel 32, and discharges the air from the inside of the casing body 31*a* through the blow-out opening 36 of the decorative panel 32.

The indoor fan 41 includes the indoor fan motor 41*a* that is disposed at the center of the top plate 33 of the casing body 31*a*, and an impeller 41*b* that is coupled to and rotated by the indoor fan motor 41*a*. The impeller 41*b*, which is an impeller having turbine blades, can suck air into the impeller 41*b* from below and blow out the air toward the outer periphery of the impeller 41*b* in plan view.

Below the indoor heat exchanger 42, a drain pan 40 for receiving drain water, which is generated when water vapor condenses in the indoor heat exchanger 42, is disposed. The drain pan 40 is attached to a lower portion of the casing body 31*a*. The drain pan 40 has a blow-out hole 40*a*, a suction hole 40*b*, and a drain water receiving groove 40*c*. The blow-out hole 40*a* communicates with the blow-out opening 36 of the decorative panel 32. The suction hole 40*b* communicates with the suction opening 35 of the decorative panel 32. The drain water receiving groove 40*c* is formed in a lower portion of the indoor heat exchanger 42. In the suction hole 40*b* of the drain pan 40, a bell mouth 41*c*, for guiding air sucked from the suction opening 35 to the impeller 41*b* of the indoor fan, is disposed.

(3-2) Indoor Heat Exchanger 42

(3-2-1) Structure of Indoor Heat Exchanger 42

The indoor heat exchanger 42 in a heat exchanger that includes an upstream heat exchange unit 51 and a downstream heat exchange unit 61, and is incorporated in the refrigerant circuit 10 that performs a vapor compression refrigeration cycle. The upstream heat exchange unit 51 is disposed in the indoor heat exchanger 42 on the upstream side in the airflow direction indicated by arrow Ar1. In other words, the upstream heat exchange unit 51 is located on the upstream side of the downstream heat exchange unit 61. The plurality of upstream flat pipes 92 of the upstream heat exchange unit 51 are arranged in a direction that crosses the airflow direction. To be more specific, as illustrated in FIG. 4, the plurality of upstream flat pipes 92 are arranged in the vertical direction. The downstream heat exchange unit 61 is disposed in the indoor heat exchanger 42 on the downstream side in the airflow direction. The plurality of downstream flat pipes 94 of the downstream heat exchange unit 61 are arranged in a direction that crosses the airflow direction. To be more specific, as illustrated in FIG. 4, the plurality of downstream flat pipes 94 are arranged in the vertical direction.

Figure 5:
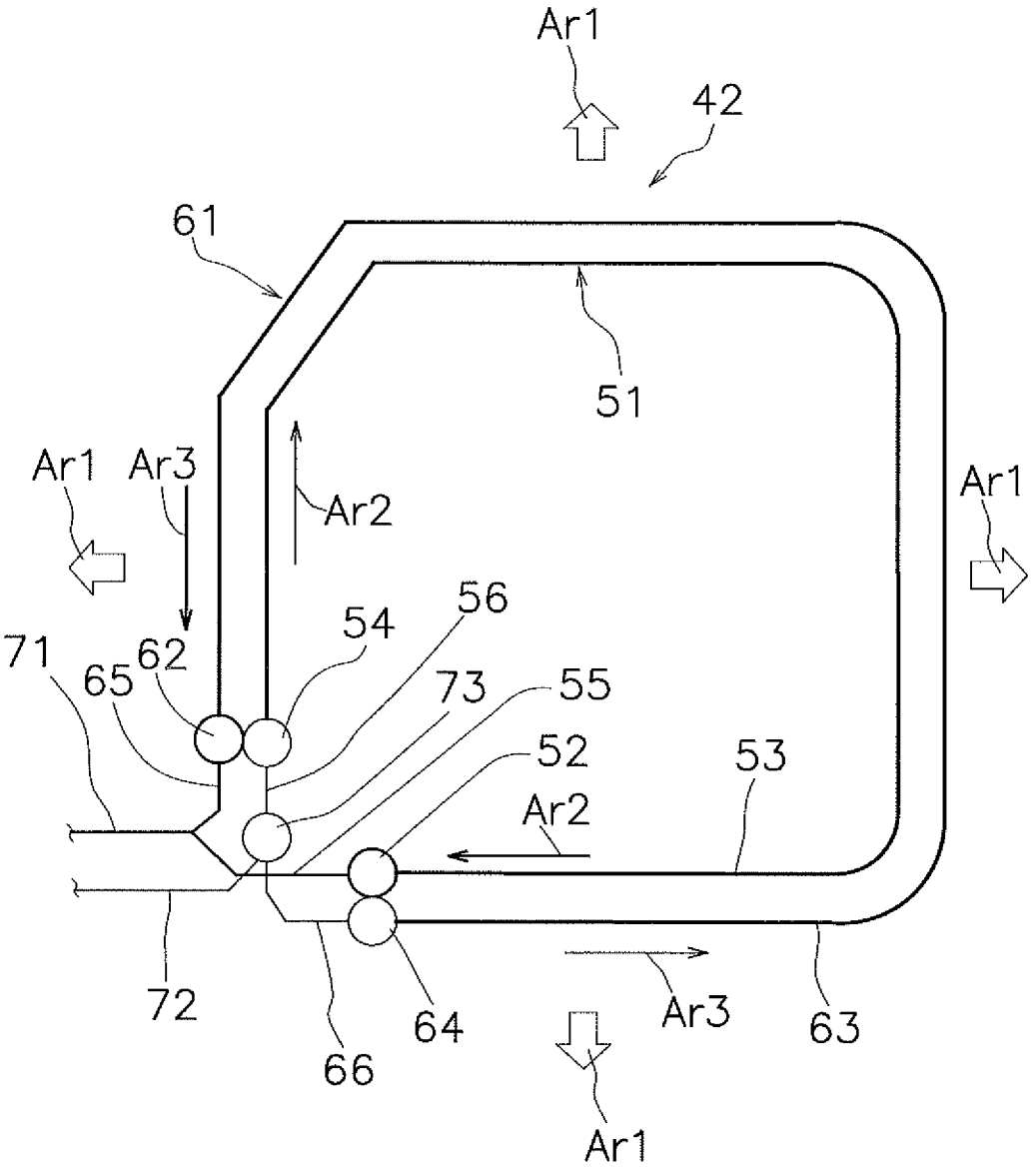
FIG. 5 is a schematic plan view of the indoor heat exchanger that functions as an evaporator.
Figure 6:
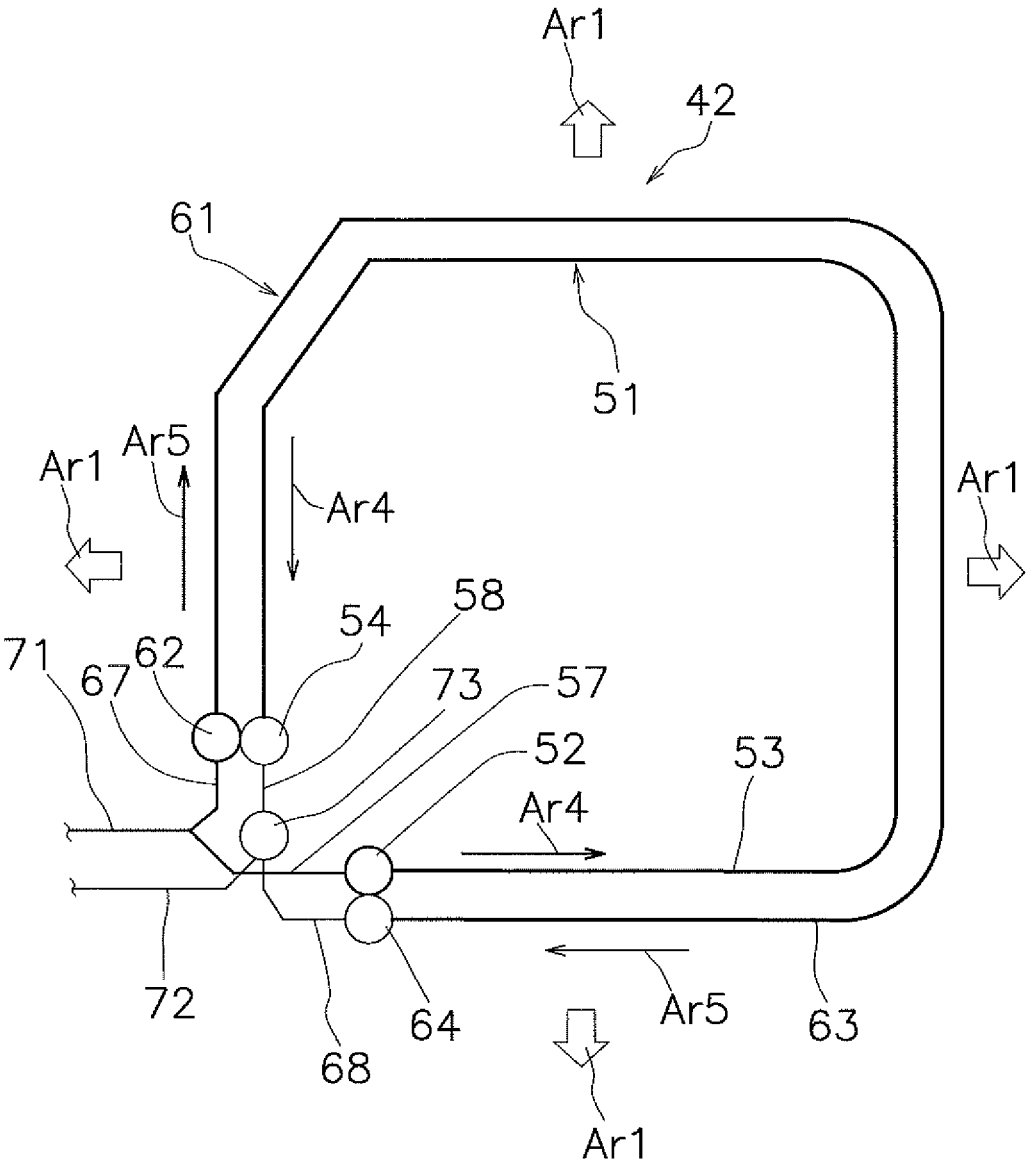
FIG. 6 is a schematic plan view of the indoor heat exchanger that functions as a condenser.

The indoor heat exchanger 42 is bent so as to surround the indoor fan 41 in plan view. FIGS. 5 and 6 schematically illustrate the configuration of the indoor heat exchanger 42 in plan view. Arrow Ar1 in FIGS. 5 and 6 indicates the direction of airflow. Arrows Ar2 and Ar3 in FIG. 5 indicate the flow of refrigerant during a cooling operation. Arrows Ar4 and Ar5 in FIG. 6 indicate the flow of refrigerant during a heating operation. In the indoor heat exchanger 42 illustrated in FIGS. 3 to 5, a side near to the indoor fan 41 is the upstream side. Therefore, the upstream heat exchange unit 51 and the downstream heat exchange unit 61 are arranged in this order from a side near the indoor fan 41. The upstream heat exchange unit 51 includes an upstream first header manifold 52, an upstream heat exchange region 53, and an upstream second header manifold 54. The upstream heat exchange region 53 includes the plurality of upstream fins 91 that are disposed between the upstream first header manifold 52 and the upstream second header manifold 54, and the plurality of upstream flat pipes 92 that are connected to the upstream first header manifold 52 and the upstream second header manifold 54 and to which the plurality of upstream fins 91 are attached so as to cross. The downstream heat exchange unit 61 includes a downstream first header manifold 62, a downstream heat exchange region 63, and a downstream second header manifold 64. The downstream heat exchange region 63 includes the plurality of downstream fins 93 that are disposed between the downstream first header manifold 62 and the downstream second header manifold 64, and the plurality of downstream flat pipes 94 that are connected to the downstream first header manifold 62 and the downstream second header manifold 64 and to which the plurality of downstream fins 93 are attached so as to cross. The liquid-side connection pipe 72 is connected to a flow splitter 73.

As illustrated in FIG. 5, when the indoor heat exchanger 42 functions as an evaporator during a cooling operation, a gas outlet pipe 55 from the gas-side connection pipe 71 to the upstream first header manifold 52 serves as an upstream refrigerant outlet, and a liquid inlet pipe 56 from the upstream second header manifold 54 to the flow splitter 73 serves as an upstream refrigerant inlet. Accordingly, refrigerant moves in the upstream heat exchange region 53 in the direction of arrow Ar2 from the upstream second header manifold 54 toward the upstream first header manifold 52. A gas outlet pipe 65 from the gas-side connection pipe 71 to the downstream first header manifold 62 serves as a downstream refrigerant outlet, and a liquid inlet pipe 66 from the downstream second header manifold 64 to the flow splitter 73 serves as a downstream refrigerant inlet. Accordingly, refrigerant moves in the downstream heat exchange region 63 in the direction of arrow Ar3 from the downstream second header manifold 64 toward the downstream first header manifold 62.

As illustrated in FIG. 6, when the indoor heat exchanger 42 functions as a condenser during a heating operation, a gas inlet pipe 57 from the gas-side connection pipe 71 to the upstream first header manifold 52 serves as an upstream refrigerant inlet, and a liquid outlet pipe 58 from the upstream second header manifold 54 to the flow splitter 73 serves as an upstream refrigerant outlet. Accordingly, refrigerant moves in the upstream heat exchange region 53 in the direction of arrow Ar4 from the upstream first header manifold 52 toward the upstream second header manifold 54. A gas inlet pipe 67 from the gas-side connection pipe 71 to the downstream first header manifold 62 serves as a downstream refrigerant inlet, and a liquid outlet pipe 68 from the downstream second header manifold 64 to the flow splitter 73 serves as a downstream refrigerant outlet. Accordingly, refrigerant moves in the downstream heat exchange region 63 in the direction of arrow Ar5 from the downstream first header manifold 62 toward the downstream second header manifold 64.

Figure 7:
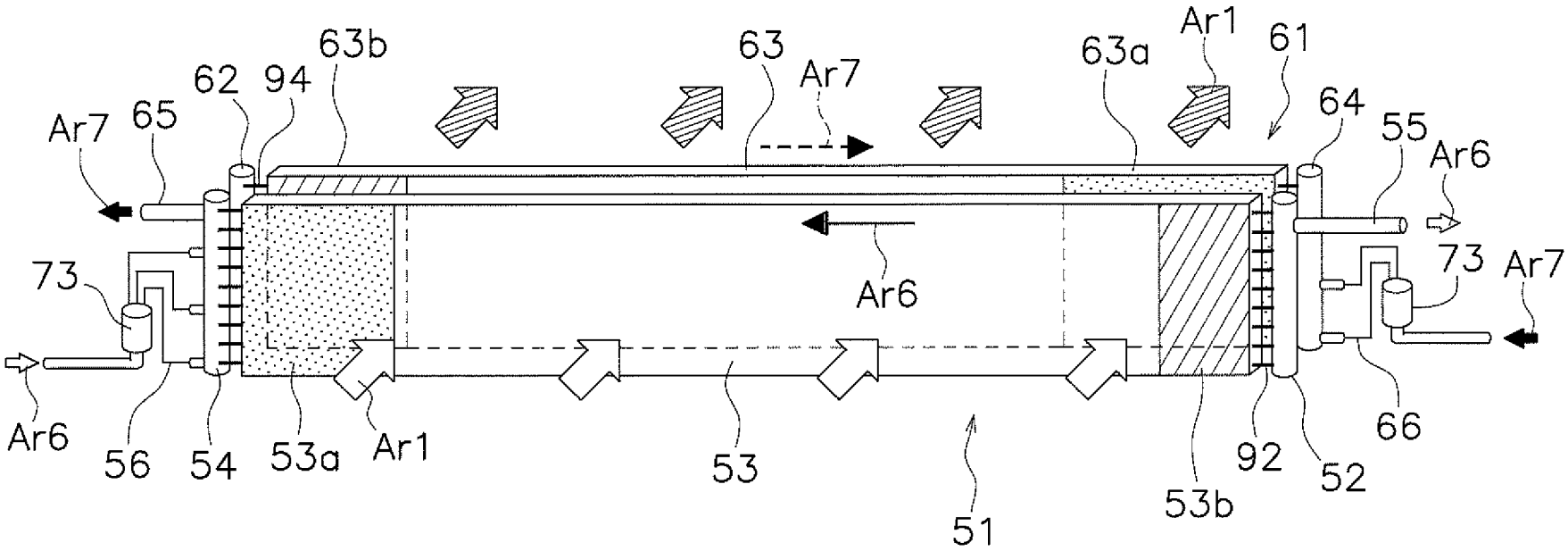
FIG. 7 is a schematic view of the indoor heat exchanger that functions as an evaporator.
Figure 8:
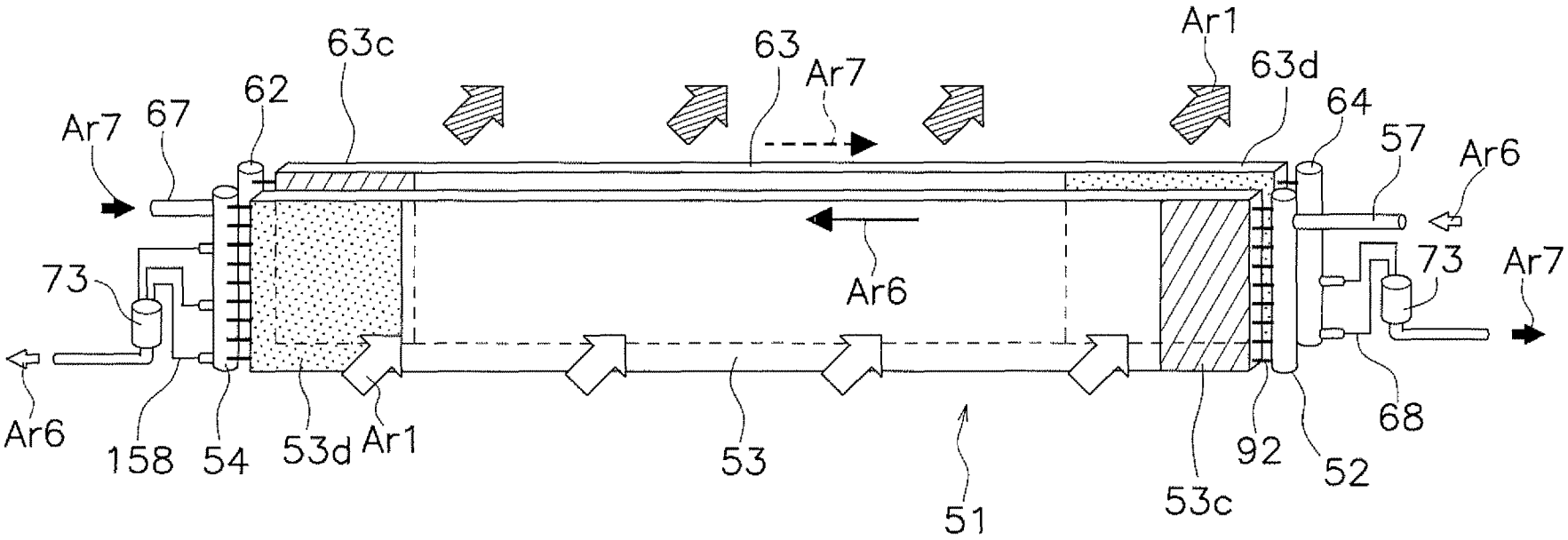
FIG. 8 is a schematic view of the indoor heat exchanger that functions as a condenser.

Because the indoor heat exchanger 42 illustrated in FIGS. 5 and 6 surrounds the indoor fan 41 in a ring shape, it may be difficult to understand the relationship between the flow of refrigerant and the airflow direction. Therefore, FIGS. 7 and 8 illustrate a conceptual indoor heat exchanger 42, which is the indoor heat exchanger 42 that is extended so that the flow of refrigerant becomes straight. In FIG. 7, arrow Ar6 indicates the direction in which refrigerant on the upstream side flows, and arrow Ar7 indicates the direction in which refrigerant on the downstream side flows. In FIGS. 7 and 8, the flow splitter 73, which is shown as one unit in FIGS. 5 and 6, is drawn at two positions. This is because the flow splitter 73, which is shared by the upstream heat exchange unit 51 and the downstream heat exchange unit 61 in FIGS. 5 and 6, is conceptually illustrated as two units.

As illustrated in FIGS. 5 and 7, when the indoor heat exchanger 42 is functioning as an evaporator, the upstream refrigerant inlet, which is disposed at one end of the plurality of upstream flat pipes 92, is located adjacent to the upstream second header manifold 54; and the upstream refrigerant outlet, which is disposed at the other end of the plurality of upstream flat pipes 92, is located adjacent to the upstream first header manifold 52. When the indoor heat exchanger 42 is functioning as an evaporator, the downstream refrigerant inlet, which is disposed at one end of the plurality of downstream flat pipes 94, is located adjacent to the downstream second header manifold 64; and the downstream refrigerant outlet, which is disposed at the other end of the plurality of downstream flat pipes 94, is located adjacent to the downstream first header manifold 62. When the indoor heat exchanger 42 is functioning as an evaporator, the upstream refrigerant inlet is the liquid inlet pipe 56, the upstream refrigerant outlet is the gas outlet pipe 55 the downstream refrigerant inlet is the liquid inlet pipe 66, and the downstream refrigerant outlet is the gas outlet pipe 65.

As illustrated in FIGS. 6 and 8, when the indoor heat exchanger 42 is functioning as a condenser, the upstream refrigerant inlet, which is disposed at one end of the plurality of upstream flat pipes 92, is located adjacent to the upstream first header manifold 52; and the upstream refrigerant outlet, which is disposed at the other end of the plurality of upstream flat pipes 92, is located adjacent to the upstream second header manifold 54. When the indoor heat exchanger 42 is functioning as an evaporator, the downstream refrigerant inlet, which is disposed at one end of the plurality of downstream flat pipes 94, is located adjacent to the downstream first header manifold 62; and the downstream refrigerant outlet, which is disposed at the other end of the plurality of downstream flat pipes 94, is located adjacent to the downstream second header manifold 64. When the indoor heat exchanger 42 is functioning as a condenser, the upstream refrigerant inlet is the gas inlet pipe 57, the upstream refrigerant outlet is the liquid outlet pipe 58, the downstream refrigerant inlet is the gas inlet pipe 67, and the downstream refrigerant outlet is the liquid outlet pipe 68.

(3-2-2) Flow of Refrigerant in Indoor Heat Exchanger 42

The upstream heat exchange unit 51 and the downstream heat exchange unit 61 are configured so that refrigerants flow in the upstream flat pipes 92 and the downstream flat pipes 94 in directions opposite to each other. The heat exchange units 51 and 61 are configured so that air that has passed through the vicinity of the one end of the upstream flat pipes 92 passes through the vicinity of the other end of the downstream flat pipes 94 and air that has passed through the vicinity of the other end of the upstream flat pipes 92 passes through the vicinity of the one end of the downstream flat pipes 94.

As illustrated in FIG. 7, when the indoor heat exchanger 42 is functioning as an evaporator, an inflow region 53*a* of the upstream heat exchange region 53, which is shown by dotted hatching, is a region in the vicinity of the one end of the upstream flat pipes 92, and an outflow region 63*b* of the downstream heat exchange region 63, which is shown by cross hatching, is a region in the vicinity of the other end of the downstream flat pipes 94. That is, when the indoor heat exchanger 42 is functioning as an evaporator, air that has passed through the inflow region 53*a* of the upstream heat exchange unit 51 passes through the outflow region 63*b* of the downstream heat exchange unit 61. When the indoor heat exchanger 42 is functioning as an evaporator, an outflow region 53*b* of the upstream heat exchange region 53, which is shown by cross hatching, is a region in the vicinity of the other end of the upstream flat pipes 92, and an inflow region 63*a* of the downstream heat exchange region 63, which is shown by dotted hatching, is a region in the vicinity of the one end of the downstream flat pipes 94. That is, when the indoor heat exchanger 42 is functioning as an evaporator, air that has passed through the outflow region 53*b* of the upstream heat exchange unit 51 passes through the inflow region 63*a* of the downstream heat exchange unit 61.

Figure 9:
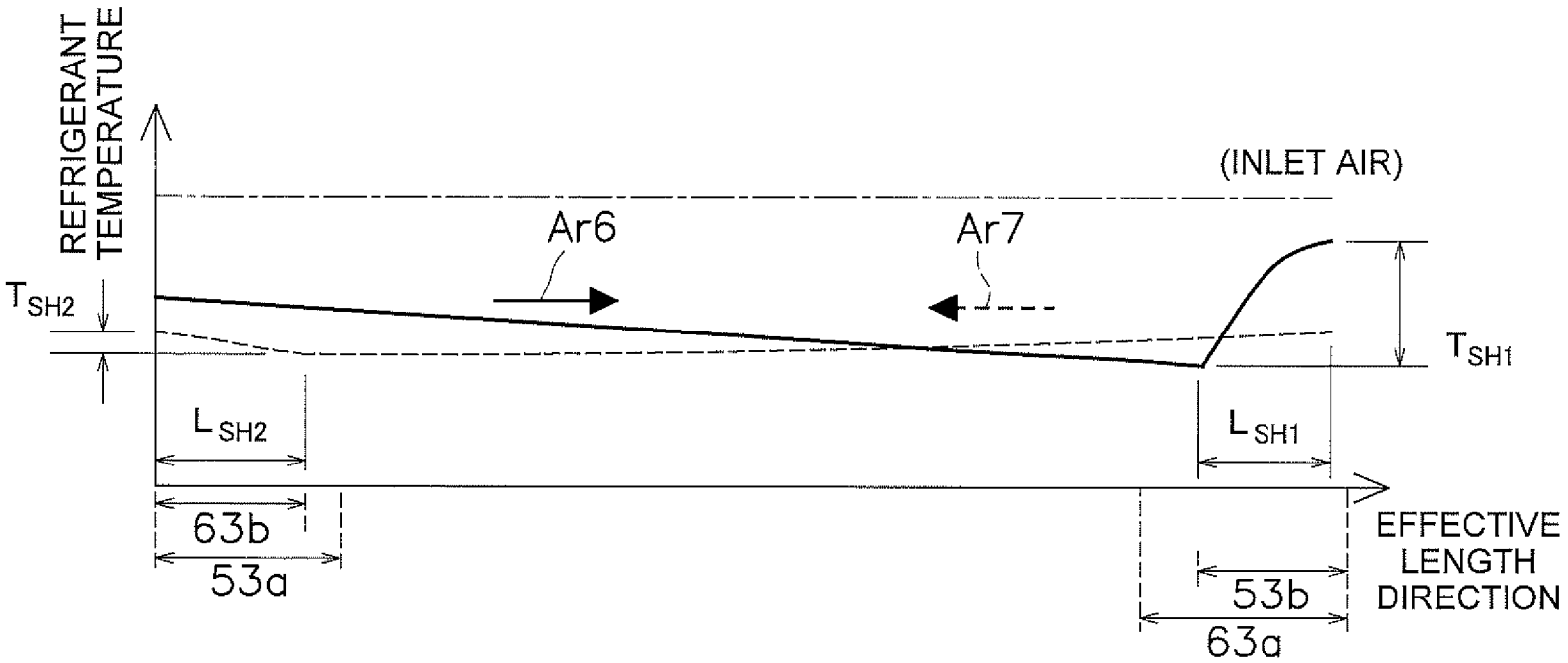
FIG. 9 is a graph representing the temperature distribution of refrigerant in the indoor heat exchanger according to the embodiment when the indoor heat exchanger functions as an evaporator.

FIG. 9 shows the relationship between the position in the indoor heat exchanger 42 and the temperature of refrigerant when the indoor heat exchanger 42 is functioning as an evaporator. In FIG. 9, a solid line corresponds to refrigerant in the upstream heat exchange unit 51 and a broken line corresponds to refrigerant in the downstream heat exchange unit 61. In FIG. 9, regarding the refrigerant in the upstream heat exchange unit 51, which is shown by the solid line, the right side in the graph corresponds to the upstream refrigerant inlet, and the left side in the graph corresponds to the upstream refrigerant outlet. In FIG. 9, regarding the refrigerant in the downstream heat exchange unit 61, which is shown by the broken line, the left side in the graph corresponds to the downstream refrigerant inlet, and the right side in the graph corresponds to the downstream refrigerant outlet. The same applies to FIGS. 10, 11, and 13, which will be described below. In FIGS. 9 and 11, the temperature of inlet air is shown by a chain line, for reference. In each of FIGS. 9, 10, 11, and 13, the horizontal axis represents the effective length direction. In a case where a refrigerant channel is reversely bent in the upstream heat exchange unit 51 and in a case where a refrigerant channel is reversely bent in the downstream heat exchange unit 61, it is possible to draw the refrigerant channels in the graphs by conceptually removing the bends and assuming that the refrigerant channels are straight.

As illustrated in FIG. 9, the outflow region 53*b* of the upstream heat exchange unit 51 and the outflow region 63*b* of the downstream heat exchange unit 61, in which the temperature of refrigerant is comparatively high, are disposed so as to be separated from each other. Therefore, nonuniformity in the temperature of air that has exchanged heat, that is, difference in the temperature of passing air depending on the location in the indoor heat exchanger 42 is reduced.

As illustrated in FIG. 8, when the indoor heat exchanger 42 is functioning as condenser, an inflow region 53*c* of the upstream heat exchange region 53, which is shown by cross hatching, is a region in the vicinity of the one end of the upstream flat pipes 92, and an outflow region 63*d* of the downstream heat exchange region 63, which is shown by dotted hatching, is a region in the vicinity of the other end of the downstream flat pipes 94. That is, when the indoor heat exchanger 42 is functioning as a condenser, air that has passed through the inflow region 53*c* of the upstream heat exchange unit 51 passes through the outflow region 63*d* of the downstream heat exchange unit 61. When the indoor heat exchanger 42 is functioning as a condenser, an outflow region 53*d* of the upstream heat exchange region 53, which is shown by dotted hatching, is a region in the vicinity of the other end of the upstream flat pipes 92, and an inflow region 63*c* of the downstream heat exchange region 63, which is shown by cross hatching, is a region in the vicinity of the one end of the downstream flat pipes 94. That is, when the indoor heat exchanger 42 is functioning as a condenser, air that has passed through the outflow region 53*d* of the upstream heat exchange unit 51 passes through the inflow region 63*c* of the downstream heat exchange unit 61.

Figure 10:
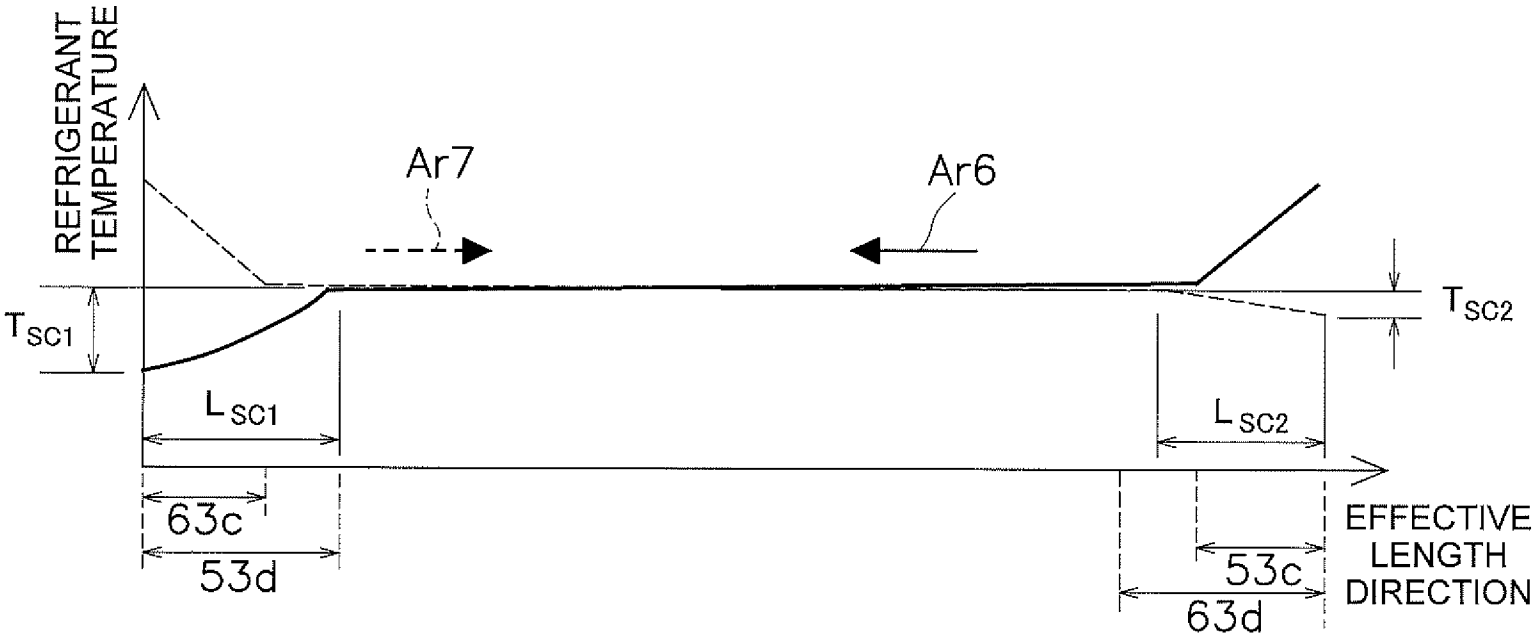
FIG. 10 is a graph representing the temperature distribution of refrigerant in the indoor heat exchanger according to the embodiment when the indoor heat exchanger functions as a condenser.
Figure 11:
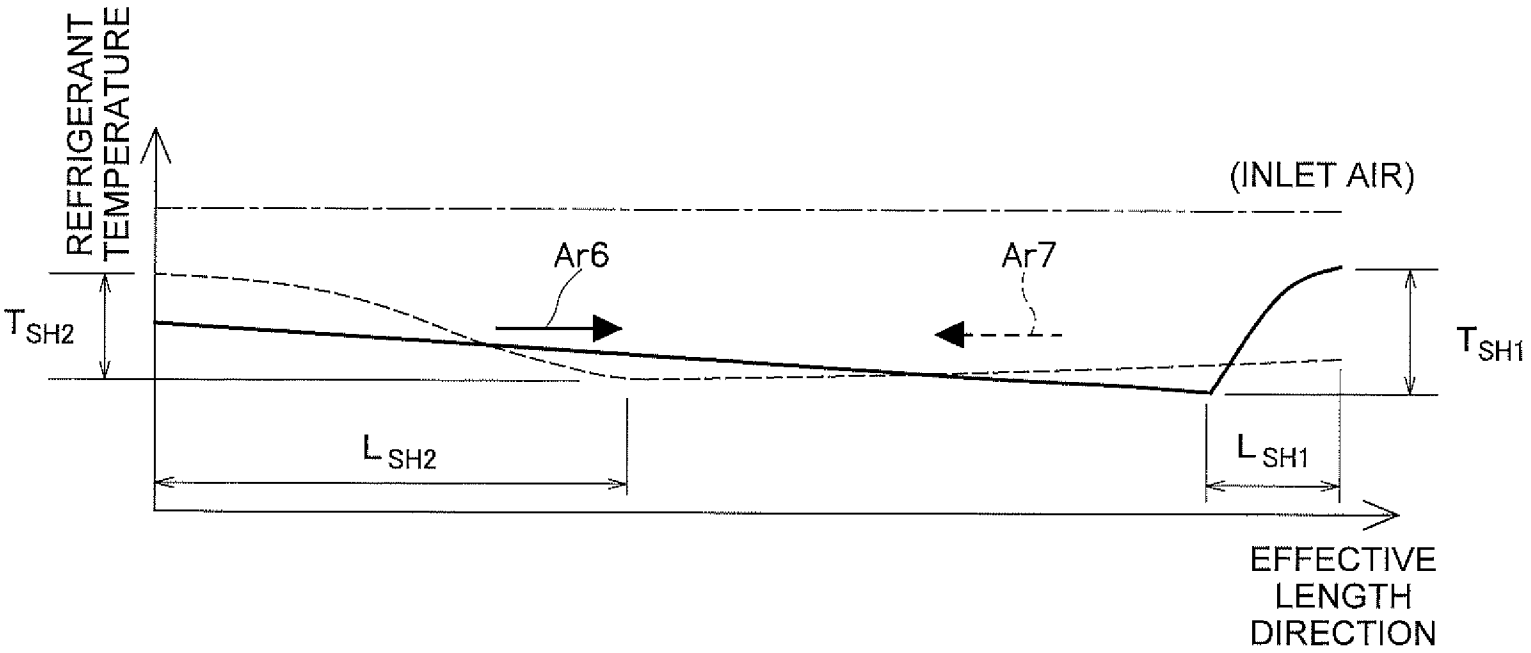
FIG. 11 is a graph representing the temperature distribution of refrigerant in the indoor heat exchanger when the indoor heat exchanger functions as an evaporator and the degree of superheating at an upstream refrigerant outlet and the degree of superheating at a downstream refrigerant outlet are approximately the same.

FIG. 10 shows the relationship between the position in the indoor heat exchanger 42 and the temperature of refrigerant when the indoor heat exchanger 42 is functioning as a condenser. As illustrated in FIG. 10, the outflow region 53*d* of the upstream heat exchange unit 51 and the outflow region 63*d* of the downstream heat exchange unit 61, in which the temperature of refrigerant is comparatively low, are disposed so as to be separated from each other. Therefore, nonuniformity in the temperature of air that has exchanged heat, that is, difference in the temperature of passing air depending on the location in the indoor heat exchanger 42 is reduced.

(3-2-3) Structure of Indoor Heat Exchanger 42 as Evaporator

FIG. 11 shows the relationship between the position in the indoor heat exchanger 42 and the temperature of refrigerant in a case where the degree of superheating $T_{SH1}$ at the upstream refrigerant outlet of the upstream heat exchange unit 51 is approximately the same as the degree of superheating $T_{SH2}$ at the downstream refrigerant outlet of the downstream heat exchange unit 61 ($T_{SH1} \approx T_{SH2}$). In contrast, in the present embodiment, as illustrated in FIG. 9, the degree of superheating $T_{SH2}$ at the downstream refrigerant outlet of the downstream heat exchange unit 61 is smaller than the degree of superheating $T_{SH1}$ at the upstream refrigerant outlet of the upstream heat exchange unit 51 ($T_{SH2} < T_{SH1}$). As a result, as can be understood by comparing FIG. 9 with FIG. 11, when the indoor heat exchanger 42 according to the present embodiment is compared with the case where the degree of superheating $T_{SH1}$ at the upstream refrigerant outlet is approximately the same as the degree of superheating $T_{SH2}$ at the downstream refrigerant outlet, the length $L_{SH2}$ of the superheated region of the downstream heat exchange unit 61 is reduced, although the length $L_{SH1}$ of the superheated region of the upstream heat exchange unit 51 does not differ considerably. Thus, the heat exchange efficiency is improved.

(3-2-4) Adjustment of Indoor Heat Exchanger 42 as Evaporator

Figure 12:
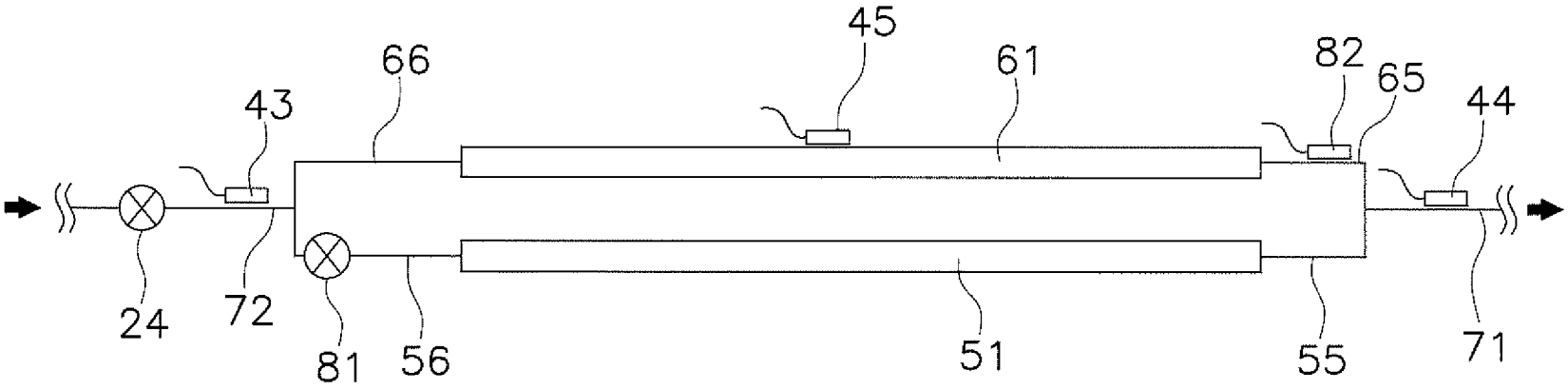
FIG. 12 is a schematic diagram illustrating the structure of the indoor heat exchanger for making the degree of superheating at the downstream refrigerant outlet smaller than the degree of superheating at the upstream refrigerant outlet.

Referring to FIG. 12, an example of a method of making the degree of superheating $T_{SH2}$ at the downstream refrigerant outlet of the downstream heat exchange unit 61 smaller than the degree of superheating $T_{SH1}$ at the upstream refrigerant outlet of the upstream heat exchange unit 51 in this way will be described. The indoor heat exchanger 42 includes, as in existing indoor heat exchangers, a liquid-pipe temperature sensor 43 attached to the liquid-side connection pipe 72, a gas-pipe temperature sensor 44 attached to the gas-side connection pipe 71, and a heat-exchanger temperature sensor 45. The heat-exchanger temperature sensor 45 is a temperature sensor for measuring an evaporation temperature and is attached to a position where the evaporation temperature can be detected, for example, such a middle portion of the downstream heat exchange unit 61. The middle portion is, for example, the downstream flat pipes 94 or a header of a reversely bent portion. In order to perform the adjustment as described above, the indoor heat exchanger 42 includes a flow-rate adjusting valve 81 in the liquid inlet pipe 56 and a temperature sensor 82 in the gas outlet pipe 65. For example, an electric valve can be used as the flow-rate adjusting valve 81.

Figure 15:
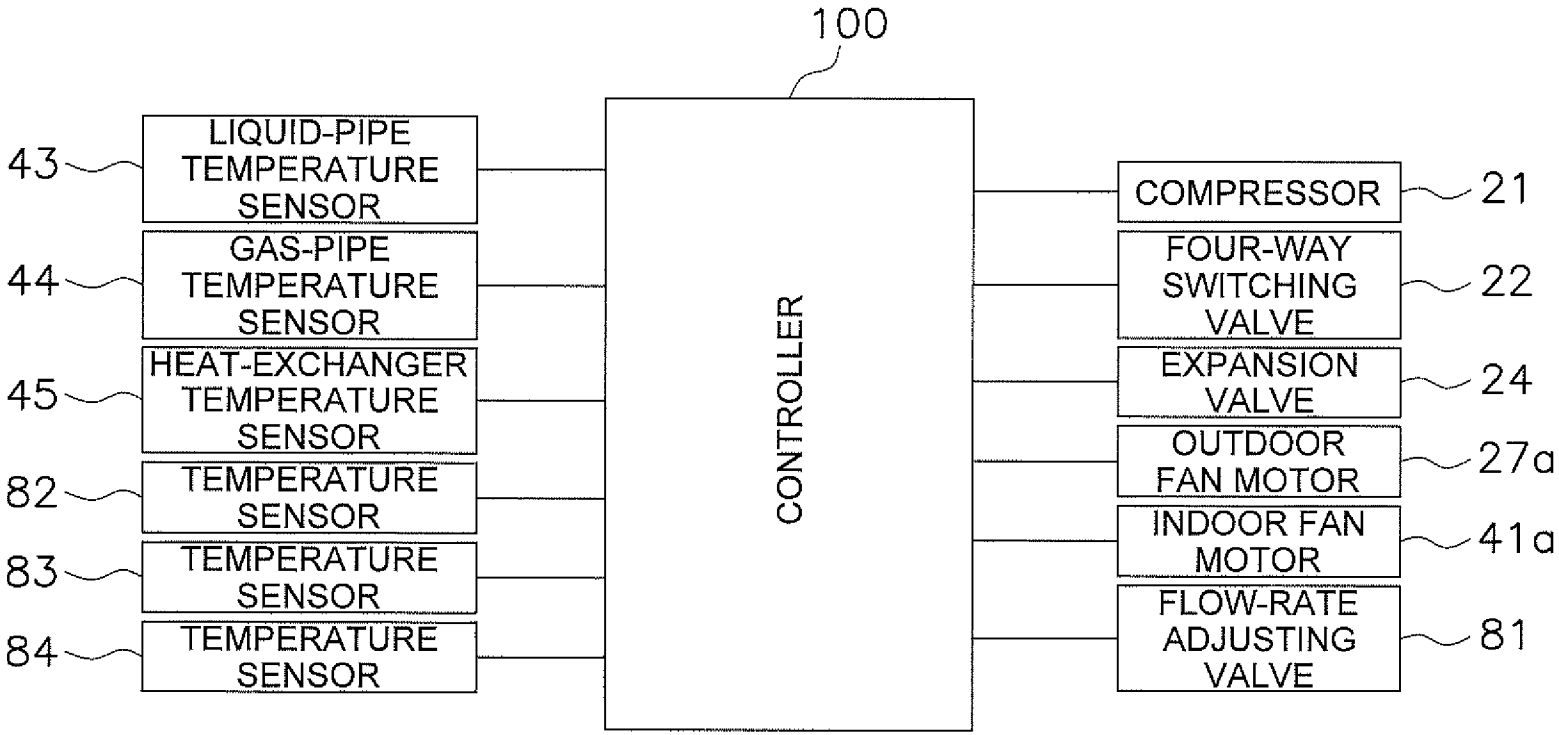
FIG. 15 is a block diagram of a control system of the refrigeration apparatus.

During a cooling operation, for example, a controller 100 (see FIG. 15) controls the expansion valve 24 so that the degree of superheating $T_{SHA}$ of the entirety of the indoor heat exchanger 42 is a predetermined specific value. The degree of superheating $T_{SHA}$ can be obtained, for example, by subtracting an evaporation temperature Te detected by the heat-exchanger temperature sensor 45 from a detection temperature Tg of the gas-pipe temperature sensor 44.

The flow-rate adjusting valve 81 adjusts first resistance to refrigerant that flows in the upstream heat exchange unit 51 and second resistance to refrigerant that flows in the downstream heat exchange unit 61 so that the degree of superheating $T_{SH2}$ at the downstream refrigerant outlet is smaller than the degree of superheating $T_{SH1}$ at the upstream refrigerant outlet. Here, because the refrigerant that flows in the downstream heat exchange unit 61 is less than the amount of refrigerant that flows in the upstream heat exchange unit 51, the degree of superheating $T_{SH1}$ at the upstream refrigerant outlet is substituted by the detection temperature Tg of the gas-pipe temperature sensor 44. Alternatively, a temperature sensor may be attached to the gas outlet pipe 55, and the degree of superheating $T_{SH1}$ at the upstream refrigerant outlet may be detected by using the temperature sensor of the gas outlet pipe 55. Because the degree of superheating $T_{SH2}$ at the downstream refrigerant outlet is detected by the temperature sensor 82, the controller 100 performs control so that the detection temperature of the temperature sensor 82 is lower than the detection temperature of the gas-pipe temperature sensor 44.

To be specific, the controller 100 controls the flow-rate adjusting valve 81 so that the difference between the detection temperature of the temperature sensor 82 and the detection temperature of the gas-pipe temperature sensor 44 are 3° C. or larger. At this time, the controller 100 controls the flow-rate adjusting valve 81 so that the degree of superheating $T_{SH2}$ at the downstream refrigerant outlet is 2° C. or smaller. For example, the degree of superheating $T_{SHA}$ of the entirety and the degree of superheating $T_{SH1}$ at the upstream refrigerant outlet is controlled to be 5° C., and the degree of superheating $T_{SH2}$ at the downstream refrigerant outlet is controlled to be 1° C. Because the degree of superheating $T_{SH2}$ at the downstream refrigerant outlet needs be adjusted to be 2° C. or smaller, the degree of superheating $T_{SH2}$ at the downstream refrigerant outlet may be adjusted to, for example, 0° C.

(3-2-5) Structure of Indoor Heat Exchanger 42 as Condenser

Figure 13:
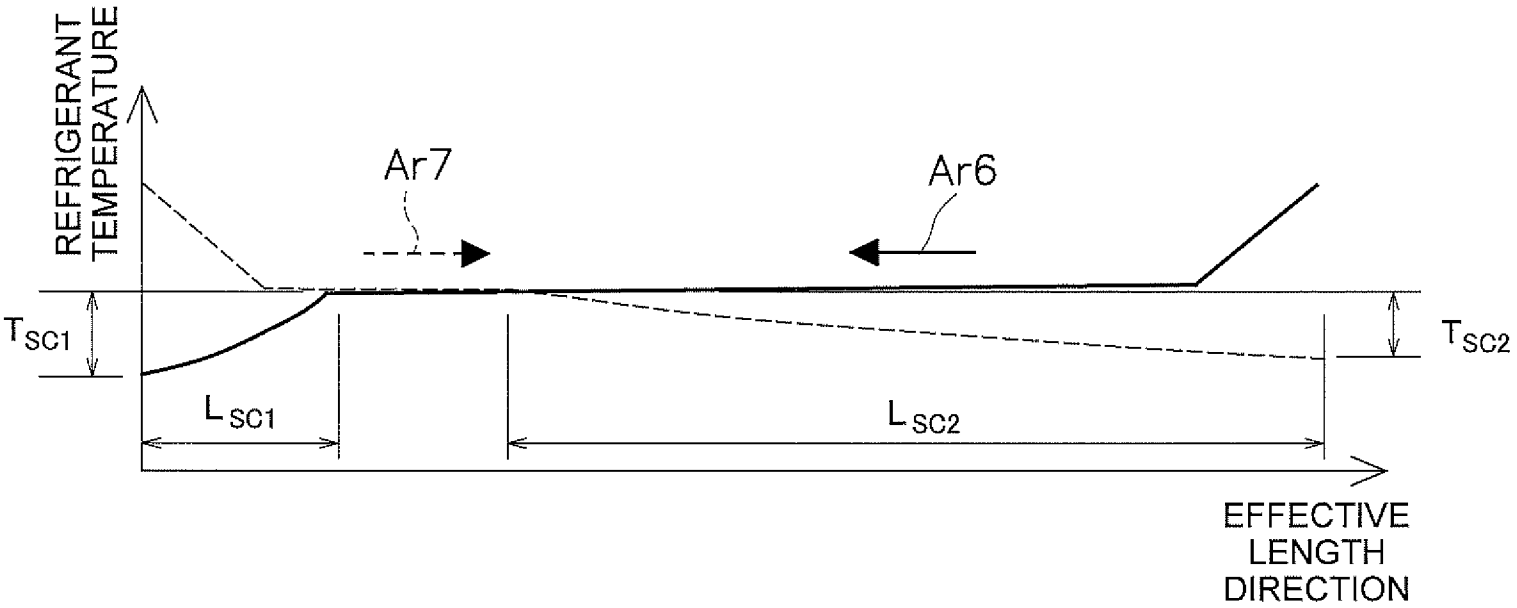
FIG. 13 is a graph representing the temperature distribution of refrigerant in the indoor heat exchanger when the indoor heat exchanger functions as a condenser and the degree of subcooling at the upstream refrigerant outlet and the degree of subcooling at the downstream refrigerant outlet are approximately the same.

FIG. 13 shows the relationship between the position in the indoor heat exchanger 42 and the temperature of refrigerant in a case where the degree of subcooling $T_{SC1}$ at the upstream refrigerant outlet of the upstream heat exchange unit 51 is approximately the same as the degree of subcooling $T_{SC2}$ at the downstream refrigerant outlet of the downstream heat exchange unit 61 ($T_{SC1} \approx T_{SC2}$). In contrast, in the present embodiment, as illustrated in FIG. 10, the degree of subcooling $T_{SC2}$ at the downstream refrigerant outlet of the downstream heat exchange unit 61 is smaller than the degree of subcooling $T_{SC1}$ at the upstream refrigerant outlet of the upstream heat exchange unit 51 ($T_{SC2} < T_{SC1}$). As a result, as can be understood by comparing FIG. 10 with FIG. 13, when the indoor heat exchanger 42 according to the present embodiment is compared with the case where the degree of subcooling $T_{SC1}$ at the upstream refrigerant outlet is approximately the same as the degree of subcooling $T_{SC2}$ at the downstream refrigerant outlet, the length $L_{SC2}$ of the subcooled region of the downstream heat exchange unit 61 is reduced, although the length $L_{SC1}$ of the subcooled region of the upstream heat exchange unit 51 does not differ considerably. Thus, the heat exchange efficiency is improved.

(3-2-6) Adjustment of Indoor Heat Exchanger 42 as Condenser

Figure 14:
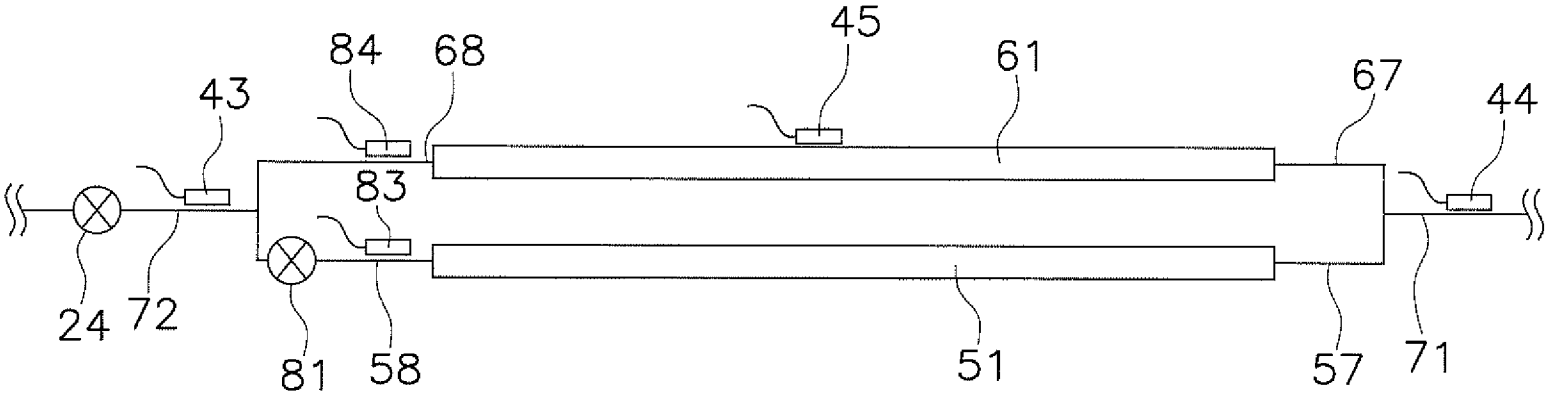
FIG. 14 is a conceptual diagram illustrating the structure of the indoor heat exchanger for making the degree of subcooling at the downstream refrigerant outlet smaller than the degree of subcooling at the upstream refrigerant outlet.

Referring to FIG. 14, an example of a method of making the degree of subcooling $T_{SC2}$ at the downstream refrigerant outlet of the downstream heat exchange unit 61 smaller than the degree of subcooling $T_{SC1}$ at the upstream refrigerant outlet of the upstream heat exchange unit 51 in this way will be described. The indoor heat exchanger 42 includes, as in existing indoor heat exchangers, the liquid-pipe temperature sensor 43, the gas-pipe temperature sensor 44, and the heat-exchanger temperature sensor 45. The heat-exchanger temperature sensor 45 is a temperature sensor for measuring a condensation temperature and is attached to a position where the condensation temperature can be detected, such a middle portion of the downstream heat exchange unit 61. The middle portion is, for example, the downstream flat pipes 94 or a header of a reversely bent portion. In order to perform the adjustment described above, the indoor heat exchanger 42 includes the flow-rate adjusting valve 81 in the liquid outlet pipe 58, and temperature sensors 83 and 84 in the liquid outlet pipes 58 and 68.

During a heating operation, for example, the controller 100 (see FIG. 15) controls the expansion valve 24 so that the degree of subcooling $T_{SCA}$ of the entirety of the indoor heat exchanger 42 is a predetermined specific value. For example, the degree of subcooling $T_{SCA}$ can be obtained by subtracting a condensation temperature Tc detected by the heat-exchanger temperature sensor 45 from a detection temperature Tl of the liquid-pipe temperature sensor 43.

The flow-rate adjusting valve 81 adjusts first resistance to refrigerant that flows in the upstream heat exchange unit 51 and second resistance to refrigerant that flows in the downstream heat exchange unit 61 so that the degree of subcooling $T_{SC2}$ at the downstream refrigerant outlet is smaller than the degree of subcooling $T_{SC1}$ at the upstream refrigerant outlet. The temperature sensors 83 and 84, which are attached to the liquid outlet pipes 58 and 68, detect the degree of subcooling $T_{SC1}$ at the upstream refrigerant outlet and the degree of subcooling $T_{SC2}$ at the downstream refrigerant outlet. Because the temperature sensors 83 and 84 detect the degree of subcooling $T_{SC1}$ at the upstream refrigerant outlet and the degree of subcooling $T_{SC2}$ at the downstream refrigerant outlet, the controller 100 performs control so that the detection temperature of the temperature sensor 84 is lower than the detection temperature of the temperature sensor 83.

To be specific, the controller 100 adjusts the flow-rate adjusting valve 81 so that the difference between the detection temperatures of the temperature sensors 83 and 84 is 3° C. or larger. At this time, the controller 100 adjusts the flow-rate adjusting valve 81 so that the degree of subcooling $T_{SC2}$ at the downstream refrigerant outlet is 2° C. or smaller. For example, the controller 100 controls the degree of subcooling $T_{SCA}$ of the entirety and the degree of subcooling $T_{SC1}$ at the upstream refrigerant outlet is to be 5° C., and controls the degree of subcooling $T_{SC2}$ at the downstream refrigerant to be 1° C. Because the degree of subcooling $T_{SC2}$ at the downstream refrigerant outlet is adjusted to be 2° C. or smaller, the degree of subcooling $T_{SC2}$ at the downstream refrigerant outlet may be adjusted to, for example, 0° C.

(4) Modifications (4-1) Modification 1A

In the first embodiment described above, the flow-rate adjusting valve 81 adjusts the first resistance, which is resistance to refrigerant that flows in the upstream heat exchange unit 51, and the second resistance, which is resistance to refrigerant that flows in the downstream heat exchange unit 61. However, in the upstream heat exchange unit 51 and the downstream heat exchange unit 61, the first resistance and the second resistance may be adjusted beforehand so as to generate a difference in degree of superheating that is a first threshold or larger or a difference in degree of subcooling that is a second threshold or larger.

For example, a capillary tube may be used instead of the flow-rate adjusting valve 81. In this case, for example, a production-model test or a simulation may be performed and examined beforehand, and the first resistance and the second resistance may be set so that the degree of superheating of refrigerant at the downstream refrigerant outlet is smaller than the degree of superheating of refrigerant at the upstream refrigerant outlet by the first threshold or larger, or so that the degree of subcooling of refrigerant at the downstream refrigerant outlet is smaller than the degree of subcooling of refrigerant at the upstream refrigerant outlet by the second threshold or larger, in a state in which the refrigerant circuit 10 is stably operating. The capillary tube may be disposed only in the upstream heat exchange unit, or the capillary tubes may be disposed in both of the upstream heat exchange unit and the downstream heat exchange unit.

Alternatively, the channel resistance of the refrigerant channels 92*a* of the upstream flat pipes 92 and the channel resistance of the refrigerant channels 94*a* of the downstream flat pipes 94 may be used instead of the flow-rate adjusting valve 81. In this case, for example, a production-model test or a simulation may be performed and examined beforehand, and the first resistance and the second resistance may be set so that the degree of superheating of refrigerant at the downstream refrigerant outlet is smaller than the degree of superheating of refrigerant at the upstream refrigerant outlet by the first threshold or larger, or so that the degree of subcooling of refrigerant at the downstream refrigerant outlet is smaller than the degree of subcooling of refrigerant at the upstream refrigerant outlet by the second threshold or larger, in a state in which the refrigerant circuit 10 is stably operating.

Figure 16:
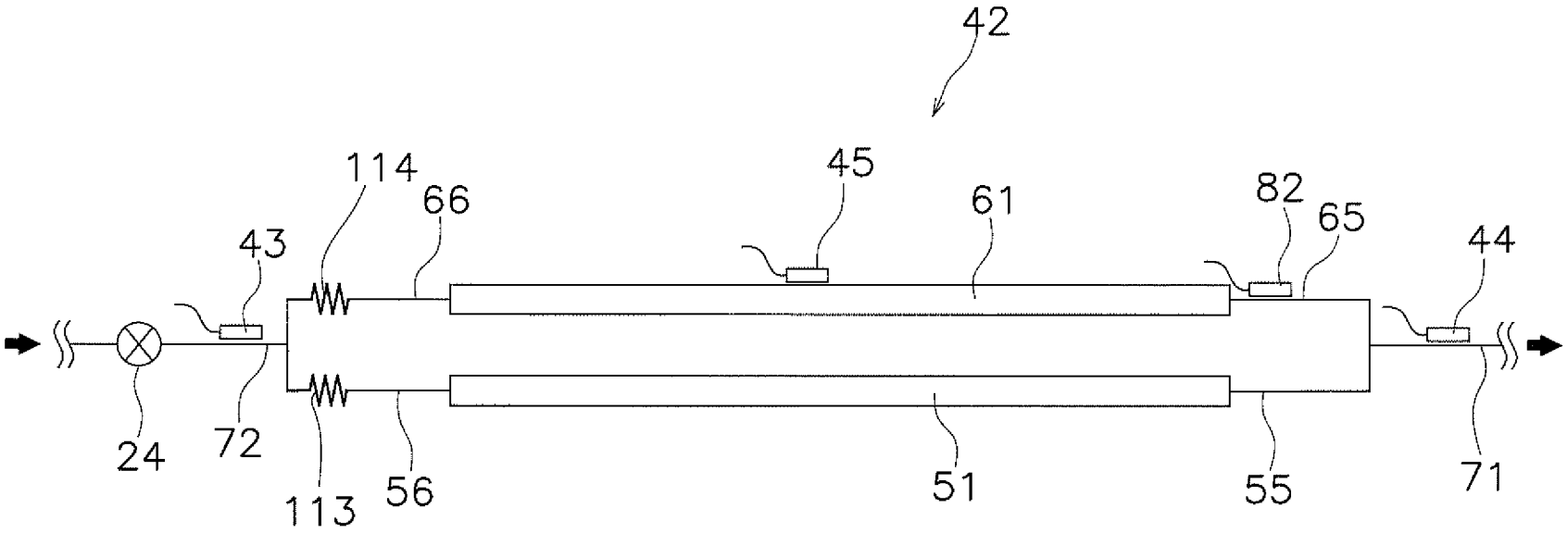
FIG. 16 is a schematic diagram illustrating the structure of the indoor heat exchanger, according to modification 1A, for making the degree of superheating at the downstream refrigerant outlet smaller than the degree of superheating at the upstream refrigerant outlet.

Referring to FIG. 16, another example of the structure of the indoor heat exchanger 42 that functions as an evaporator in a case where the indoor heat exchanger 42 includes a capillary tube will be described. The indoor heat exchanger 42 illustrated in FIG. 16 includes the expansion valve 24, the liquid-side connection pipe 72, the liquid inlet pipes 56 and 66, the upstream heat exchange unit 51, the downstream heat exchange unit 61, the gas outlet pipes 55 and 65, the gas-side connection pipe 71, capillary tubes 113 and 114, the liquid-pipe temperature sensor 43, the gas-pipe temperature sensor 44, the heat-exchanger temperature sensor 45, and the temperature sensor 82.

In the indoor heat exchanger 42 illustrated in FIG. 16, the liquid inlet pipe 56 is disposed adjacent to one end of the plurality of upstream flat pipes 92 (see FIG. 7) and serves as an upstream refrigerant inlet into which refrigerant that flows out from the upstream refrigerant outlet (the gas outlet pipe 55) flows when the indoor heat exchanger 42 functions as an evaporator; and the liquid inlet pipe 66 is disposed adjacent to one end of the plurality of downstream flat pipes 94 (see FIG. 7) and serves as a downstream refrigerant inlet into which refrigerant that flows out from the downstream refrigerant outlet (the gas outlet pipe 65) flows when the indoor heat exchanger 42 functions as an evaporator. The liquid-side connection pipe 72 serves as a third connection pipe through which refrigerant that flows into the upstream refrigerant inlet (the liquid inlet pipe 56) and refrigerant that flows into the downstream refrigerant inlet (the liquid inlet pipe 66) flow together before being split when the indoor heat exchanger 42 functions as an evaporator.

The capillary tube 113 is a third capillary tube that is connected between the third connection pipe (the liquid-side connection pipe 72) and the upstream refrigerant inlet (the liquid inlet pipe 56), and the capillary tube 114 is a fourth capillary tube that is connected between the third connection pipe and the downstream refrigerant inlet (the liquid inlet pipe 66). Here, two capillary tubes 113 and 114 are used. However, if it is possible to appropriately adjust the first resistance and the second resistance that refrigerants receive by using one of the capillary tubes 113 and 114, the other one may be omitted.

That is, the indoor heat exchanger 42 may include the third capillary tube (the capillary tube 113) that is connected between the third connection pipe (the liquid-side connection pipe 72) and the upstream refrigerant inlet (the liquid inlet pipe 56) and/or the fourth capillary tube (the capillary tube 114) that is connected between the third connection pipe and the downstream refrigerant inlet (the liquid inlet pipe 66); and the first resistance to refrigerant that flows in the upstream heat exchange unit 51 and the second resistance to refrigerant that flows in the downstream heat exchange unit 61 may be adjusted by using the third capillary tube and/or the fourth capillary tube so that the degree of superheating of refrigerant at the downstream refrigerant outlet is smaller than the degree of superheating of refrigerant at the upstream refrigerant outlet.

Figure 17:
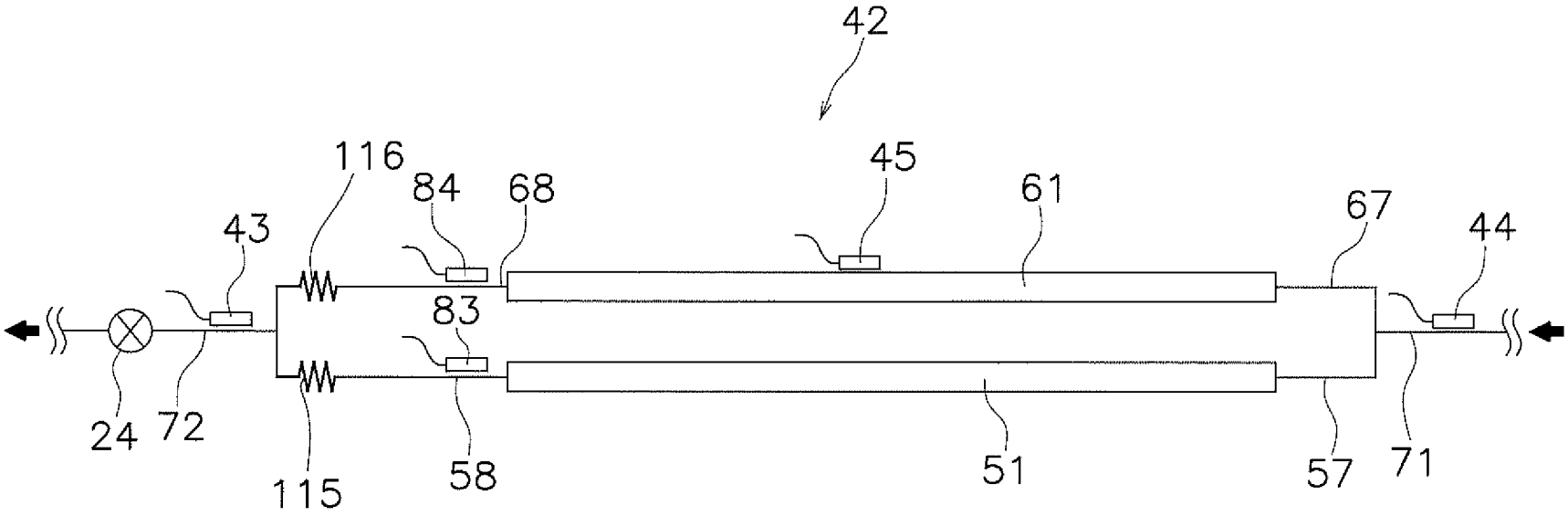
FIG. 17 is a schematic diagram illustrating the structure of the indoor heat exchanger, according to modification 1A, for making the degree of subcooling at the downstream refrigerant outlet smaller than the degree of subcooling at the upstream refrigerant outlet.

Referring to FIG. 17, an example of the structure of the indoor heat exchanger 42 that functions as a condenser in a case where the indoor heat exchanger 42 includes a capillary tube will be described. The indoor heat exchanger 42 illustrated in FIG. 17 includes the gas-side connection pipe 71, the gas inlet pipes 57 and 67, the upstream heat exchange unit 51, the downstream heat exchange unit 61, the liquid outlet pipes 58 and 68, capillary tubes 115 and 116, the liquid-side connection pipe 72, the expansion valve 24, the liquid-pipe temperature sensor 43, the gas-pipe temperature sensor 44, the heat-exchanger temperature sensor 45, and the temperature sensors 83 and 84.

In the indoor heat exchanger 42 illustrated in FIG. 17, the liquid-side connection pipe 72 serves as a second connection pipe in which refrigerant that flows out from the liquid outlet pipe 58 that is the upstream refrigerant outlet and refrigerant that flows out from the liquid outlet pipe 68 that is the downstream refrigerant outlet join and flow together, when the indoor heat exchanger 42 functions as a condenser. The capillary tube 115 is a fifth capillary tube that is connected between the second connection pipe (the liquid-side connection pipe 72) and the upstream refrigerant outlet (the liquid outlet pipe 58), and the capillary tube 116 is a sixth capillary tube that is connected between the second connection pipe and the downstream refrigerant outlet (the liquid outlet pipe 68). Here, two capillary tubes 115 and 116 are used. However, if it is possible to appropriately adjust the first resistance and the second resistance that refrigerants receive by using one of the capillary tubes 115 and 116, the other one may be omitted.

That is, the indoor heat exchanger 42 may include the fifth capillary tube (the capillary tube 115) that is connected between the second connection pipe (the liquid-side connection pipe 72) and the upstream refrigerant outlet (the liquid outlet pipe 58) and/or the sixth capillary tube (the capillary tube 116) that is connected between the second connection pipe and the downstream refrigerant outlet (the liquid outlet pipe 68); and the first resistance to refrigerant that flows in the upstream heat exchange unit 51 and the second resistance to refrigerant that flows in the downstream heat exchange unit 61 may be adjusted by using the fifth capillary tube and/or the sixth capillary tube so that the degree of subcooling of refrigerant at the downstream refrigerant outlet is smaller than the degree of subcooling of refrigerant at the upstream refrigerant outlet.

In modification 1A described above, capillary tubes, as flow-rate adjusting members, are disposed between the third connection pipe (the liquid-side connection pipe 72) and the upstream refrigerant inlet (the liquid inlet pipe 56) and between the third connection pipe and the downstream refrigerant inlet (the liquid inlet pipe 66), or between the second connection pipe (the liquid-side connection pipe 72) and the upstream refrigerant outlet (the liquid outlet pipe 58) and between the second connection pipe and the downstream refrigerant outlet (the liquid outlet pipe 68). However, a flow-rate adjusting member may be disposed between the gas-side connection pipe 71 and the gas outlet pipe 55 and/or the gas outlet pipe 65. Alternatively, a flow-rate adjusting member may be disposed between the gas-side connection pipe 71 and the gas inlet pipe 57 and/or the gas inlet pipe 67. Examples of a flow-rate adjusting member include a flow-rate adjusting valve, a capillary tube, and an orifice plate.

(4-2) Modification 1B

In the first embodiment described above, the flow-rate adjusting valve 81 for adjusting the first resistance to refrigerant that flows in the upstream heat exchange unit 51 and the second resistance to refrigerant that flows in the downstream heat exchange unit 61 is disposed only in the upstream heat exchange unit 51. However, flow-rate adjusting valves may be disposed in both of the upstream heat exchange unit 51 and the downstream heat exchange unit 61, or a flow-rate adjusting valve may be disposed only in the downstream heat exchange unit 61.

(4-3) Modification 1C

In the first embodiment described above, the heat-exchanger temperature sensor 45 is disposed in the downstream heat exchange unit 61. However, the heat-exchanger temperature sensor 45 may be disposed in the upstream heat exchange unit 51. The same applies to a second embodiment described below.

(4-4) Modification 1D

In the first embodiment described above, the temperature sensors 82 to 84 are disposed in order to determine whether the degree of superheating of refrigerant in the downstream refrigerant outlet is smaller than the degree of superheating of refrigerant at the upstream refrigerant outlet, or to determine whether the degree of subcooling of refrigerant in the downstream refrigerant outlet is smaller than the degree of subcooling of refrigerant at the upstream refrigerant outlet. However, a configuration used to detect a temperature difference for these determinations is not limited to this.

(4-5) Modification 1E

In the first embodiment described above, one indoor unit 4 is connected to one outdoor unit 2 in the refrigeration apparatus 1. However, the technology according to the present disclosure is also applicable to a refrigeration apparatus in which a plurality of indoor units 4 are connected to one outdoor unit 2 and a refrigeration apparatus in which a plurality of indoor units 4 are connected to a plurality of outdoor units 2. The same applies to the second embodiment described below.

(4-6) Modification 1F

In the first embodiment described above, the indoor heat exchanger 42, which is incorporated in the indoor unit 4 that is a ceiling-mounted air conditioner, is described as an example of a heat exchanger that includes an upstream heat exchange unit and a downstream heat exchange unit. However, a heat exchanger that includes an upstream heat exchange unit and a downstream heat exchange unit is not limited to the indoor heat exchanger 42 that is incorporated in a ceiling-mounted air conditioner. For example, the present disclosure is applicable also to a case where an indoor heat exchanger of a wall-mounted air conditioner or an indoor heat exchanger of a floor-mounted air conditioner includes an upstream heat exchange unit and a downstream heat exchange unit. The technology according to the present disclosure is applicable also to a case where an outdoor heat exchanger of an outdoor unit includes an upstream heat exchange unit and a downstream heat exchange unit. The same applies to the second embodiment described below.

(4-7) Modification 1G

In the first embodiment described above, refrigerant that flows in the upstream heat exchange unit 51 and refrigerant that flows in the downstream heat exchange unit 61 flow in opposite directions. However, refrigerant that flows in the upstream heat exchange unit 51 and refrigerant that flows in the downstream heat exchange unit 61 may flow in the same direction.

(4-8) Modification 1H

In the first embodiment, the refrigeration apparatus 1 is a pair-type refrigeration apparatus, in which one outdoor unit 2 is connected to one indoor unit 4; and the indoor heat exchanger 42 that is used in the indoor unit 4 of the pair-type refrigeration apparatus 1 is described as an example. However, the indoor heat exchanger 42 according to the present embodiment can be used also as an indoor unit of a multi-type refrigeration apparatus, in which a plurality of indoor units are connected to one outdoor unit.

(5) Features (5-1)

With the indoor heat exchanger 42 of the refrigeration apparatus 1 described above, the difference between the first resistance, which is channel resistance to refrigerant that flows in the upstream heat exchange unit 51, and the second resistance, which is channel resistance to refrigerant that flows in the downstream heat exchange unit 61, is adjusted by using the flow-rate adjusting valve 81, so that the degree of superheating $T_{SH2}$ of refrigerant in the gas outlet pipe 65 (an example of a downstream refrigerant outlet) of the downstream heat exchange unit 61 is smaller than the degree of superheating $T_{SH1}$ of refrigerant in the gas outlet pipe 55 (an example of an upstream refrigerant outlet) of the upstream heat exchange unit 51 when the indoor heat exchanger 42 functions as an evaporator. To be more specific, the first resistance is channel resistance between the gas-side connection pipe 71 and the liquid-side connection pipe 72 via the upstream heat exchange unit 51, and the second resistance is channel resistance between the gas-side connection pipe 71 and the liquid-side connection pipe 72 via the downstream heat exchange unit 61. As a result, it is possible to make the length $L_{SH2}$ of a superheated region in which superheated refrigerant flows in the downstream heat exchange unit 61 sufficiently small and to improve the heat exchange efficiency. In the indoor heat exchanger 42 described above, the difference between the first resistance and the second resistance is adjusted by using the flow-rate adjusting valve 81, so that the degree of subcooling $T_{SC2}$ of refrigerant in the liquid outlet pipe 68 (an example of a downstream refrigerant outlet) of the downstream heat exchange unit 61 is smaller than the degree of subcooling $T_{SC1}$ of refrigerant at the liquid outlet pipe 58 (an example of an upstream refrigerant outlet) of the upstream heat exchange unit 51 when the indoor heat exchanger 42 functions as a condenser. As a result, it is possible to make the length $L_{SC2}$ of a subcooled region in which subcooled refrigerant flows in the downstream heat exchange unit 61 sufficiently small and to improve the heat exchange efficiency.

(5-2)

Air that has passed through the vicinity of the one end of the upstream flat pipes 92, that is, the inflow regions 53*a* and 53*c* of the upstream heat exchange unit 51 passes through the vicinity of the other end of the downstream flat pipes 94, that is, the outflow regions 63*b* and 63*d* of the downstream heat exchange unit 61. Air that has passed through the vicinity of the other end of the upstream flat pipes 92, that is, the outflow regions 53*b* and 53*d* of the upstream heat exchange unit 51 passes through the vicinity of the one end of the downstream flat pipes 94, that is, the inflow regions 63*a* and 63*c* of the downstream heat exchange unit 61. As a result, nonuniformity in the temperature of conditioning air that passes through the upstream heat exchange unit 51 and the downstream heat exchange unit 61 is reduced. Although the heat exchange efficiency tends to decrease when refrigerants flow in the opposite directions through the upstream heat exchange unit 51 and the downstream heat exchange unit 61, decrease of the heat exchange efficiency is considerably reduced by reducing the length $L_{SH2}$ of the superheated region or the length $L_{SC2}$ of the subcooled region.

(5-3)

In the first embodiment, when the indoor heat exchanger 42 functions as an evaporator, the gas-pipe temperature sensor 44 and the temperature sensor 82 are temperature difference detectors for detecting the difference between the degree of superheating of refrigerant at the refrigerant outlet of the upstream heat exchange unit 51 and the degree of superheating of refrigerant at the refrigerant outlet of the downstream heat exchange unit 61. The flow-rate adjusting valve 81, which is a first flow-rate adjusting valve, adjusts the difference between the first resistance and the second resistance so that the temperature difference detected by the gas-pipe temperature sensor 44 and the temperature sensor 82 is the first threshold or larger, for example, 3° C. or larger, in degree of superheating. When the indoor heat exchanger 42 functions as a condenser, the temperature sensors 83 and 84 are temperature difference detectors for detecting the difference between the degree of subcooling of refrigerant at the refrigerant outlet of the upstream heat exchange unit 51 and the degree of subcooling of refrigerant at the refrigerant outlet of the downstream heat exchange unit 61. The flow-rate adjusting valve 81 adjusts the difference between the first resistance and the second resistance so that the temperature difference detected by the temperature sensors 83 and 84 is the second threshold or larger, for example, 3° C. or larger, in degree of subcooling. As a result, it is possible to reliably maintain the first threshold in degree of superheating or the second threshold in degree of subcooling by changing the flow-rate adjusting valve 81 even when the state of refrigerant and/or air that flows in the indoor heat exchanger 42 changes. Therefore, it is possible to improve the heat exchange efficiency even when the state of refrigerant and/or air changes in the upstream heat exchange unit 51 and the downstream heat exchange unit 61.

(5-4)

As described in modification 1A, in the upstream heat exchange unit 51 and the downstream heat exchange unit 61, the difference between the first resistance and the second resistance may be adjusted beforehand so as to be the first threshold or larger in degree of superheating or the second threshold or larger in degree of subcooling. Therefore, it is possible to easily maintain the first threshold in degree of superheating and the second threshold in degree of sub cooling in the use ranges of the upstream heat exchange unit 51 and the downstream heat exchange unit 61. As a result, it is possible to improve the heat exchange efficiency at low cost.

(5-5)

As with the specific setting described above in the first embodiment, the difference in degree of superheating or degree of subcooling between refrigerant at the downstream refrigerant outlet and refrigerant at the upstream refrigerant outlet may be set to be 3° C. or larger. In this case, it is possible to reliably maintain the degree of superheating or the degree of subcooling by using the upstream heat exchange unit 51 whose heat exchange efficiency is higher than that of the downstream heat exchange unit 61. Therefore, it is possible to perform stable heat exchange and to sufficiently improve the heat exchange efficiency.

(5-6)

As with the specific setting described above in the first embodiment, the degree of superheating of refrigerant at the downstream refrigerant outlet or the degree of subcooling of refrigerant at the downstream refrigerant outlet may be adjusted to be 2° C. or smaller. In this case, it is possible to sufficiently enlarge the superheated region or the subcooled region of the downstream heat exchange unit 61. Therefore, it is possible to sufficiently improve the heat exchange efficiency.

(5-7)

In the indoor heat exchanger 42 according to the first embodiment, the first resistance and the second resistance may be set so that the degree of superheating of refrigerant at the downstream refrigerant outlet is constantly smaller than the degree of superheating of refrigerant at the upstream refrigerant outlet, or so that the degree of subcooling of refrigerant at the downstream refrigerant outlet is constantly smaller than the degree of subcooling of refrigerant at the upstream refrigerant outlet, in a state in which the refrigerant circuit 10 is stably operating. In this case, it is possible to make the superheated region in which superheated refrigerant flows or the subcooled region in which subcooled refrigerant flows in the downstream heat exchange unit 61 sufficiently small in the entirety of the stable operating range of the refrigerant circuit 10. The phrase "a state in which the refrigerant circuit 10 is stably operating" refers to a state that is not a transitory state such as during startup of the refrigerant circuit 10 and in which constituent devices of the refrigerant circuit 10 are operated while keeping constant conditions. An example of a state in which the refrigerant circuit 10 is stably operating is a state in which, within an operating range of the refrigerant circuit 10, the operation frequency of the compressor 21 is constant, the rotation speeds of the outdoor fan 27 and the indoor fan 41 are constant, and the expansion-valve opening degree of the expansion valve 24 is constant. For example, the meaning of the phrase "the operation frequency of the compressor 21 is constant" includes not only a case where the same operation frequency continues but also a case where, for example, the operation frequency can be regarded as substantially constant even though the operation frequency may have positive or negative variation of several percent. The same applies to the meaning of "constant" regarding other devices.

(5-8)

The indoor heat exchanger 42 according to the first embodiment may include the gas-side connection pipe 71, which is a first connection pipe, in which refrigerant that flows out from the upstream heat exchange unit 51 and refrigerant that flows out from the downstream heat exchange unit 61 join and flow together when the indoor heat exchanger 42 functions as an evaporator. With such a structure, the relationship between the first resistance and the second resistance does not easily change when, for example, the indoor heat exchanger 42 is transported, and the indoor heat exchanger 42 can be easily handled.

(5-9)

The indoor heat exchanger 42 according to the first embodiment may include the liquid-side connection pipe 72, which is a second connection pipe, in which refrigerant that flows out from the upstream heat exchange unit 51 and refrigerant that flows out from the downstream heat exchange unit 61 join and flow together when the indoor heat exchanger 42 functions as a condenser. With such a structure, the relationship between the first resistance and the second resistance does not easily change when, for example, the indoor heat exchanger 42 is transported, and the indoor heat exchanger 42 can be easily handled.

(5-10)

The indoor heat exchanger 42 according to the first embodiment may include the expansion valve 24, which is a second flow-rate adjusting valve, that adjusts the flow rate of refrigerant that flows into the upstream heat exchange unit 51 and the downstream heat exchange unit 61 before the flow of the refrigerant is split when the indoor heat exchanger 42 functions as an evaporator, and/or the expansion valve 24, which is a third flow-rate adjusting valve, that adjusts the flow rate of refrigerant that has flowed out from the upstream heat exchange unit 51 and the downstream heat exchange unit 61 after flows of the refrigerant have joined when the indoor heat exchanger 42 functions as a condenser. With such a structure, compared with a case where the second flow-rate adjusting valve and/or the third flow-rate adjusting valve are retrofitted, it is easy to adjust the second flow-rate adjusting valve and/or the third flow-rate adjusting valve when incorporating the indoor heat exchanger 42 in the refrigerant circuit 10, and it is easy to incorporate the indoor heat exchanger 42 in the refrigerant circuit 10.

Second Embodiment (6) Overall Structure

A refrigeration apparatus according to the second embodiment can be structured in a similar way to the refrigeration apparatus according to the first embodiment. Because the second embodiment considerably differs from the first embodiment in the structure of the indoor heat exchanger, description of the second embodiment will be focused on the structure and operation of the indoor heat exchanger.

(7) Detailed Structure (7-1) Indoor Heat Exchanger 42A

Figure 18:
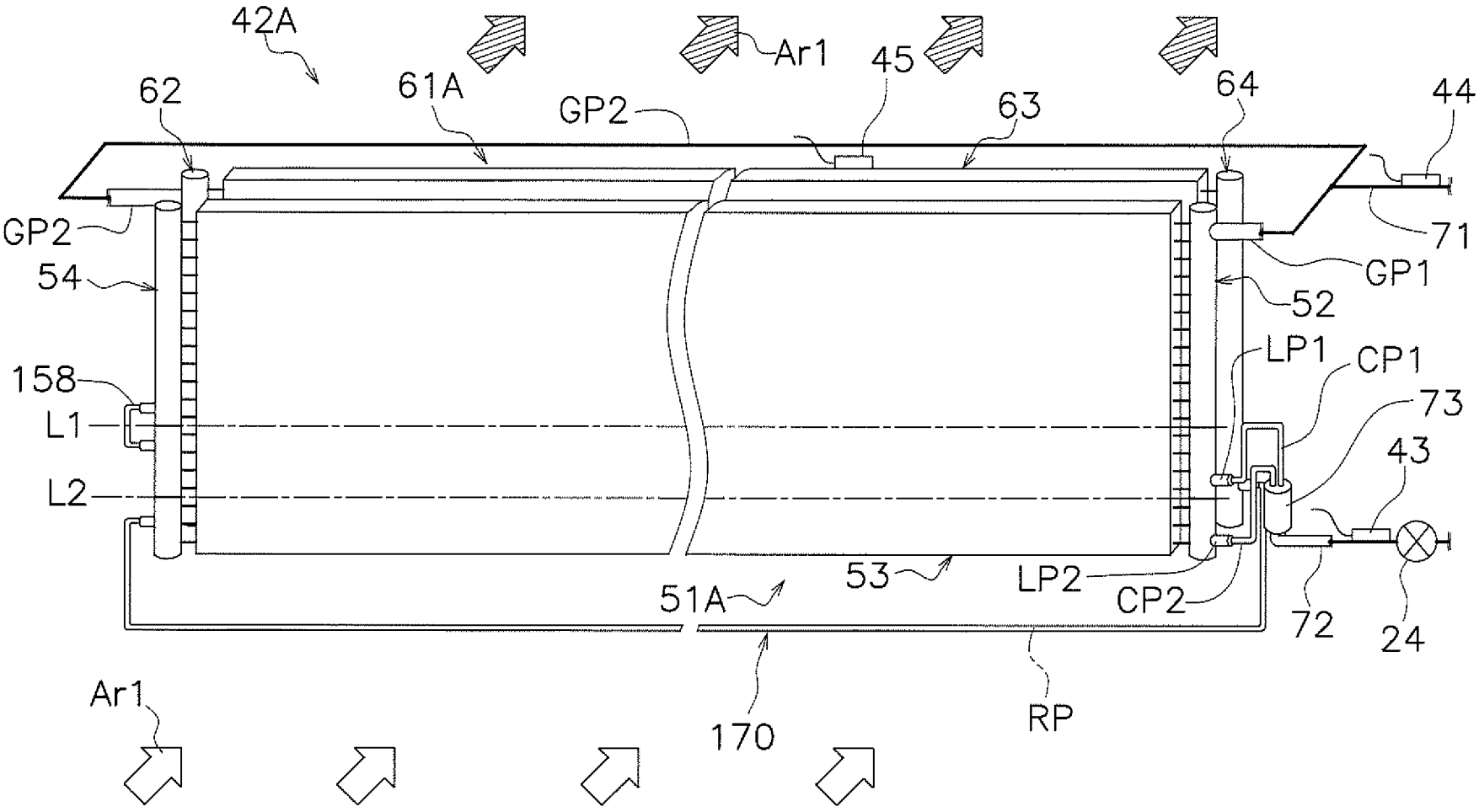
FIG. 18 is a schematic view of an indoor heat exchanger according to a second embodiment.

FIG. 18 is a schematic view of an indoor heat exchanger 42A. The indoor heat exchanger 42A illustrated in FIG. 18 is bent in a refrigeration apparatus 1 according to the present embodiment as illustrated in FIGS. 5 and 6. However, for convenience of the description, bent portions are extended in FIG. 18 so that refrigerant flows straightly. The indoor heat exchanger 42A includes an upstream heat exchange unit 51A disposed upstream of the airflow, a downstream heat exchange unit 61A disposed downstream of the airflow, a connection pipe 170 that connects the upstream heat exchange unit 51A and the downstream heat exchange unit 61A, the expansion valve 24, the liquid-side connection pipe 72, the flow splitter 73, capillary tubes CP1 and CP2, the gas-side connection pipe 71, the liquid-pipe temperature sensor 43, the gas-pipe temperature sensor 44, and the heat-exchanger temperature sensor 45. Airflow in the direction of arrow Ar1 is formed in the indoor heat exchanger 42A illustrated in FIG. 18.

(7-1-1) Airflow-Upstream Heat Exchange Unit 51A

Figure 19:
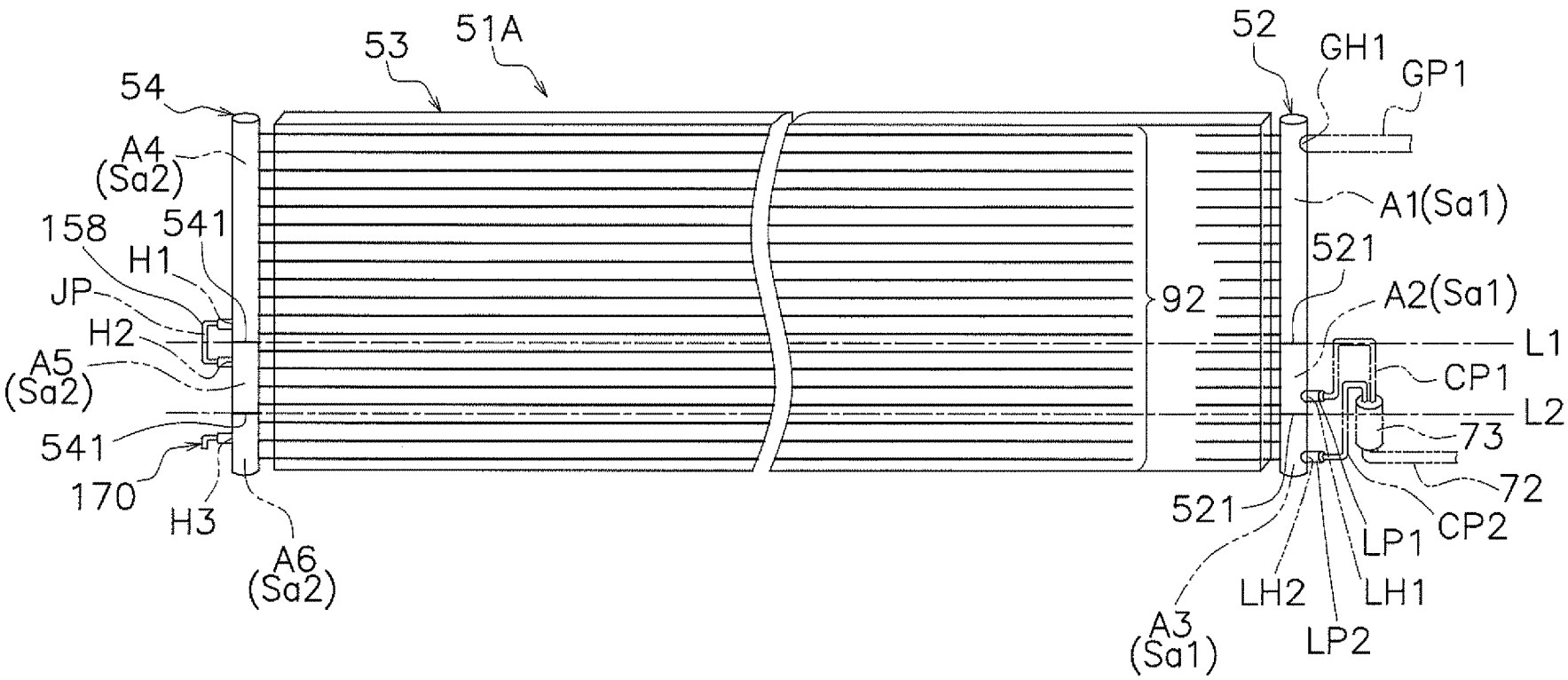
FIG. 19 is a schematic view of an upstream heat exchange unit of the indoor heat exchanger of FIG. 18.

FIG. 19 is a schematic view of the upstream heat exchange unit 51A. The upstream heat exchange unit 51A includes the upstream heat exchange region 53, the upstream first header manifold 52, the upstream second header manifold 54, a reversely bent pipe 158, a first gas-side connection pipe GP1, a first liquid-side connection pipe LP1, and a second liquid-side connection pipe LP2. Regarding the velocity distribution of indoor airflow that passes through the upstream heat exchange unit 51A disposed in the indoor unit 4, the airflow velocity in a lower region is lower than that of an upper region. To be specific, the airflow velocity of indoor airflow that passes through a portion of the upstream heat exchange unit 51A below a chain line L1 (see FIG. 19) is lower than the airflow velocity of indoor airflow that passes through a portion above the chain line L1.

(7-1-1-1) Airflow-Upstream First Header Manifold 52

The upstream first header manifold 52 is a header manifold that functions as: a splitting header that splits the flow of refrigerant into the upstream flat pipes 92; a joining header that joins the flows of refrigerants that flow out from the upstream flat pipes 92; a reversing header that reverses the direction of flow of refrigerant that flows out from each of the upstream flat pipes 92 to another upstream flat pipe 92; or the like. In an installed state, the longitudinal direction of the upstream first header manifold 52 coincides with the vertical direction (up-down direction).

The upstream first header manifold 52 has a tubular shape and has an inner space (hereinafter, referred to as an "upstream first header space Sa1"). The upstream first header space Sa1 is located most downstream of refrigerant flow in the upstream heat exchange unit 51A during a cooling operation, and is located most upstream of refrigerant flow in the upstream heat exchange unit 51A during a heating operation. The upstream first header manifold 52 is connected to an end portion of each of the upstream flat pipes 92 and allows the upstream flat pipes 92 to communicate with the upstream first header space Sa1.

A plurality of (here, two) partition plates 521 are disposed in the upstream first header manifold 52. The partition plates 521 divide the upstream first header space Sa1 into a plurality of (here, three) spaces (to be specific, an upstream first space A1, an upstream second space A2, and an upstream third space A3) in a step direction (here, corresponding to the vertical direction). In other words, in the upstream first header manifold 52, the upstream first space A1, the upstream second space A2, and the upstream third space A3 are arranged from top to bottom in this order. Accordingly, the upstream first space A1 is disposed at the top of the upstream first header space Sa1, the upstream second space A2 is disposed at the middle of the upstream first header space Sa1 (between the upstream first space A1 and the upstream third space A3), and the upstream third space A3 is disposed at the bottom of the upstream first header space Sa1.

The upstream first header manifold 52 has a first gas-side port GH1. The first gas-side port GH1 communicates with the upstream first space A1. The first gas-side connection pipe GP1 is connected to the first gas-side port GH1.

The upstream first header manifold 52 has a first liquid-side port LH1 and a second liquid-side port LH2. The first liquid-side port LH1 communicates with the upstream second space A2. The capillary tube CP1 is connected to the first liquid-side port LH1 via the first liquid-side connection pipe LP1. The second liquid-side port LH2 communicates with the upstream third space A3. The capillary tube CP2 is connected to the second liquid-side port LH2 via the second liquid-side connection pipe LP2.

(7-1-1-2) Airflow-Upstream Second Header Manifold 54

The upstream second header manifold 54 is a header manifold that functions as: a splitting header that splits the flow of refrigerant into the upstream flat pipes 92; a joining header that joins the flows of refrigerants that flow out from the upstream flat pipes 92; a reversing header that reverses the direction of flow of refrigerant that has flowed out from each of the upstream flat pipes 92 to another upstream flat pipe 92; or the like. In an installed state, the longitudinal direction of the upstream second header manifold 54 coincides with the vertical direction (up-down direction).

The upstream second header manifold 54 has a tubular shape and has an inner space (hereinafter, referred to as an "upstream second header space Sa2"). The upstream second header space Sa2 is located at the most upstream location of refrigerant flow in the upstream heat exchange unit 51A during a cooling operation, and is located at the most downstream location of refrigerant flow in the upstream heat exchange unit 51A during a heating operation. The upstream second header manifold 54 is connected to an end portion of each of the upstream flat pipes 92 and allows the upstream flat pipes 92 to communicate with the upstream second header space Sa2.

A plurality of (here, two) partition plates 541 are disposed in the upstream second header manifold 54. The partition plates 541 divide the upstream second header space Sa2 into a plurality of (here, three) spaces (to be specific, an upstream fourth space A4, an upstream fifth space A5, and an upstream sixth space A6) in a step direction (here, corresponding to the vertical direction). In other words, in the upstream second header manifold 54, the upstream fourth space A4, the upstream fifth space A5, and the upstream sixth space A6 are arranged from top to bottom in this order. Accordingly, the upstream fourth space A4 is disposed at the top of the upstream second header space Sa2, the upstream fifth space A5 is disposed at the middle of the upstream second header space Sa2 (between the upstream fourth space A4 and the upstream sixth space A6), and the upstream sixth space A6 is disposed at the bottom of the upstream second header space Sa2.

The upstream fourth space A4 communicates with the upstream first space A1 via the upstream flat pipes 92. The upstream fifth space A5 communicates with the upstream second space A2 via the upstream flat pipes 92. The upstream fifth space A5 communicates with the upstream fourth space A4 via the reversely bent pipe 158. The upstream sixth space A6 communicates with the upstream third space A3 via the upstream flat pipes 92. The upstream second header manifold 54 has a first connection hole H1 for connecting one end of the reversely bent pipe 158. The first connection hole H1 communicates with the upstream fourth space A4. The upstream second header manifold 54 has a second connection hole H2 for connecting the other end of the reversely bent pipe 158. The second connection hole H2 communicates with the upstream fifth space A5. Moreover, the upstream second header manifold 54 has a third connection hole H3 for connecting one end of the connection pipe 170. The third connection hole H3 communicates with the upstream sixth space A6. The one end of the connection pipe 170 is connected to the third connection hole H3 so that the upstream sixth space A6 and a downstream second header space Sb2 (described below) communicate with each other.

(7-1-1-3) Reversely Bent Pipe 158

The reversely bent pipe 158 is a pipe that forms a reverse channel JP that reverses the direction of flow of refrigerant that has passed through the upstream flat pipes 92 and flowed into one of portions of the upstream second header space Sa2 of the upstream second header manifolds 54 (here, the upstream fourth space A4 or the upstream fifth space A5) and to cause the refrigerant to flow into another portion of the upstream second header space Sa2 (here, the upstream fifth space A5 or the upstream fourth space A4). In the present embodiment, one end of the reversely bent pipe 158 is connected to the upstream second header manifold 54 so as to communicate with the upstream fourth space A4, and the other end of the reversely bent pipe 158 is connected to the upstream second header manifold 54 so as to communicate with the upstream fifth space A5. That is, the reverse channel JP allows the upstream fourth space A4 and the upstream fifth space A5 to communicate with each other.

(7-1-2) Airflow-Downstream Heat Exchange Unit 61A

Figure 20:
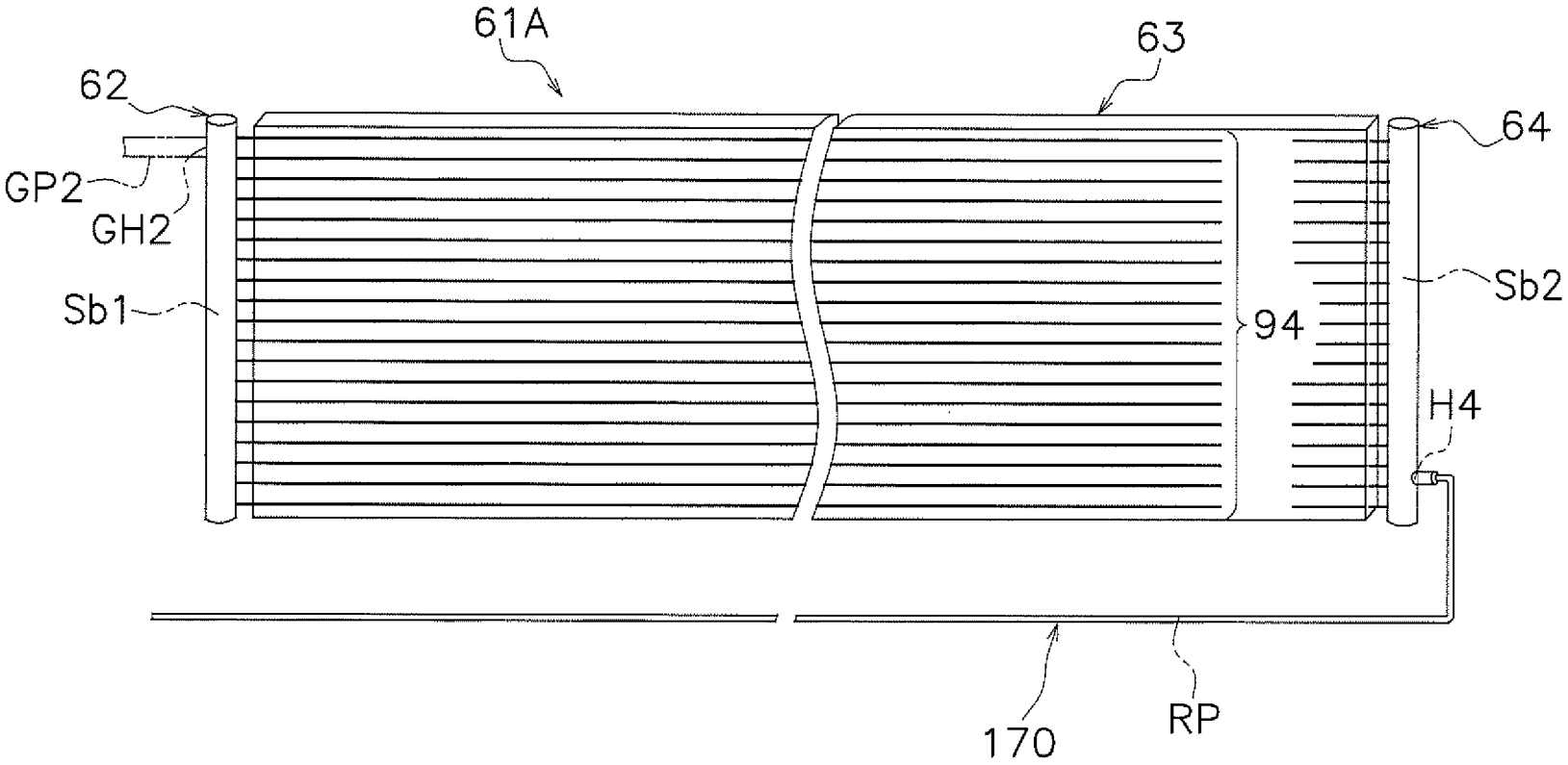
FIG. 20 is a schematic view of a downstream heat exchange unit of the indoor heat exchanger of FIG. 18.

FIG. 20 is a schematic view of the downstream heat exchange unit 61A. The downstream heat exchange unit 61A includes the downstream heat exchange region 63, the downstream first header manifold 62, the downstream second header manifold 64, and a second gas-side connection pipe GP2. Regarding the velocity distribution of indoor airflow that passes through the downstream heat exchange unit 61A disposed in the indoor unit 4, the airflow velocity in a lower region is lower than that of an upper region. To be specific, the airflow velocity of indoor airflow that passes through a portion of the downstream heat exchange unit 61A below a chain line L1 (see FIG. 21) is lower than the airflow velocity of indoor airflow that passes through a portion above the chain line L1.

(7-1-2-1) Airflow-Downstream First Header Manifold 62

The downstream first header manifold 62 is a header manifold that functions as: a splitting header that splits the flow of refrigerant into the downstream flat pipes 94; a joining header that joins the flows of refrigerants that flow out from the downstream flat pipes 94; or the like. In an installed state, the longitudinal direction of the downstream first header manifold 62 coincides with the vertical direction (up-down direction).

The downstream first header manifold 62 has a tubular shape and has an inner space (hereinafter, referred to as an "downstream first header space Sb1"). The downstream first header space Sb1 is located at the most downstream location of refrigerant flow in the downstream heat exchange unit 61A during a cooling operation, and is located at the most upstream location of refrigerant flow in the downstream heat exchange unit 61A during a heating operation. The downstream first header manifold 62 is connected to an end portion of each of the downstream flat pipes 94 and allows the downstream flat pipes 94 to communicate with the downstream first header space Sb1.

The downstream first header manifold 62 has a second gas-side port GH2. The second gas-side port GH2 communicates with the downstream first header space Sb1. The second gas-side connection pipe GP2 is connected to the second gas-side port GH2.

(7-1-2-2) Airflow-Downstream Second Header Manifold 64

The downstream second header manifold 64 is a header manifold that functions as: a splitting header that splits the flow of refrigerant into the downstream flat pipes 94; or a joining header that joins the flows of refrigerants that flow out from the downstream flat pipes 94. In an installed state, the longitudinal direction of the downstream second header manifold 64 coincides with the vertical direction (up-down direction).

The downstream second header manifold 64 has a tubular shape and has an inner space (hereinafter, referred to as an "downstream second header space Sb2"). The downstream second header space Sb2 is located at the most upstream location of refrigerant flow in the downstream heat exchange unit 61A during a cooling operation, and is located at the most downstream location of refrigerant flow in the downstream heat exchange unit 61A during a heating operation.

The downstream second header manifold 64 is connected to an end portion of each of the downstream flat pipes 94 and allows the downstream flat pipes 94 to communicate with the downstream second header space Sb2. The downstream second header manifold 64 has a fourth connection hole H4 for connecting the other end of the connection pipe 170. The fourth connection hole H4 communicates with the downstream second header space Sb2. The other end of the connection pipe 170 is connected to the fourth connection hole H4 so that the downstream second header space Sb2 and the upstream sixth space A6 communicate with each other.

(7-1-3) Connection Pipe 170

The connection pipe 170 is a refrigerant pipe that forms a connection channel RP between the upstream heat exchange unit MA and the downstream heat exchange unit 61A. The connection channel RP is a refrigerant channel that allows the downstream second header space Sb2 and the upstream sixth space A6 communicate with each other. Because the connection pipe 170 forms the connection channel RP, refrigerant flows from the upstream sixth space A6 toward the downstream second header space Sb2 during a cooling operation, and refrigerant flows from the downstream second header space Sb2 toward the upstream sixth space A6 during a heating operation.

(7-1-4) Capillary Tubes CP1 and CP2

The capillary tubes CP1 and CP2 adjust the first resistance that is channel resistance to refrigerant that flows in the upstream heat exchange unit 51A and the second resistance that is channel resistance to refrigerant that flows in the downstream heat exchange unit 61A. The capillary tubes CP1 and CP2 adjust the difference between the first resistance in the upstream heat exchange unit 51A and the second resistance in the downstream heat exchange unit 61A beforehand so as to generate a difference in degree of superheating that is the first threshold or larger or a difference in degree of subcooling that is the second threshold or larger. Accordingly, in the second embodiment, the temperature sensors 82 to 84 (see FIGS. 12 and 14) and the like, which are attached to the indoor heat exchanger 42 in the first embodiment, are omitted.

(7-2) Refrigerant Paths in Indoor Heat Exchanger 42A

Figure 21:
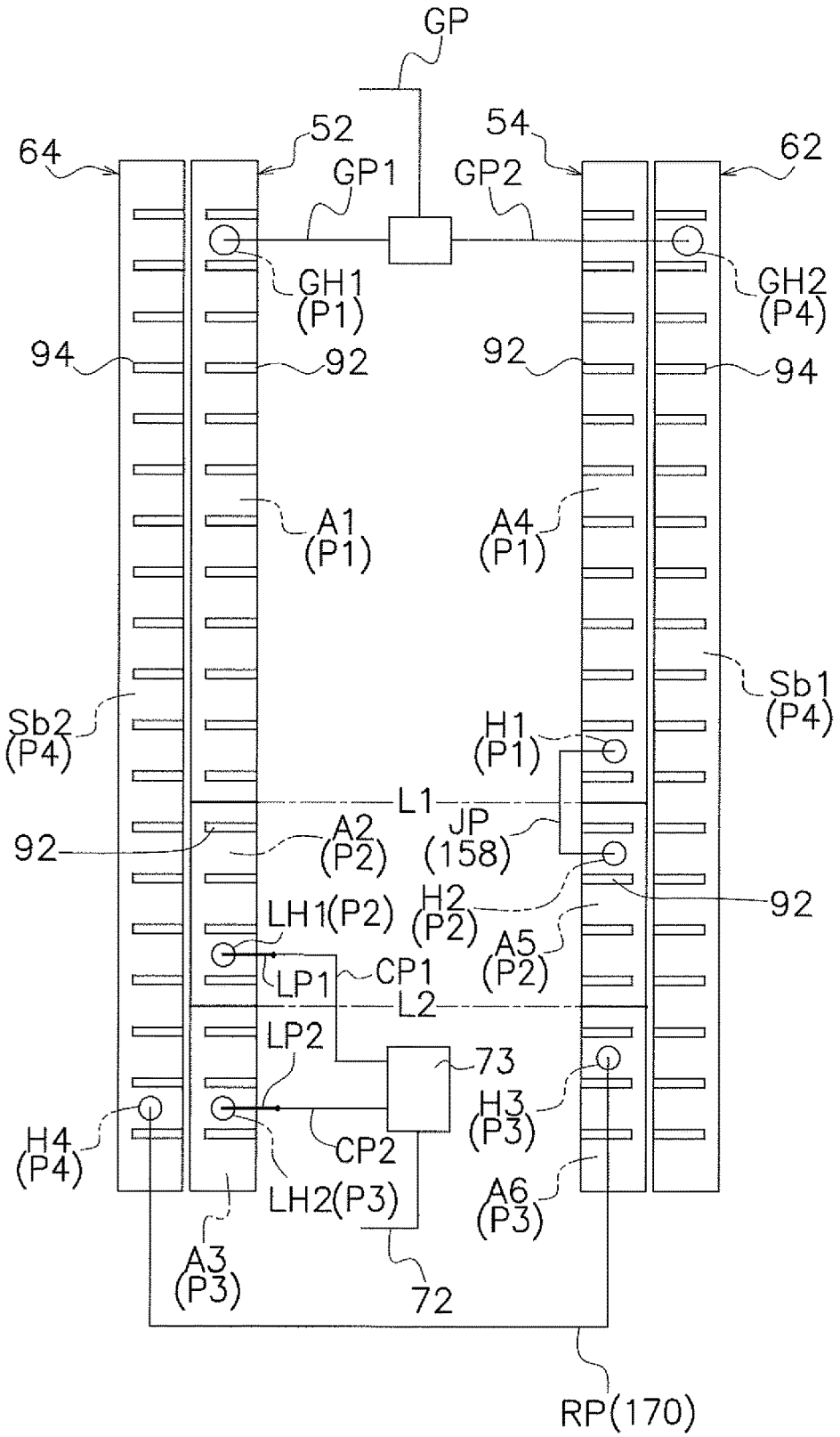
FIG. 21 is a schematic view illustrating the path of refrigerant in the indoor heat exchanger of FIG. 18.

FIG. 21 is a schematic view of refrigerant paths in the indoor heat exchanger 42A. The term "path" refers to a channel of refrigerant that is formed because elements that are included in the indoor heat exchanger 42A communicate with each other. The indoor heat exchanger 42A has a plurality of paths. To be specific, the indoor heat exchanger 42A has a first path P1, a second path P2, a third path P3, and a fourth path P4.

(7-2-1) First Path P1

The first path P1 is formed in the upstream heat exchange unit 51A. In the present embodiment, the first path P1 is formed in the upstream heat exchange unit 51A above the chain line L1 (FIGS. 18, 19, 21, and others). The first path P1 is a refrigerant channel that is formed because the first gas-side port GH1 communicates with the upstream first space A1, the upstream first space A1 communicates with the upstream fourth space A4 via heat transfer tube channels in the upstream flat pipes 92, and the upstream fourth space A4 communicates with the first connection hole H1. In other words, the first path P1 is a refrigerant channel that includes the first gas-side port GH1, the upstream first space A1 in the upstream first header manifold 52, the heat transfer tube channels in the upstream flat pipes 92, the upstream fourth space A4 in the upstream second header manifold 54, and the first connection hole H1. As illustrated in FIGS. 19 and 21, the chain line L1 is located between the twelfth upstream flat pipe 92 and the thirteenth upstream flat pipe 92, counted from the top. That is, in the present embodiment, the first path P1 includes twelve upstream flat pipes 92, counted from the top.

(7-2-2) Second Path P2

The second path P2 is formed in the upstream heat exchange unit 51A. In the present embodiment, the second path P2 is formed in the upstream heat exchange unit 51A below the chain line L1 and above the chain line L2 (FIGS. 18, 19, 21, and others). The second path P2 is a refrigerant channel that is formed because the second connection hole H2 communicates with the upstream fifth space A5, the upstream fifth space A5 communicates with the upstream second space A2 via heat transfer tube channels in the upstream flat pipes 92, and the upstream second space A2 communicates with the first liquid-side port LH1. That is, the second path P2 is a refrigerant channel that includes the second connection hole H2, the upstream fifth space A5 in the upstream second header manifold 54, the heat transfer tube channels in the upstream flat pipes 92, the upstream second space A2 in the upstream first header manifold 52, and the first liquid-side port LH1. The second path P2 communicates with the first path P1 via the reverse channel JP (the reversely bent pipe 158).

As illustrated in FIGS. 19 and 21, the chain line L2 is located between the sixteenth upstream flat pipe 92 and the seventeenth the upstream flat pipe 92, counted from the top. That is, in the present embodiment, the second path P2 includes the thirteenth to sixteenth upstream flat pipes 92 (in other words, four upstream flat pipes 92), counted from the top.

(7-2-3) Third Path P3

The third path P3 is formed in the upstream heat exchange unit 51A. In the present embodiment, the third path P3 is formed in the upstream heat exchange unit 51A below the chain line L2. The third path P3 is a refrigerant channel that is formed because the third connection hole H3 communicates with the upstream sixth space A6, the upstream sixth space A6 communicates with the upstream third space A3 via heat transfer tube channels in the upstream flat pipes 92, and the upstream third space A3 communicates with the second liquid-side port LH2. That is, the third path P3 is a refrigerant channel that includes the third connection hole H3, the upstream sixth space A6 in the upstream second header manifold 54, the heat transfer tube channels in the upstream flat pipes 92, the upstream third space A3 in the upstream first header manifold 52, and the second liquid-side port LH2. The third path P3 communicates with the fourth path P4 via the connection channel RP (the connection pipe 170). In the present embodiment, the third path P3 includes the seventeenth to nineteenth upstream flat pipes 92, counted from the top (in other words, three upstream flat pipes 92, counted from the bottom).

(7-2-4) Fourth Path P4

The fourth path P4 is formed in the downstream heat exchange unit 61A. The fourth path P4 is a refrigerant channel that is formed because the second gas-side port GH2 communicates with the downstream first header space Sb1, the downstream first header space Sb1 communicates with the downstream second header space Sb2 via heat transfer tube channels in the downstream flat pipes 94, and the downstream second header space Sb2 communicates with the fourth connection hole H4. That is, the fourth path P4 includes the second gas-side port GH2, the downstream first header space Sb1 in the downstream first header manifold 62, the heat transfer tube channels in the downstream flat pipes 94, the downstream second header space Sb2 in the downstream second header manifold 64, and the fourth connection hole H4. The fourth path P4 communicates with the third path P3 via the connection channel RP (the connection pipe 170).

Figure 22:
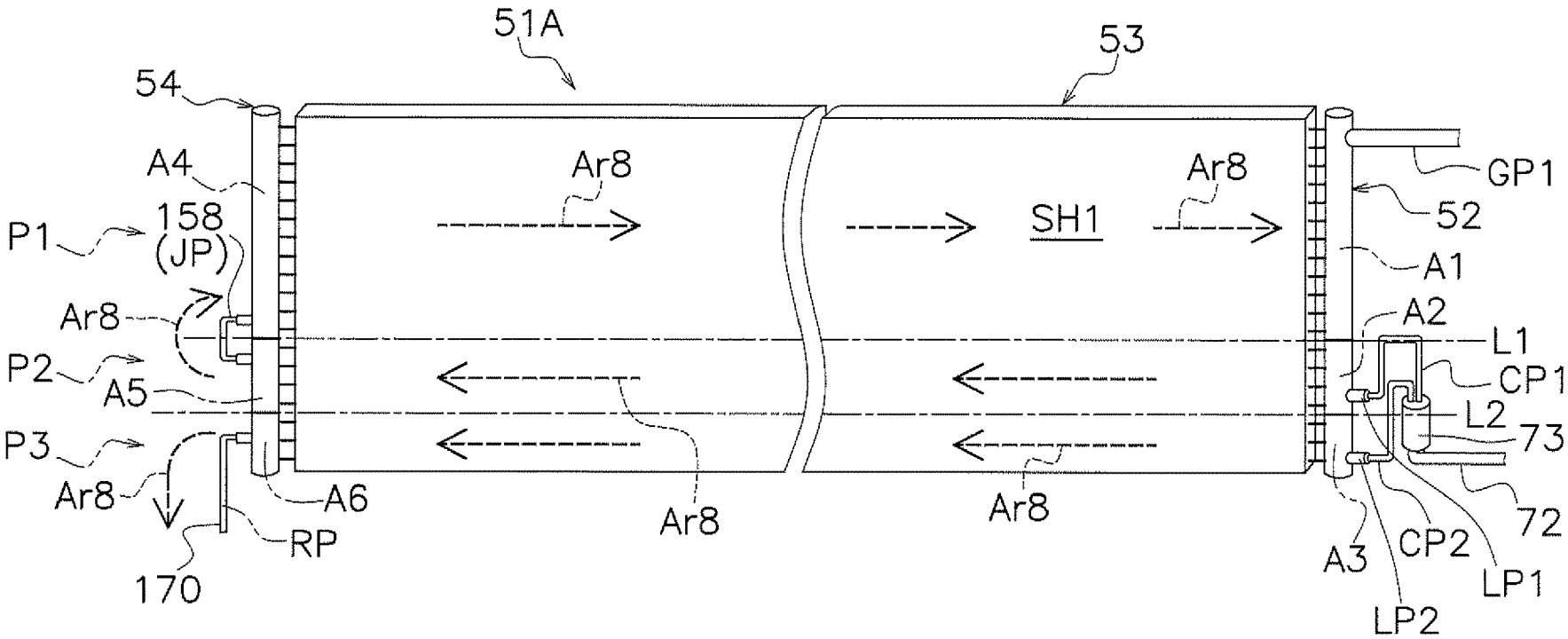
FIG. 22 is a schematic view illustrating the flow of refrigerant in the upstream heat exchange unit during a cooling operation.
Figure 23:
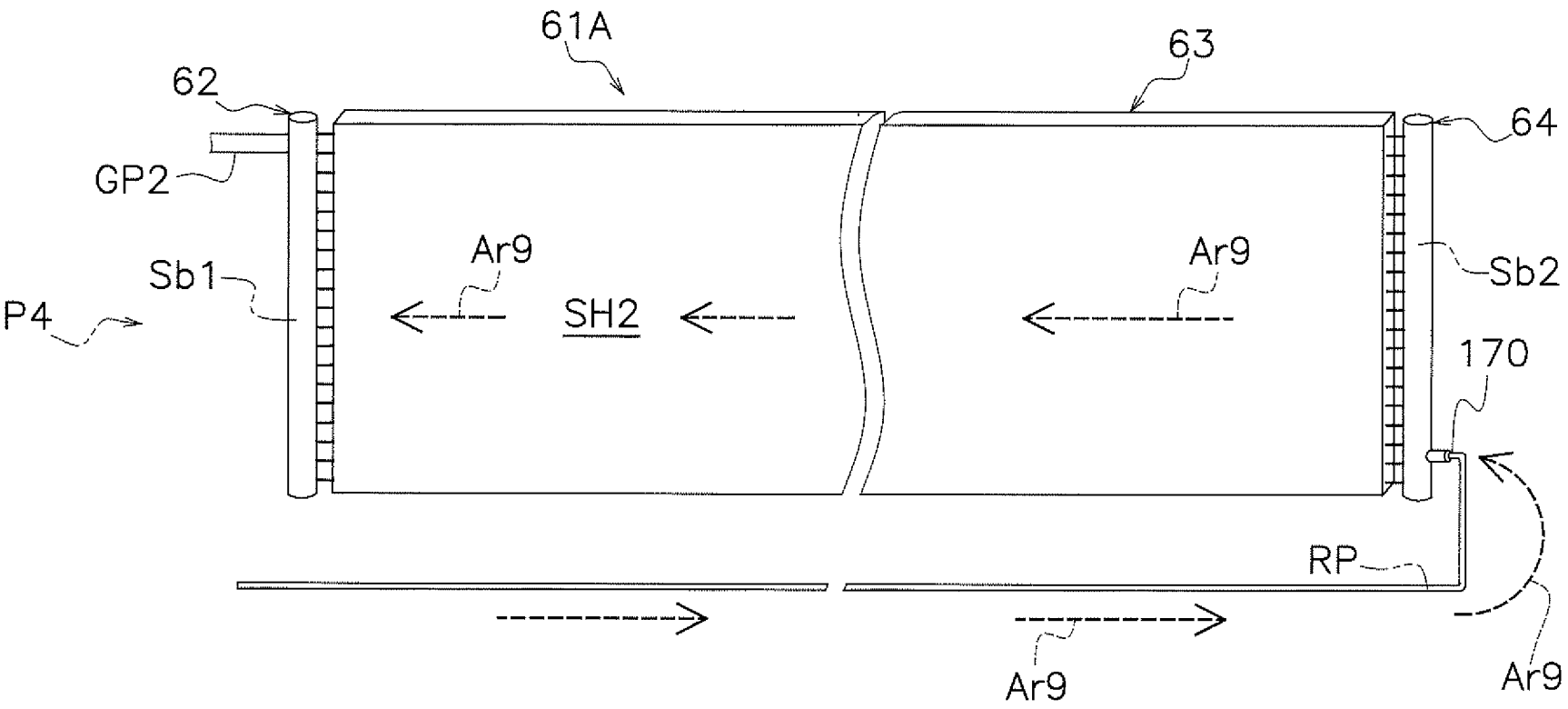
FIG. 23 is a schematic view illustrating the flow of refrigerant in the downstream heat exchange unit during a cooling operation.

(7-3) Flow of Refrigerant in Indoor Heat Exchanger 42A (7-3-1) During Cooling Operation FIG. 22 is a schematic view illustrating the flow of refrigerant in the upstream heat exchange unit 51A during a cooling operation. FIG. 23 is a schematic view illustrating the flow of refrigerant in the downstream heat exchange unit 61A during a cooling operation. In FIGS. 22 and 23, broken-line arrows Ar8 and Ar9 indicate refrigerant flow directions.

During a cooling operation, refrigerant that has flowed through the capillary tube CP1 flows into the second path P2 of the upstream heat exchange unit 51A via the first liquid-side connection pipe LP1 and the first liquid-side port LH1. The refrigerant that has flowed into the second path P2 passes through the second path P2 while being heated by exchanging heat with indoor airflow, and flows into the first path P1 via the reverse channel JP (the reversely bent pipe 158). The refrigerant that has flowed into the first path P1 passes through the first path P1 while being heated by exchanging heat with indoor airflow, and flows out to the first gas-side connection pipe GP1 via the first gas-side port GH1. In this way, during a cooling operation, the first liquid-side connection pipe LP1 functions as an upstream refrigerant inlet, and the first gas-side connection pipe GP1 functions as an upstream refrigerant outlet.

During a cooling operation, refrigerant that has flowed through the capillary tube CP2 flows into the third path P3 of the upstream heat exchange unit 51A via the second liquid-side connection pipe LP2 and the second liquid-side port LH2. The refrigerant that has flowed into the third path P3 passes through the third path P3 while being heated by exchanging heat with indoor airflow, and flows into the fourth path P4 of the downstream heat exchange unit 61A via the connection channel RP (the connection pipe 170). The refrigerant that has flowed into the fourth path P4 passes through the fourth path P4 while being heated by exchanging heat with indoor airflow, and flows out to the second gas-side connection pipe GP2 via the second gas-side port GH2. In this way, during a cooling operation, the second liquid-side connection pipe LP2 functions as a downstream refrigerant inlet, and the second gas-side connection pipe GP2 functions as a downstream refrigerant outlet.

In this way, during a cooling operation, in the indoor heat exchanger 42A, a flow of refrigerant that flows into the second path P2, passes through the first path P1, and flows out (that is, a flow of refrigerant formed by the first path P1 and the second path P2), and a flow of refrigerant that flows into the third path P3, passes through the fourth path P4, and flows out (that is, a flow of refrigerant formed by the third path P3 and the fourth path P4) are formed.

In the flow of refrigerant formed by the first path P1 and the second path P2, the refrigerant flows through the first liquid-side port LH1, the upstream second space A2, the heat transfer tube channels in the upstream flat pipes 92 in the second path P2, the upstream fifth space A5, the reverse channel JP (the reversely bent pipe 158), the upstream fourth space A4, the heat transfer tube channels in the upstream flat pipes 92 in the first path P1, the upstream first space A1, and the first gas-side port GH1, in this order.

In the flow of refrigerant formed by the third path P3 and the fourth path P4, the refrigerant flows through the second liquid-side port LH2, the upstream third space A3, the heat transfer tube channels in the upstream flat pipes 92 of the third path P3, the upstream sixth space A6, the connection channel RP (the connection pipe 170), the downstream second header space Sb2, the heat transfer tube channels in the downstream flat pipes 94 in the fourth path P4, the downstream first header space Sb1, and the second gas-side port GH2, in this order During a cooling operation, in the indoor heat exchanger 42A, a region in which superheated refrigerant flows (superheated region SH1) is formed in the heat transfer tube channels in the upstream flat pipes 92 in the first path P1 (in particular, in the heat transfer tube channels near the upstream first header manifold 52). Moreover, a region in which superheated refrigerant flows (superheated region SH2) is formed in the heat transfer tube channels in the downstream flat pipes 94 in the fourth path P4 (in particular, in the heat transfer tube channels near the downstream first header manifold 62).

(7-3-2) During Heating Operation

Figure 24:
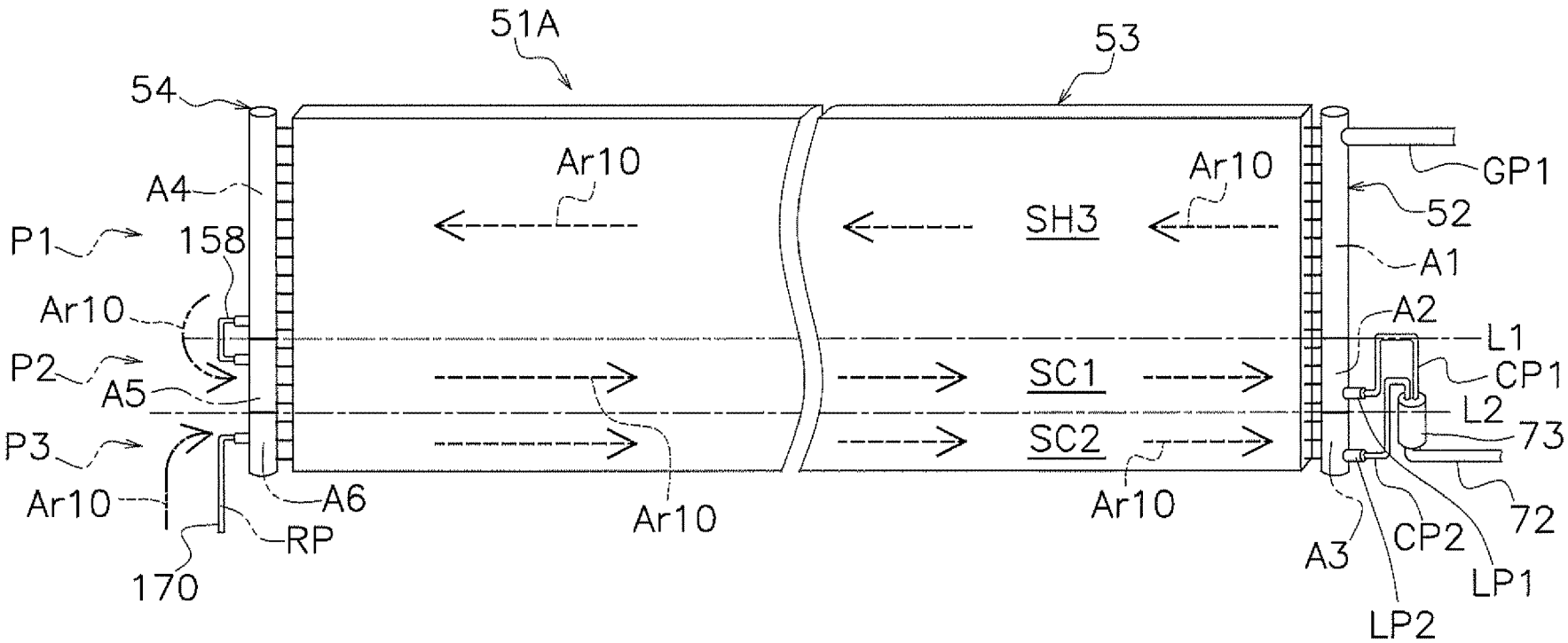
FIG. 24 is a schematic view illustrating the flow of refrigerant in the upstream heat exchange unit during a heating operation.
Figure 25:
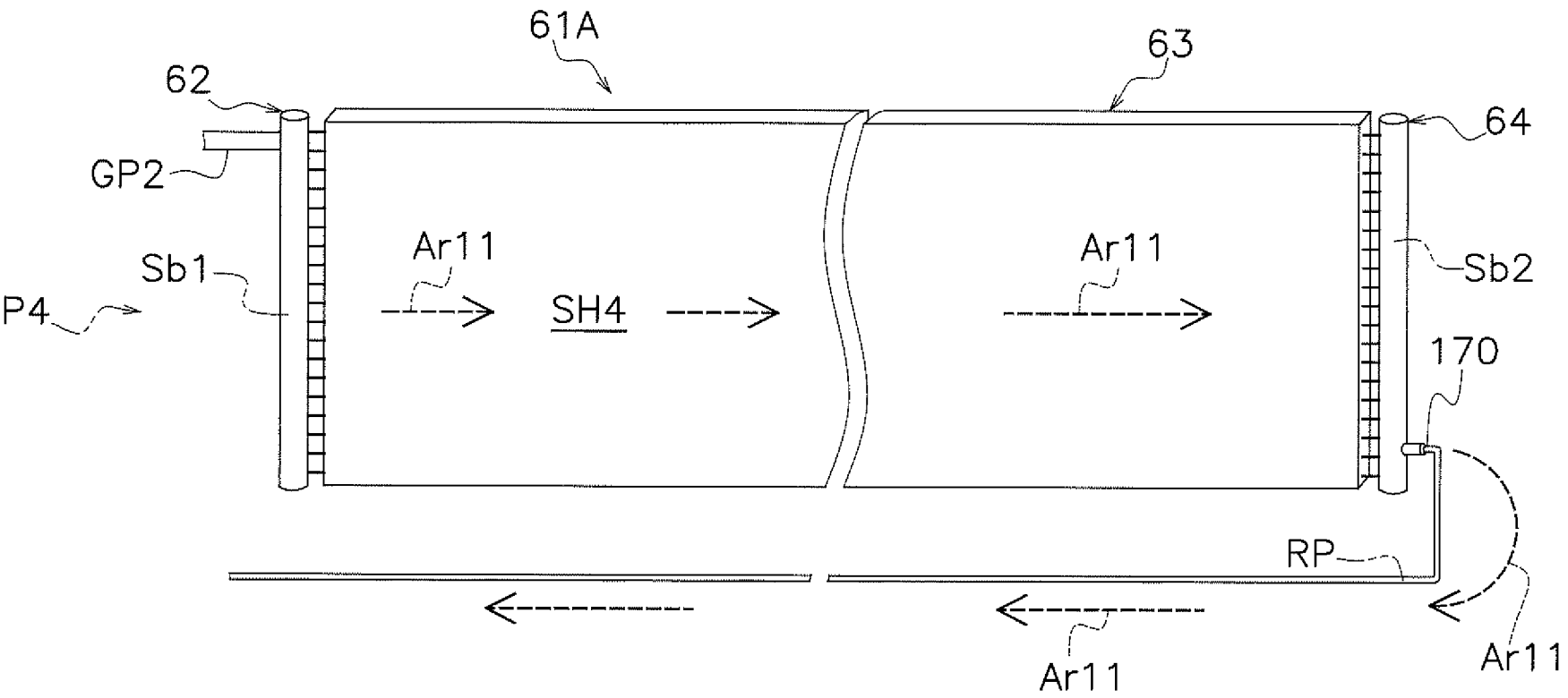
FIG. 25 is a schematic view illustrating the flow of refrigerant in the downstream heat exchange unit during a heating operation.

FIG. 24 is a schematic view illustrating the flow of superheated gas refrigerant in the upstream heat exchange unit 51A during a heating operation. FIG. 25 is a schematic view illustrating the flow of refrigerant in the downstream heat exchange unit 61A during a heating operation. In FIGS. 24 and 25, broken-line arrows Ar10 and Ar11 indicate refrigerant flow directions.

During a heating operation, refrigerant that has flowed through the first gas-side connection pipe GP1 flows into the first path P1 of the upstream heat exchange unit 51A via the first gas-side port GH1. The refrigerant that has flowed into the first path P1 passes through the first path P1 while being cooled by exchanging heat with indoor airflow, and flows into the second path P2 via the reverse channel JP (the reversely bent pipe 158). The refrigerant that has flowed into the second path P2 passes through the second path P2 while becoming subcooled by exchanging heat with indoor airflow, and flows out to the capillary tube CP1 via the first liquid-side port LH1 and the first liquid-side connection pipe LP1. In this way, during a heating operation, the first gas-side connection pipe GP1 functions as an upstream refrigerant inlet, and the first liquid-side connection pipe LP1 functions as an upstream refrigerant outlet.

During a heating operation, superheated gas refrigerant that has flowed through the second gas-side connection pipe GP2 flows into the fourth path P4 of the downstream heat exchange unit 61A via the second gas-side port GH2. The refrigerant that has flowed into the fourth path P4 passes through the fourth path P4 while being cooled by exchanging heat with indoor airflow, and flows into the third path P3 of the upstream heat exchange unit 51A via the connection channel RP (the connection pipe 170). The refrigerant that has flowed into the third path P3 passes through the third path P3 while becoming subcooled by exchanging heat with indoor airflow, and flows out to the capillary tube CP2 via the second liquid-side port LH2 and the second liquid-side connection pipe LP2. In this way, during a heating operation, the second gas-side connection pipe GP2 functions as a downstream refrigerant inlet, and the second liquid-side connection pipe LP2 functions as a downstream refrigerant outlet.

In this way, during a heating operation, in the indoor heat exchanger 42A, a flow of refrigerant that flows into the first path P2, passes through the second path P2, and flows out (that is, a flow of refrigerant formed by the first path P1 and the second path P2), and a flow of refrigerant that flows into the fourth path P4, passes through the third path P3, and flows out (that is, a flow of refrigerant formed by the third path P3 and the fourth path P4) are formed.

In the flow of refrigerant formed by the first path P1 and the second path P2, the refrigerant flows through the first gas-side port GH1, the upstream first space A1, the heat transfer tube channels in the upstream flat pipes 92 in the first path P1, the upstream fourth space A4, the reverse channel JP (the reversely bent pipe 158), the upstream fifth space A5, the heat transfer tube channels in the upstream flat pipes 92 in the second path P2, the upstream second space A2, and the first liquid-side port LH1, in this order.

In the flow of refrigerant formed by the third path P3 and the fourth path P4, the refrigerant flows through the second gas-side port GH2, the downstream first header space Sb1, the heat transfer tube channels in the downstream flat pipes 94 in the fourth path P4, the downstream second header space Sb2, the connection channel RP (the connection pipe 170), the upstream sixth space A6, the heat transfer tube channels in the upstream flat pipes 92 in the third path P3, the upstream third space A3, and the second liquid-side port LH2, in this order.

During a heating operation, in the indoor heat exchanger 42A, a region in which superheated refrigerant flows (a superheated region SH3) is formed in the heat transfer tube channels in the upstream flat pipes 92 in the first path P1 (in particular, in the heat transfer tube channels near the upstream first header manifold 52). Moreover, a region in which superheated refrigerant flows (a superheated region SH4) is formed in the heat transfer tube channels in the downstream flat pipes 94 in the fourth path P4 (in particular, in the heat transfer tube channels near the downstream first header manifold 62). As illustrated in FIGS. 24 and 25, the direction in which refrigerant flows in the superheated region SH3 of the upstream heat exchange unit 51A and the direction in which refrigerant flows in the superheated region SH4 of the downstream heat exchange unit 61A are counter to each other (that is, counterflows).

During a heating operation, in the indoor heat exchanger 42A, a region in which subcooled refrigerant flows (a subcooled region SC1) is formed in the heat transfer tube channels in the upstream flat pipes 92 in the second path P2 (in particular, in the heat transfer tube channels near the upstream first header manifold 52). Moreover, a region in which subcooled refrigerant flows (a subcooled region SC2) is formed in the heat transfer tube channels in the upstream flat pipes 92 in the third path P3 (in particular, in the heat transfer tube channels near the upstream first header manifold 52). As illustrated in FIGS. 24 and 25, the subcooled regions SC1 and SC2 of the upstream heat exchange unit 51A and the superheated region SH4 of the downstream heat exchange unit 61A do not overlap at all or do not overlap in most parts thereof in the airflow direction.

One of the upstream heat exchange region 53 and the downstream heat exchange region 63 that does not correspond to a subcooled region during a heating operation is the main heat exchange region. The amount of heat that is exchanged between refrigerant and indoor air in the main heat exchange region is large, compared with that in the subcooled region. In the upstream heat exchange region 53 and the downstream heat exchange region 63, the main heat exchange region has a heat transfer area larger than that of the subcooled region.

(8) Modifications (8-1) Modification 2A

In the second embodiment described above, the capillary tubes CP1 and CP2 adjust the first resistance, which is channel resistance to refrigerant that flows in the upstream heat exchange unit 51A, and the second resistance, which is channel resistance to refrigerant that flows in the downstream heat exchange unit 61A. However, a member that adjusts the first resistance and the second resistance is not limited to the capillary tubes CP1 and CP2, and a member other than a capillary tube may adjust the channel resistances. For example, instead of a capillary tube, a flow-rate adjusting valve, such as the flow-rate adjusting valve 81 described in the first embodiment, may adjust the first resistance and the second resistance during the operation of the refrigeration apparatus 1.

(8-2) Modification 2B

In the second embodiment, adjustment of the first resistance and the second resistance is not limited to adjustment using the two capillary tubes CP1 and CP2. Only one of the capillary tubes may be used. Positions where the capillary tubes are attached are not limited to the first liquid-side port LH1 and the second liquid-side port LH2.

(8-3) Modification 2C

In the second embodiment described above, the temperature sensors 82 to 84, which are used in the first embodiment, are omitted. However, one, two, or all of the temperature sensors 82 to 84 may be used in order to monitor the operation.

(8-4) Modification 2D

Figure 26:
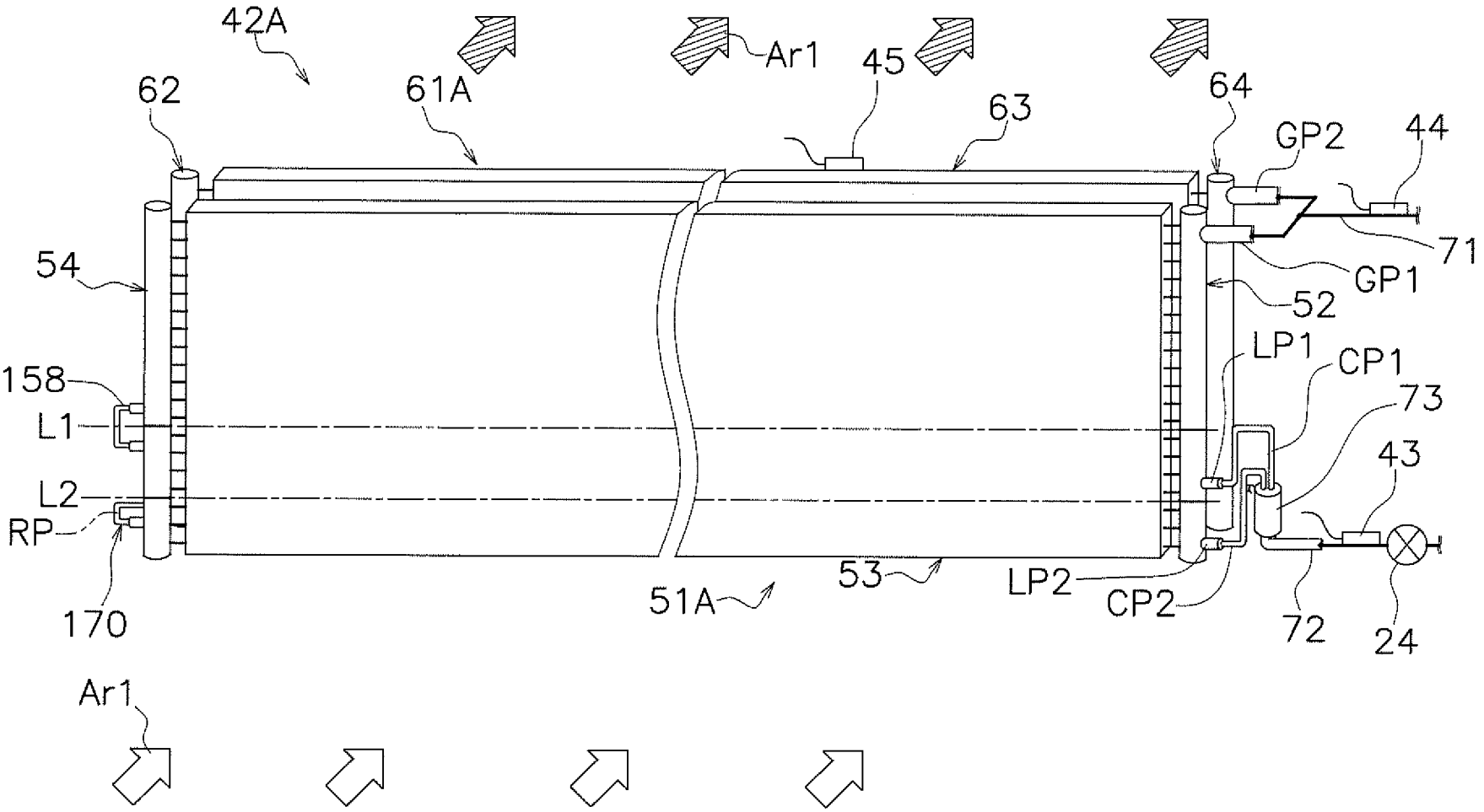
FIG. 26 is a schematic view of an indoor heat exchanger according to modification 2D.

In the second embodiment described above, refrigerant that flows in the upstream heat exchange unit MA and refrigerant that flows in the downstream heat exchange unit 61A flow in opposite directions. However, as illustrated in FIG. 26, refrigerant that flows in the upstream heat exchange unit MA and refrigerant that flows in the downstream heat exchange unit 61A may flow in the same direction.

(8-5) Modification 2E

Figure 27:
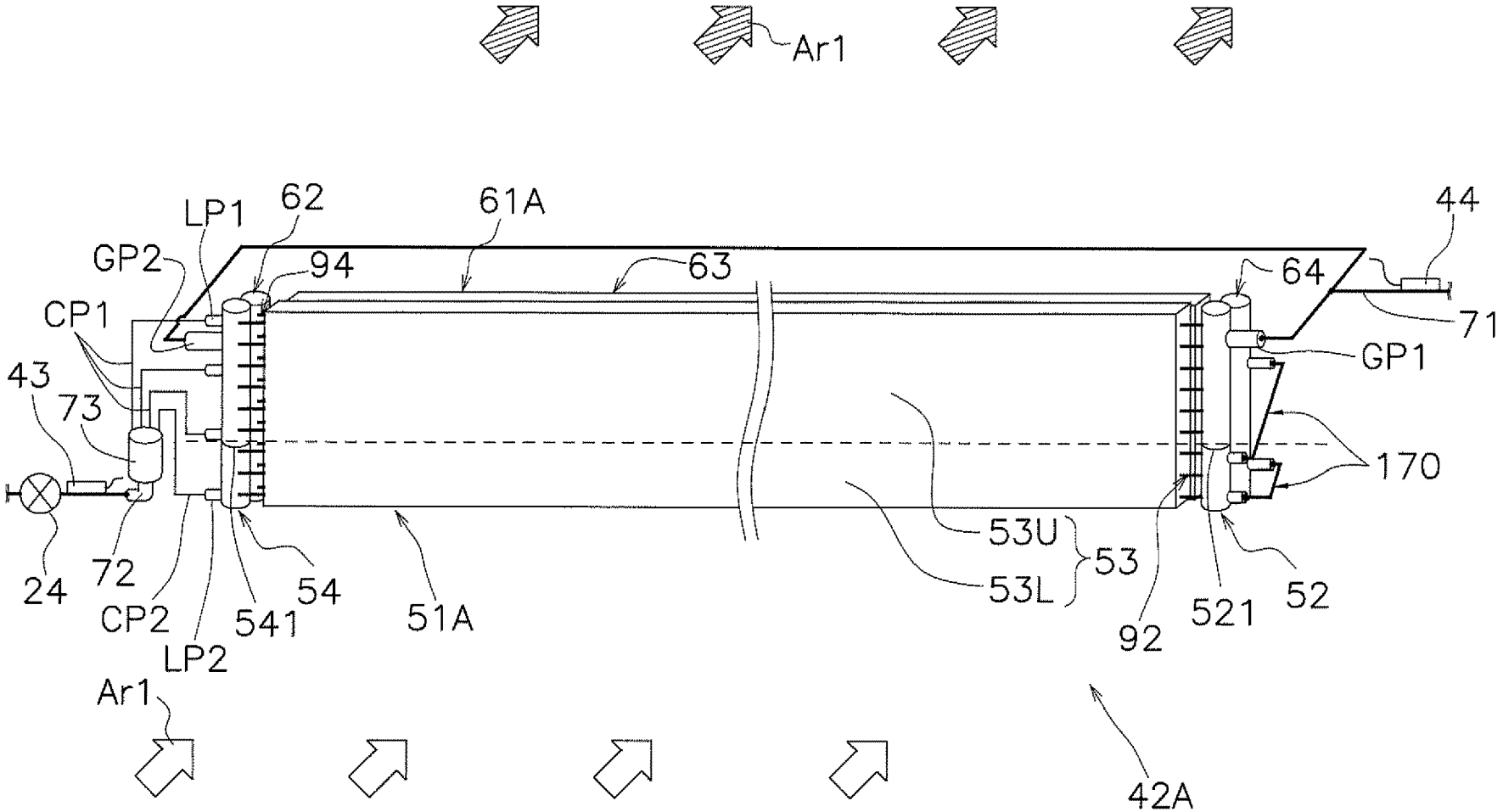
FIG. 27 is a schematic view of an indoor heat exchanger according to modification 2E.

In the second embodiment described above, two paths in which refrigerant in the upstream heat exchange unit 51A and subcooled refrigerant in the downstream heat exchange unit 61A flow are formed in a lower portion of the upstream heat exchange unit 51A. However, for example, as illustrated in FIG. 27, heat exchange of refrigerant that passes through the first gas-side connection pipe GP1 may be performed in an upper portion 53U of the upstream heat exchange region 53, and heat exchange of refrigerant that passes through the second gas-side connection pipe GP2 may be performed in a lower portion 53L of the upstream heat exchange region 53. That is, in the upstream heat exchange unit 51A, a structure according to the second embodiment such that the flow of refrigerant is reversed in the upstream second header manifold 54 or the upstream first header manifold 52 may be omitted. In FIG. 27, portions denoted by reference numerals that are the same as those of FIG. 18 are portions that are the same as those of FIG. 18. In modification 2E, the direction in which refrigerant flows in the upper portion 53U of the upstream heat exchange region 53 and the direction in which refrigerant flows in the downstream heat exchange region 63 are counter to each other. However, the directions of the flows of these refrigerants may be the same as each other.

(8-6) Modification 2F

In the second embodiment described above, the indoor heat exchanger 42A includes the expansion valve 24, the gas-side connection pipe 71, the liquid-side connection pipe 72, the flow splitter 73, and the capillary tubes CP1 and CP2. However, some or all of these may be included, instead of in the indoor heat exchanger 42A, in the refrigerant circuit 10 excluding the indoor heat exchanger 42A. The same applies to the refrigeration apparatus 1 that includes the indoor heat exchanger 42 according to the first embodiment.

(8-7) Modification 2G

In the refrigeration apparatus 1 according to the second embodiment described above, the four-way switching valve 22 can switch the direction of flow of refrigerant in the indoor heat exchanger 42A. When the expansion valve 24 is described as an example, the expansion valve 24 is a flow-rate adjusting valve that adjusts the flow rate of refrigerants that flow into the upstream heat exchange unit 51A and the downstream heat exchange unit 61A before the flow of the refrigerant is split when the indoor heat exchanger 42A functions as an evaporator, and a flow-rate adjusting valve that adjusts the flow rate of refrigerant that has flowed out from the upstream heat exchange unit 51A and the downstream heat exchange unit 61A after the flows of the refrigerant have joined when the indoor heat exchanger 42A functions as a condenser. That is, the expansion valve 24 functions as both of the former flow-rate adjusting valve and the latter flow-rate adjusting valve. However, the indoor heat exchanger 42A is applicable also to a case where a device for changing the direction of flow of refrigerant, such as the four-way switching valve 22, is not provided. For example, when the indoor heat exchanger 42A functions only as an evaporator, the expansion valve 24 may function only as a flow-rate adjusting valve that adjusts the flow rate of refrigerant that flows into the upstream heat exchange unit 51A and the downstream heat exchange unit 61A before the flow of the refrigerant is split. When the indoor heat exchanger 42A functions only as a condenser, the expansion valve 24 may function only as a flow-rate adjusting valve that adjusts the flow rate of refrigerant that has flowed out from the upstream heat exchange unit 51A and the downstream heat exchange unit 61A after the flows of the refrigerant have joined. As with the indoor heat exchanger 42A, the indoor heat exchanger 42 according to the first embodiment may be used for a refrigeration apparatus in which the direction of flow of refrigerant is not switched by using the four-way switching valve 22. That is, naturally, the indoor heat exchanger 42 is applicable also to a case where the indoor heat exchanger 42 functions only as an evaporator or a case where the indoor heat exchanger 42 functions only as a condenser.

(9) Features (9-1)

With the indoor heat exchanger 42A of the refrigeration apparatus 1 described above, the difference between the first resistance, which is channel resistance to refrigerant that flows in the upstream heat exchange unit MA, and the second resistance, which is channel resistance to refrigerant that flows in the downstream heat exchange unit 61A, is adjusted by using the capillary tubes CP1 and CP2, so that the degree of superheating $T_{SH2}$ of refrigerant in the second gas-side connection pipe GP2 (an example of a downstream refrigerant outlet) of the downstream heat exchange unit 61A is smaller than the degree of superheating $T_{SH1}$ of refrigerant in the first gas-side connection pipe GP1 (an example of an upstream refrigerant outlet) of the upstream heat exchange unit 51 when the indoor heat exchanger 42A functions as an evaporator. To be more specific, the first resistance is channel resistance between the gas-side connection pipe 71 and the liquid-side connection pipe 72 via the upstream heat exchange unit MA, and the second resistance is channel resistance between the gas-side connection pipe 71 and the liquid-side connection pipe 72 via the downstream heat exchange unit 61A. As a result, it is possible to make the length $L_{SH2}$ the superheated region in which superheated refrigerant flows in the downstream heat exchange unit 61A sufficiently small and to improve the heat exchange efficiency.

(9-2)

The upstream heat exchange unit 51A of the indoor heat exchanger 42A has the first liquid-side port LH1, which is a first upstream refrigerant outlet, through which refrigerant that flows in from the first gas-side connection pipe GP1, which is an upstream refrigerant inlet that is located adjacent to one end of the plurality of upstream flat pipes 92, flows out when the indoor heat exchanger 42A functions as a condenser. Further, the upstream heat exchange unit 51A has the second liquid-side port LH2, which is a second upstream refrigerant outlet, through which refrigerant that flows in from the second gas-side connection pipe GP2, which is a downstream refrigerant inlet that is located adjacent to the one end of the plurality of upstream flat pipes 92, flows out when the indoor heat exchanger 42A functions as a condenser.

With such a structure, when the indoor heat exchanger 42A functions as a condenser, refrigerant that flows in the downstream heat exchange unit 61A can be subcooled by using the upstream heat exchange unit 51A, and it is possible to increase the amount of refrigerant that is subcooled in the indoor heat exchanger 42. When the indoor heat exchanger 42A functions as a condenser, passing of air that has passed through the superheated region of the upstream heat exchange unit 51A through a subcooled region is reduced. Thus, it is possible to reliably maintain an appropriate degree of subcooling by reliably maintaining a sufficient temperature difference between refrigerant that flows in the subcooled region and air, and to improve the performance of the indoor heat exchanger 42A.

Heretofore, embodiments of the present disclosure have been described. It should be understood that configurations and details may be changed in various ways within the spirit and scope of the present disclosure described in the claims.

REFERENCE SIGNS LIST

1 refrigeration apparatus
10 refrigerant circuit

21 compressor
24 expansion valve (example of second flow-rate adjusting valve and third flow-rate adjusting valve)
42, 42A indoor heat exchanger (example of heat exchanger)
43 liquid-pipe temperature sensor
44 gas-pipe temperature sensor
45 heat-exchanger temperature sensor
81 flow-rate adjusting valve (example of first flow-rate adjusting valve)
82 to 84 temperature sensor
51, 51A upstream heat exchange unit
61, 61A downstream heat exchange unit
92 upstream flat pipe
94 downstream flat pipe
113 to 116 capillary tube

CITATION LIST

Patent Literature

[PTL 1] Japanese Laid-open Patent Publication No. 2016-38192

The invention claimed is:

1. A heat exchanger that is incorporated in a refrigerant circuit in which a vapor compression refrigeration cycle is performed and that functions as an evaporator and/or a condenser, the heat exchanger comprising:

an upstream heat exchange unit disposed upstream in an airflow direction and including a plurality of upstream flat pipes and an upstream refrigerant outlet, the plurality of upstream flat pipes being arranged in a direction that crosses the airflow direction and having one end and the other end, the upstream refrigerant outlet being located at a side of the other end of the plurality of upstream flat pipes;

a downstream heat exchange unit disposed downstream of the upstream heat exchange unit and including a plurality of downstream flat pipes and a downstream refrigerant outlet, the plurality of downstream flat pipes being arranged in a direction that crosses the airflow direction and having one end and the other end, the downstream refrigerant outlet being located at the side of the other end of the plurality of downstream flat pipes, wherein the upstream and downstream heat exchange units are configured to function as an evaporator or a condenser;

a temperature difference detector configured to detect a difference between a degree of superheating of refrigerant at a refrigerant outlet of the upstream heat exchange unit and a degree of superheating of refrigerant at a refrigerant outlet of the downstream heat exchange unit when the heat exchange units function as an evaporator, and detect a difference between a degree of subcooling of refrigerant at the refrigerant outlet of the upstream heat exchange unit and a degree of subcooling of refrigerant at the refrigerant outlet of the downstream heat exchange unit when the heat exchange units function as a condenser;

a flow-rate adjusting device configured to adjust a first resistance to refrigerant flow in the upstream heat exchange unit and a second resistance to refrigerant flow in the downstream heat exchange unit such that a detected temperature difference is a first threshold or larger in degree of superheating when the heat exchange units function as an evaporator or a second threshold or larger in degree of subcooling when the heat exchange units function as a condenser.

2. The heat exchanger according to claim 1, wherein the upstream heat exchange unit and the downstream heat exchange unit are configured in order that: refrigerants flow in the upstream flat pipes and the downstream flat pipes in directions opposite to each other; air that has passed through a vicinity of the one end of the upstream flat pipes passes through a vicinity of the other end of the downstream flat pipes; and air that has passed through a vicinity of the other end of the upstream flat pipes passes through a vicinity of the one end of the downstream flat pipes.

3. The heat exchanger according to claim 1, wherein the first threshold or the second threshold has a value of 3° C. or larger.

4. The heat exchanger according to claim 1, wherein, in the downstream heat exchange unit, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller.

5. The heat exchanger according to claim 1, wherein the first resistance and the second resistance are set in order that the degree of superheating of refrigerant at the downstream refrigerant outlet is constantly smaller than the degree of superheating of refrigerant at the upstream refrigerant outlet when the heat exchanger functions as an evaporator or in order that the degree of subcooling of refrigerant at the downstream refrigerant outlet is constantly smaller than the degree of subcooling of refrigerant at the upstream refrigerant outlet when the heat exchanger functions as a condenser, in a state in which the refrigerant circuit is stably operating.

6. The heat exchanger according to claim 1, wherein the upstream refrigerant outlet includes a first upstream refrigerant outlet through which refrigerant that flows in from an upstream refrigerant inlet that is located adjacent to the one end of the plurality of upstream flat pipes flows out when the heat exchanger functions as a condenser, and a second upstream refrigerant outlet through which refrigerant that flows in from a downstream refrigerant inlet that is located adjacent to the one end of the plurality of upstream flat pipes flows out when the heat exchanger functions as a condenser.

7. The heat exchanger according to claim 1, further comprising:

a first connection pipe in which refrigerant that flows out from the upstream heat exchange unit and refrigerant that flows out from the downstream heat exchange unit join and flow together when the heat exchanger functions as an evaporator.

8. The heat exchanger according to claim 7, further comprising:

a second connection pipe in which refrigerant that flows out from the upstream heat exchange unit and refrigerant that flows out from the downstream heat exchange unit join and flow together when the heat exchanger functions as a condenser.

9. The heat exchanger according to claim 1, further comprising:

an expansion valve configured to function as a flow-rate adjusting valve that adjusts a flow rate of refrigerant that flows into the upstream heat exchange unit and the downstream heat exchange unit before a flow of the refrigerant is split when the heat exchanger functions as an evaporator, and/or to function as a flow-rate adjusting valve that adjusts a flow rate of refrigerant that has flowed out from the upstream heat exchange unit and the downstream heat exchange unit after flows of the refrigerant have joined when the heat exchanger functions as a condenser.

10. The heat exchanger according to claim 2, wherein, in the downstream heat exchange unit, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller.

11. The heat exchanger according to claim 3, wherein, in the downstream heat exchange unit, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller.

12. A heat exchanger that is incorporated in a refrigerant circuit in which a vapor compression refrigeration cycle is performed and that functions as an evaporator and/or a condenser, the heat exchanger comprising:

an upstream heat exchange unit disposed upstream in an airflow direction and including a plurality of upstream flat pipes and an upstream refrigerant outlet, the plurality of upstream flat pipes being arranged in a direction that crosses the airflow direction and having one end and the other end, the upstream refrigerant outlet being located at a side of the other end of the plurality of upstream flat pipes;

a downstream heat exchange unit disposed downstream of the upstream heat exchange unit and including a plurality of downstream flat pipes and a downstream refrigerant outlet, the plurality of downstream flat pipes being arranged in a direction that crosses the airflow direction and having one end and the other end, the downstream refrigerant outlet being located at the side of the other end of the plurality of downstream flat pipes;

flow-rate adjusting member configured to adjust a first resistance to refrigerant flow in the upstream heat exchange unit and a second resistance to refrigerant flow in the downstream heat exchange unit, in order that a degree of superheating of refrigerant at the downstream refrigerant outlet is smaller than a degree of superheating of refrigerant at the upstream refrigerant outlet when the heat exchanger functions as an evaporator or in order that a degree of subcooling of refrigerant at the downstream refrigerant outlet is smaller than a degree of subcooling of refrigerant at the upstream refrigerant outlet when the heat exchanger functions as a condenser, wherein, the flow-rate adjusting member includes at least one capillary tube positioned in the upstream heat exchange unit and/or the downstream heat exchange unit, the at least one capillary tube being configured so as to generate a difference in degree of superheating between the upstream and downstream heat exchange units that is a first threshold or larger when the heat exchanger functions as an evaporator or so as to generate a difference in degree of sub cooling that is a second threshold or larger when the heat exchanger functions as a condenser.

13. The heat exchanger according to claim 12, wherein the first threshold or the second threshold has a value of 3° C. or larger.

14. The heat exchanger according to claim 12, wherein, in the downstream heat exchange unit, the degree of superheating of refrigerant at the downstream refrigerant outlet when the heat exchanger functions as an evaporator or the degree of subcooling of refrigerant at the downstream refrigerant outlet when the heat exchanger functions as a condenser is adjusted to be 2° C. or smaller.

15. A refrigeration apparatus comprising:

a compressor that is incorporated in a refrigerant circuit in which a vapor compression refrigeration cycle is performed; and a heat exchanger that is disposed on a suction side or a discharge side of the compressor and that performs heat exchange that evaporates refrigerant sucked into the compressor or heat exchange that condenses refrigerant discharged from the compressor, wherein the heat exchanger includes an upstream heat exchange unit that is disposed upstream in an airflow direction and that includes a plurality of upstream flat pipes that are arranged in a direction that crosses the airflow direction, an upstream refrigerant inlet that is located adjacent to one end of the plurality of upstream flat pipes, and an upstream refrigerant outlet that is located adjacent to the other end of the plurality of upstream flat pipes, and a downstream heat exchange unit that is disposed downstream of the upstream heat exchange unit and that includes a plurality of downstream flat pipes that are arranged in a direction that crosses the airflow direction, a downstream refrigerant inlet that is located adjacent to one end of the plurality of downstream flat pipes, and a downstream refrigerant outlet that is located adjacent to the other end of the plurality of upstream flat pipes;

a temperature difference detector configured to detect a difference between a degree of superheating of refrigerant at a refrigerant outlet of the upstream heat exchange unit and a degree of superheating of refrigerant at a refrigerant outlet of the downstream heat exchange unit when the heat exchange units function as an evaporator, and detect a difference between a degree of subcooling of refrigerant at the refrigerant outlet of the upstream heat exchange unit and a degree of subcooling of refrigerant at the refrigerant outlet of the downstream heat exchange unit when the heat exchanger functions as a condenser;

flow-rate adjusting device configured to adjust a first resistance to refrigerant flow in the upstream heat exchange unit and a second resistance to refrigerant flow in the downstream heat exchange unit such that a detected temperature difference is a first threshold or larger in degree of superheating when the heat exchange units function as an evaporator or a second threshold or larger in degree of subcooling when the heat exchanger functions as a condense.

16. The refrigeration apparatus according to claim 15, wherein the first resistance and the second resistance are set in order that the degree of superheating of refrigerant at the downstream refrigerant outlet is constantly smaller than the degree of superheating of refrigerant at the upstream refrigerant outlet when the heat exchanger functions as an evaporator or in order that the degree of subcooling of refrigerant at the downstream refrigerant outlet is constantly smaller than the degree of subcooling of refrigerant at the upstream refrigerant outlet when the heat exchanger functions as a condenser, in a state in which the compressor is stably operated at a constant operation frequency.

17. A refrigeration apparatus comprising:

a compressor that is incorporated in a refrigerant circuit in which a vapor compression refrigeration cycle is performed; and a heat exchanger that is disposed on a suction side or a discharge side of the compressor and that performs heat exchange that evaporates refrigerant sucked into the compressor or heat exchange that condenses refrigerant discharged from the compressor, wherein the heat exchanger includes an upstream heat exchange unit that is disposed upstream in an airflow direction and that includes a plurality of upstream flat pipes that are arranged in a direction that crosses the airflow direction, an upstream refrigerant inlet that is located adjacent to one end of the plurality of upstream flat pipes, and an upstream refrigerant outlet that is located adjacent to the other end of the plurality of upstream flat pipes;

a downstream heat exchange unit that is disposed downstream of the upstream heat exchange unit and that includes a plurality of downstream flat pipes that are arranged in a direction that crosses the airflow direction, a downstream refrigerant inlet that is located adjacent to one end of the plurality of downstream flat pipes, and a downstream refrigerant outlet that is located adjacent to the other end of the plurality of upstream flat pipes; and a flow-rate adjusting member configured to adjust a first resistance to refrigerant flow in the upstream heat exchange unit and a second resistance to refrigerant flow in the downstream heat exchange unit so that a degree of superheating of refrigerant at the downstream refrigerant outlet is smaller than a degree of superheating of refrigerant at the upstream refrigerant outlet when the heat exchanger functions as an evaporator or so that a degree of subcooling of refrigerant at the downstream refrigerant outlet is smaller than a degree of subcooling of refrigerant at the upstream refrigerant outlet when the heat exchanger functions as a condenser, wherein the flow-rate adjusting member includes at least one capillary tube positioned in the upstream heat exchange unit and/or the downstream heat exchange unit, the at least one capillary tube being configured so as to generate a difference in degree of superheating between the upstream and downstream heat exchange units that is a first threshold or larger when the heat exchanger functions as an evaporator or so as to generate a difference in degree of subcooling that is a second threshold or larger when the heat exchanger functions as a condenser.

* * * * *